US007839240B2

(12) United States Patent
Guan

(10) Patent No.: US 7,839,240 B2
(45) **Date of Patent: *Nov. 23, 2010**

(54) REFLECTION-TYPE BANPASS FILTER

(75) Inventor: Ning Guan, Sakura (JP)

(73) Assignee: Fujikura Ltd., Tokyo (JP)

( * ) Notice: Subject to any disclaimer, the term of this patent is extended or adjusted under 35 U.S.C. 154(b) by 222 days.

This patent is subject to a terminal disclaimer.

(21) Appl. No.: 11/867,544

(22) Filed: Oct. 4, 2007

(65) Prior Publication Data

US 2008/0084256 A1 Apr. 10, 2008

(30) Foreign Application Priority Data

Oct. 5, 2006 (JP) ..... 2006-274324

(51) Int. Cl.
*H01P 1/203* (2006.01)

(52) U.S. Cl. ..... 333/204

(58) Field of Classification Search ..... 333/202, 333/204, 238, 166–168, 175, 176, 185
See application file for complete search history.

(56) References Cited

U.S. PATENT DOCUMENTS

| | | | | |
|---|---|---|---|---|
| 2,411,555 | A | 11/1946 | Rogers | |
| 3,617,877 | A | 11/1971 | Hobson | |
| 4,371,853 | A | 2/1983 | Makimoto et al. | |
| 4,992,760 | A | 2/1991 | Takeda et al. | |
| 5,418,507 | A * | 5/1995 | Keane et al. | 333/202 |
| 5,525,953 | A | 6/1996 | Okada et al. | |
| 5,923,295 | A | 7/1999 | Nakano et al. | |
| 6,323,740 | B1 | 11/2001 | Ishikawa et al. | |
| 6,353,371 | B1 | 3/2002 | Kadota et al. | |
| 6,563,403 | B2 * | 5/2003 | Kanba et al. | 333/204 |
| 6,577,211 | B1 * | 6/2003 | Tsujiguchi | 333/204 |
| 6,603,376 | B1 | 8/2003 | Handforth et al. | |
| 6,686,808 | B1 | 2/2004 | Sugawara et al. | |
| 6,924,714 | B2 * | 8/2005 | Jain | 333/123 |
| 2005/0140472 | A1 | 6/2005 | Ko et al. | |
| 2006/0061438 | A1 * | 3/2006 | Toncich | 333/205 |

(Continued)

FOREIGN PATENT DOCUMENTS

CH 663 690 A5 12/1987

(Continued)

OTHER PUBLICATIONS

Le Roy, et al., "Novel Circuit Models of Arbitrary-Shape Line: Application to Parallel Coupled Microstrip Filters with Suppression of Multi-Harmonic Responses", 2005 European Microwave Conference CNIT La Defense Paris, France Oct. 4-6 2005, Oct. 4, 2005, pp. 921-924, IEEE, Piscataway, NJ, USA, XP010903914.

(Continued)

*Primary Examiner*—Benny Lee
*Assistant Examiner*—Gerald Stevens
(74) *Attorney, Agent, or Firm*—Sughrue Mion, PLLC

(57) ABSTRACT

Provided is a reflection-type bandpass filter for ultra-wide-band wireless data communication. The filter includes a substrate including a dielectric layer and a conducting layer layered on the top and bottom surfaces thereof, and a center conductor provided within the dielectric layer and serving as a strip line. A width distribution of the center conductor is non-uniform in a length direction of the center conductor.

12 Claims, 15 Drawing Sheets

U.S. PATENT DOCUMENTS

| | | | |
|---|---|---|---|
| 2006/0255886 | A1 | 11/2006 | Ninomiya et al. |
| 2007/0159276 | A1 | 7/2007 | Han et al. |
| 2007/0210880 | A1 | 9/2007 | Bobier et al. |

FOREIGN PATENT DOCUMENTS

| | | | |
|---|---|---|---|
| CN | 1097082 | A | 1/1995 |
| JP | 56-64501 | A | 6/1981 |
| JP | 9-172318 | A | 6/1997 |
| JP | 9-232820 | A | 9/1997 |
| JP | 10-65402 | A | 3/1998 |
| JP | 10-242746 | A | 9/1998 |
| JP | 2000-4108 | A | 1/2000 |
| JP | 2000-101301 | A | 4/2000 |
| JP | 2002-43810 | A | 2/2002 |
| SU | 1 728 904 | A1 | 4/1992 |

OTHER PUBLICATIONS

Le Roy et al., "A New Design of Microwave Filters by Using Continuously Varying Transmission Lines", Microwave Symposium Digest 1997, IEEE MTT-S International Denver, CO, USA Jun. 8-13, 1997, Jun. 8, 1997, pp. 639-642, vol. 2, IEEE, New York, NY, US, XP010228412.

A.V. Oppenheim and R. W. Schafer, "Discrete-time signal processing", pp. 465-478, Prentichall, 1998.

G-B.Xiao, K. Yashiro, N, Guan, and S. Ohokawa, "An effective method for designing nonuniformly coupled transmission-line filters", IEEE Trans. Microwave Theory tech., vol. 49, pp. 1027-1031, Jun. 2001.

Y. konishi, "Microwave integrated circuits", pp. 9-11, Marcel Dekker, 1991.

Y. Konishi, "Microwave Integrated Circuits", 1991, pp. 19-21, Marcel Dekker.

Mirshekar-Syahkal et al., "Accurate Analysis of Tapered Planar Transmission Lines for Microwave Integrated Circuits", IEEE Transactions on Microwave Theory and Techniques, Feb. 1981, pp. 123-128, vol. 29, No. 2, IEEE.

Wang et al., "Ultra-Wideband Bandpass Filter with Hybrid Microstrip/CPW Structure", IEEE Microwave and Wireless Components Letters, Dec. 2005, pp. 844-846, vol. 15, No. 12, IEEE.

Chen et al., "Design of a UWB low insertion loss bandpass filter with spurious response suppression," Microwave Journal, Feb. 2006, pp. 112-116.

Xiao, et al., "A New Numerical Method for Synthesis of Arbitrarily Terminated Lossless Nonuniform Transmission Lines", IEEE Transactions on Microwave Theory and Techniques, Feb. 2001, pp. 369-376, vol. 49, No. 2, IEEE Service Center, Piscataway, NJ, US, XP011038268.

Xiao, et al., "Impedance Matching for Complex Loads Through Nonuniform Transmission Lines", IEEE Transactions on Microwave Theory and Techniques, Jun. 2002, pp. 1520-1525, vol. 50, No. 6, IEEE Service Center, Piscataway, NJ, US, XP011076613.

Chang, et al., "Wide-Band Equal-Ripple Filters in Nonuniform Transmission Lines", IEEE Transactions on Microwave Theory and Techniques, Apr. 2002, pp. 1114-1119, vol. 50, No. 4, IEEE Service Center, Piscataway, NJ, US, XP011076539.

Moreira, et al., "Direct Synthesis of Microwave Filters Using Inverse Scattering Transmission-Line Matrix Method", IEEE Transactions on Microwave Theory and Techniques, Dec. 2000, pp. 2271-2276, vol. 48, No. 12, IEEE Service Center, Piscataway, NJ, US, XP011038181.

Huang, "Quasi-Transversal Synthesis of Microwave Chirped Filters", Electronics Letters, May 21, 1992, pp. 1062-1064, vol. 28, No. 11, IEE Stevenage, GB, XP000305900.

Deng et al., "Multiple-Mode Resonance Bands in Periodically Nonuniform Conductor-Backed Coplanar Waveguides", Microwave Conference, 1999 Asia Pacific Singapore Nov. 30-Dec. 3, 1999, pp. 5-8, vol. 1, IEEE, Piscataway, NJ, USA, XP010374097.

Xiao et al, "An Efficient Algorithm for Solving Zakharov-Shabat Inverse Scattering Problem", IEEE Transactions on Antennas and Propagation, Jun. 2002, pp. 807-811, vol. 50, No. 6, IEEE.

Tan et al., "Analysis and design of conductor-backed asymmetric coplanar waveguide lines using conformal mapping techniques and their application to end-coupled filters," IEICE Trans. Electron., Jul. 1999, pp. 1098-1103, vol. E82-C, No. 7.

Sun et al., "Guided-Wave Characteristics of Periodically Nonuniform Coupled Microstrip Lines-Even and Odd Modes" IEEE Transaction on Microwave Theory and Techniques, IEEE Service Center. Piscataway, NJ, US, vol. 53, No. 4 Apr. 2005, pp. 1221-1227.

Cheng et al., "Inverse Scattering of Nonuniform, Symmetrical Coupled Lines" IEEE Microwave and Guided Wave Letters, IEEE Inc, New York, US, vol. 8, No. 7, (Jul. 1998), pp. 260-262.

Ma et al., "Experimentally investigating slow-wave transmission lines and filters based on conductor-backed CPW periodic cells" Microwave Symposium Digest, 2005 IEEE MTT-S International Long Beach, CA, USA Jun. 12-17, 2005, Piscataway, NJ, USA IEEE, pp. 1653-1656.

Young et al., "Accurate non-uniform transmission line model and its application to the de-embedding of on-wafer measurements" IEE Proceedings H. Microwaves, Antennas & Propagation, Institution of Electrical Engineers. Stevenage , GB, vol. 148, No. 3, Jun. 11, 2001, pp. 153-156, XP006016881.

Boulejfen et al., "A robust and efficient method for the frequency domain analysis of non-uniform, lossy multi-line transmission structures" Microwave Symposium Digest, 1998 IEEE MTT-S International Baltimore, MD, USA Jun. 7-12, 1998, pp. 1763-1766, XP010290106.

Marc Le Roy et al., "The Continuously Varying Transmission-Line Technique-Application to Filter Design", IEEE Transactions on Microwave Theory and Techniques, Sep. 1999, pp. 1680-1687, vol. 47, No. 9, IEEE.

Te-Wen Pan et al., "Arbitrary Filter Design by Using Non uniform Transmission Lines", IEEE Microwave and Guided Wave Letters, Feb. 1999, pp. 60-62, vol. 9, No. 2, IEEE.

Guo-Min Yang et al., "Design of Dual Passband Filter Based on Zakharov-Shabat Inverse Scattering Problem", APMC2005 Proceedings, Dec. 4-7, 2005, pp. 1-3, IEEE.

P. Ghanipour et al., "Suppression Mode Coupling in Conductor-Backer Asymmetric Coplanar Strips Using Slow-Wave Electrodes", IEEE Microwave and Wireless Components Letters, May 2006, vol. 16, No. 5, 272-274.

L. Vegni et al., "Tapered Stripline Embedded in Inhomogeneous Media as Microwave Matching Line", IEEE Transaction on Microwave Theory and Techniques, IEEE, May 2001, vol. 49, No. 5, pp. 970-978.

Japanese Office Action issued in related Japanese Patent Application No. 2006-274327 with English language translation mailed Jun. 22, 2010.

Japanese Office Action issued in related Japanese Patent Application No. 2006-274326 with English language translation mailed Jun. 22, 2010.

Japan Office Action issued in related Japanese Patent Application No. 2006-274324 with English language translation mailed Jun. 22, 2010.

Y. Qian and E. Yamashita, "Additional Approximate formulas and Experimental Data on Micro-Coplanar Striplines,"IEEE Transaction on Microwave Theory and Techniques, IEEE, Apr. 1990, vol. 38, No. 4, pp. 443-445.

J. Svacina, "Special Types of Coplanar Transmission Lines Suitable UP to mm-Wave Bands,"6th Topical Meeting on Electrical Performance of Electronic Packaging, IEEE, Oct. 1997, pp. 99-102.

* cited by examiner

REFLECTION-TYPE BANPASS FILTER

This application claims priority from Japanese Patent Application No. 2006-274324, filed on Oct. 5, 2006, the entire contents of which are incorporated herein by reference.

BACKGROUND OF THE INVENTION

1. Field of the Invention

Apparatuses consistent with the present invention relate to a reflection-type bandpass filter for use in ultra-wideband (UWB) wireless data communication.

2. Description of the Related Art

As technology of the art related to embodiments of this invention, for example, the technology disclosed in the following references 1 through 12 is known.

Reference 1: Specification of U.S. Pat. No. 2,411,555

Reference 2: Japanese Unexamined Patent Application No. 56-64501

Reference 3: Japanese Unexamined Patent Application No. 9-172318

Reference 4: Japanese Unexamined Patent Application No. 9-232820

Reference 5: Japanese Unexamined Patent Application No. 10-65402

Reference 6: Japanese Unexamined Patent Application No. 10-242746

Reference 7: Japanese Unexamined Patent Application No. 2000-4108

Reference 8: Japanese Unexamined Patent Application No. 2000-101301

Reference 9: Japanese Unexamined Patent Application No. 2002-43810

Reference 10: A. V. Oppenheim and R. W. Schafer, "Discrete-time signal processing," pp. 465-478, Prentice Hall, 1998.

Reference 11: G-B. Xiao, K. Yashiro, N. Guan, and S. Ohokawa, "An effective method for designing nonuniformly coupled transmission-line filters," IEEE Trans. Microwave Theory Tech., vol. 49, pp. 1027-1031, June 2001.

Reference 12: Y. Konishi, "Microwave integrated circuits", pp. 9-11, Marcel Dekker, 1991

However, the bandpass filters proposed in the related art may not satisfy the FCC specifications, due to manufacturing tolerances and other reasons.

Further, bandpass filters having an open construction with the microstrip line exposed are easily affected by external influences.

This invention was devised in light of the above circumstances, and has as an exemplary object the provision of a high-performance UWB reflection-type bandpass filter which is not easily affected by external influences, and which satisfies FCC specifications.

SUMMARY OF THE INVENTION

Exemplary embodiments of this invention provide a reflection-type bandpass filter for ultra-wideband wireless data communication, having a substrate comprising a dielectric layer and a conducting layer layered on the top and bottom surfaces thereof, and a center conductor provided within the dielectric layer and serving as the strip line, and in which the center conductor width distribution is non-uniform in the length direction thereof.

By using exemplary embodiments of a UWB reflection-type bandpass filter of this invention, U.S. Federal Communications Commission requirements for spectrum masks can be satisfied.

In a reflection-type bandpass filter of an exemplary embodiment of this invention, there may be a difference of 10 dB or higher between a reflectance in a range of frequencies f for which $f<3.1$ GHz and $f>10.6$ GHz, and a reflectance in a range of frequencies 3.7 GHz$\leqq f \leqq$10.0 GHz, and in a range 3.7 GHz$\leqq f \leqq$10.0 GHz a group delay variation may be within ±0.05 ns.

In a reflection-type bandpass filter of another exemplary embodiment of this invention, there may be a difference of 10 dB or greater between a reflectance in a range of frequencies f for which $f<3.1$ GHz and $f>10.6$ GHz, and a reflectance in a range of frequencies 3.9 GHz$\leqq f \leqq$9.8 GHz, and in a range 3.9 GHz$\leqq f \leqq$9.8 GHz the group delay variation may be within ±0.07 ns.

In a reflection-type bandpass filter of another exemplary embodiment of this invention, there may be a difference of 10 dB or greater between a reflectance in a range of frequencies f for which $f<3.1$ GHz and $f>10.6$ GHz, and a reflectance in a range of frequencies 4.4 GHz$\leqq f \leqq$9.2 GHz, and in a range 4.4 GHz$\leqq f \leqq$9.2 GHz a group delay variation may be within ±0.05 ns.

In a reflection-type bandpass filter of another exemplary embodiment of this invention, there may be a difference of 10 dB or greater between a reflectance in a range of frequencies f for which $f<3.1$ GHz and $f>10.6$ GHz, and a reflectance in a range of frequencies 3.8 GHz$\leqq f \leqq$9.8 GHz, and in a range 3.8 GHz$\leqq f \leqq$9.8 GHz a group delay variation may be within ±0.2 ns.

In a reflection-type bandpass filter of another exemplary embodiment of this invention, there may be a difference of 10 dB or greater between a reflectance in a range of frequencies f for which $f<3.1$ GHz and $f>10.6$ GHz, and a reflectance in a range of frequencies 3.7 GHz$\leqq f \leqq$10.0 GHz, and in a range 3.7 GHz$\leqq f \leqq$10.0 GHz a group delay variation may be within ±0.1 ns.

In a reflection-type bandpass filter of an exemplary embodiment of this invention, a characteristic impedance Zc of an input terminal of the filter may be in a range $10\Omega \leqq Zc \leqq 300\Omega$.

Further, a resistance having the same impedance as the characteristic impedance value, or a non-reflecting terminator, may be provided on the terminating side of the filter.

In a reflection-type bandpass filter of an exemplary embodiment of this invention, the center conductor and the conducting layers of the substrate may comprise metal plates of thickness equal to or greater than a skin depth at f=1 GHz.

In a reflection-type bandpass filter of an exemplary embodiment of this invention, the dielectric layer may have a thickness h in a range 0.1 mm$\leqq h \leqq$10 mm, a relative permittivity $\epsilon_r$ in a range $1 \leqq \epsilon_r \leqq 100$, a width W in a range 2 mm$\leqq W \leqq$100 mm, and a length L be in a range 2 mm$\leqq L \leqq$500 mm.

In a reflection-type bandpass filter of an exemplary embodiment of this invention, a length-direction distribution of the center conductor width may satisfy a design method based on the inverse problem of deriving a potential from spectral data in the Zakharov-Shabat equation.

In a reflection-type bandpass filter of an exemplary embodiment of this invention, a length-direction distribution of the center conductor width may satisfy a window function method.

In a reflection-type bandpass filter of an exemplary embodiment of this invention, a length-direction distribution of the center conductor width may satisfy a Kaiser window function method.

According to exemplary embodiments, by applying a window function technique to design a reflection-type bandpass filter comprising a non-uniform microstrip line, the pass band can be made extremely broad compared with bandpass filters of the prior art, and variations in the group delay within the pass band can be made extremely small, so that a UWB reflection-type bandpass filter which satisfies FCC specifications can be realized.

Further, in an exemplary configuration in which the center conductor is provided in the interior of dielectric layers with conductor layers on both faces, the filter is not easily affected by external influences, and stable filter characteristics can be obtained.

BRIEF DESCRIPTION OF THE DRAWINGS

The above and other aspects and advantages of the present invention will become more apparent by describing in detail exemplary embodiments thereof with reference to the attached drawings in which.

DESCRIPTION OF THE PREFERRED EMBODIMENTS

Figure 1:
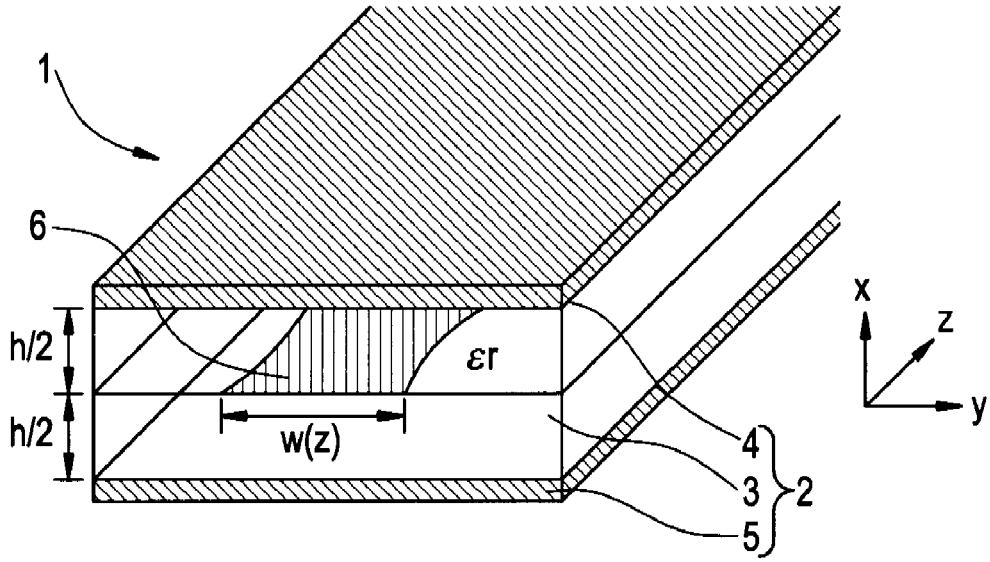
FIG. 1 is a perspective view showing one aspect of a reflection-type bandpass filter of an exemplary embodiment of the invention.

Below, exemplary aspects of the invention are explained referring to the drawings.

FIG. 1 is a perspective view showing in summary the configuration of a reflection-type bandpass filter of an exemplary embodiment of this invention. In the figure, the symbol 1 is the reflection-type bandpass filter, 2 is a substrate, 3 is a dielectric layer, 4 and 5 are conductive layers, and 6 is a center conductor.

The reflection-type bandpass filter 1 of this aspect has a substrate 2, which in turn has a dielectric layer 3 and conducting layers 4 and 5 layered on the top and bottom surfaces thereof, and a center conductor 6 which serves as a strip line, provided within the dielectric layer 3; the center conductor 6 has a width which is distributed non-uniformly in the length direction.

As shown in FIG. 1, the z axis is taken along the length direction of the center conductor 6, the y axis is orthogonal to the z axis and in the direction parallel to the surface of the substrate 2, and the x axis is taken in the direction orthogonal to the y axis and z axis. Also, the length of the filter extending in the z-axis direction from the input-side face is taken to be z.

This reflection-type bandpass filter 1 has a structure in which the center conductor 6 is shielded by the conducting layers 4, 5, so that compared with bandpass filters in which the microstrip line is exposed to the outside, the reflection-type bandpass filter 1 is not easily affected by external influences.

A reflection-type bandpass filter of an exemplary embodiment of this invention adopts a configuration in which stop band rejection (the difference between the reflectance in the pass band, and the reflectance in the stop band) is increased, by using a window function method (see Reference 10) employed in digital filter design. By this means, instead of expansion of the transition frequency region (the region between the pass band boundary and the stop band boundary), the stop band rejection can be increased. As a result, manufacturing tolerances can be increased. Also, variation in the group delay within the pass band is decreased.

Figure 28:
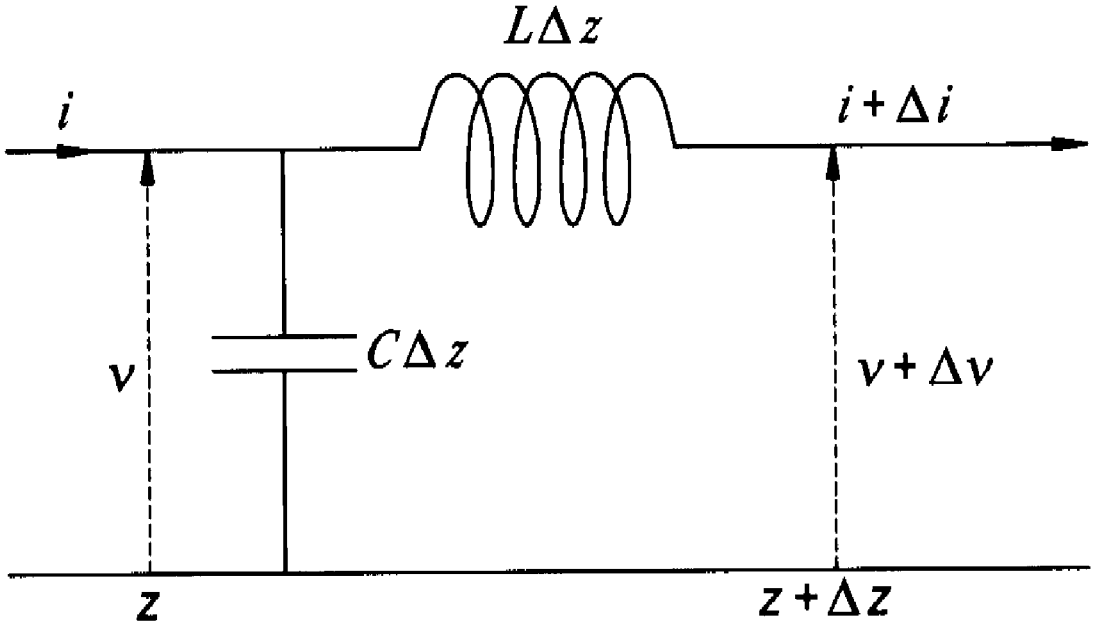

The transmission line of a reflection-type bandpass filter 1 of an exemplary embodiment of this invention can be represented by a non-uniformly distributed constant circuit such as in FIG. 28.

From FIG. 28, the following equation (1) can be obtained for the line voltage v(z,t) and the line current i(z,t).

$$\begin{cases} -\dfrac{\partial v(z,t)}{\partial z} = L(z)\dfrac{\partial i(z,t)}{\partial t}, \\ -\dfrac{\partial i(z,t)}{\partial z} = C(z)\dfrac{\partial v(z,t)}{\partial t}. \end{cases} \quad \text{(equation 1)}$$

Here L(z) and C(z) are the inductance and capacitance respectively per unit length in the transmission line. Here, the function of equation (2) is introduced.

$$\begin{cases} \dfrac{\partial \phi_1(z,t)}{\partial z} = -\dfrac{1}{c(z)}\dfrac{\partial \phi_1(z,t)}{\partial t} - \dfrac{1}{2}\dfrac{d\ \ln Z(z)}{dz}\phi_2(z,t), \\ \dfrac{\partial \phi_2(z,t)}{\partial z} = \dfrac{1}{c(z)}\dfrac{\partial \phi_2(z,t)}{\partial t} - \dfrac{1}{2}\dfrac{d\ \ln Z(z)}{dz}\phi_1(z,t). \end{cases} \quad \text{(equation 2)}$$

Here $Z(z)=\sqrt{\{L(z)/C(z)\}}$ is the local characteristic impedance, and $\phi_1$, $\phi_2$ are the power wave amplitudes propagating in the +z and −z directions respectively.

Substitution into equation (1) yields equation (3).

$$\begin{cases} \dfrac{\partial \phi_1(z,t)}{\partial z} = -\dfrac{1}{c(z)}\dfrac{\partial \phi_1(z,t)}{\partial t} - \dfrac{1}{2}\dfrac{d\ \ln Z(z)}{dz}\phi_2(z,t), \\ \dfrac{\partial \phi_2(z,t)}{\partial z} = \dfrac{1}{c(z)}\dfrac{\partial \phi_2(z,t)}{\partial t} - \dfrac{1}{2}\dfrac{d\ \ln Z(z)}{dz}\phi_1(z,t). \end{cases} \quad \text{(equation 3)}$$

Here $c(z)=1/\sqrt{\{L(z)/C(z)\}}$. If the time factor is set to exp ($j\omega t$), and a variable transformation is performed as in equation (4) below, then the Zakharov-Shabat equation of equation (5) is obtained.

$$x(z) = \int_0^z \frac{ds}{c(s)} \quad \text{(equation 4)}$$

$$\begin{cases} \dfrac{\partial \phi_1(x)}{\partial x} + j\omega\phi_1(x) = -q(x)\phi_2(x), \\ \dfrac{\partial \phi_2(x)}{\partial x} - j\omega\phi_2(x) = -q(x)\phi_1(x). \end{cases} \quad \text{(equation 5)}$$

Here q(x) is as given by equation (6) below.

$$q(x) = \frac{1}{2}\frac{d\ \ln Z(x)}{dx}. \quad \text{(equation 6)}$$

The Zakharov-Shabat inverse problem involves synthesizing the potential q(x) from spectral data which is a solution satisfying the above equations (see Reference 11). If the potential q(x) is found, the local characteristic impedance Z(x) is determined as in equation (7) below.

$$Z(x) = Z(0)\exp\left[2\int_0^x q(s)\,ds\right]. \quad \text{(equation 7)}$$

Here, according to related art, in a process to determine the potential q(x), the reflectance coefficient r(x) in x space is calculated from the spectra data reflectance coefficient R(ω) using the following equation (8), and q(x) are obtained from r(x).

$$r(x) = \frac{1}{2\pi}\int_{-\infty}^{\infty} R(\omega)e^{-j\omega x}\,d\omega \quad \text{(equation 8)}$$

In exemplary embodiments of this invention, in place of obtaining r(x) from the R(ω) for ideal spectral data, a window function is applied as in equation (9) to determine r'(x).

$$r'(x)=w(x)r(x) \quad \text{(equation 9)}$$

Here ω(x) is the window function. If the window function is selected appropriately, the stop band rejection level can be appropriately controlled. Here, a Kaiser window is used as an example. The Kaiser window is defined as in equation (10) below (see Reference 10).

$$\omega[n] = \begin{cases} \dfrac{I_0\left[\beta(1-[(n-\alpha)/\alpha]^2)^{1/2}\right]}{I_0(\beta)}, & 0 \le n \le M, \\ 0, & \text{otherwise} \end{cases} \quad \text{(equation 10)}$$

Here α=M/s, and β is determined empirically as in equation (11) below.

$$\beta = \begin{cases} 0.1102(A-8.7), & A > 50, \\ 0.5842(A-21)^{0.4} + 0.07886(A-21), & 21 \le A \le 50, \\ 0, & A < 21 \end{cases} \quad \text{(equation 11)}$$

Here $A=-20\log_{10}\delta$. where δ is the peak approximation error in the pass band and in the stop band.

In this way q(x) is determined, and from equation (7) the local characteristic impedance Z(x) is determined.

Figure 2:
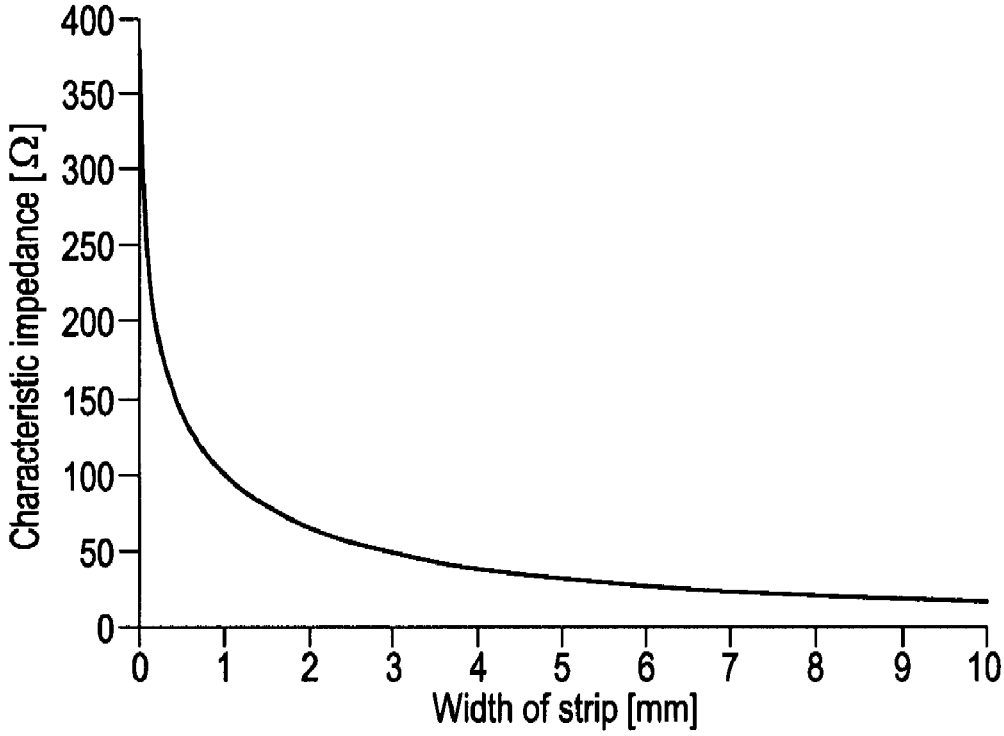
FIG. 2 is a graph showing the center conductor width dependence of the characteristic impedance in a reflection-type bandpass filter of an exemplary embodiment of this invention.

Here, when the width w of the center conductor 6 (hereafter the "center conductor width w") is changed in the strip line of an exemplary embodiment of this invention, the local characteristic impedance can be changed. FIG. 2 shows the dependence of the local characteristic impedance of the strip line on the center conductor width w when the thickness h of the dielectric layer 3 is 2 mm and the relative permittivity $\in_r$ of the dielectric layer 3 is 1.

In exemplary embodiments of this invention, the center conductor width w was calculated based on the local characteristic impedance obtained from equation (7), and bandpass filters 1 were fabricated so as to satisfy the calculated center conductor width w. By this means, reflection-type bandpass filter 1 having the desired pass band was obtained.

Below, exemplary embodiments of the invention are explained in further detail. Each of the embodiments described below is merely an illustration of the invention, and the invention is in no way limited to these embodiment descriptions.

Embodiment 1

Figure 3:
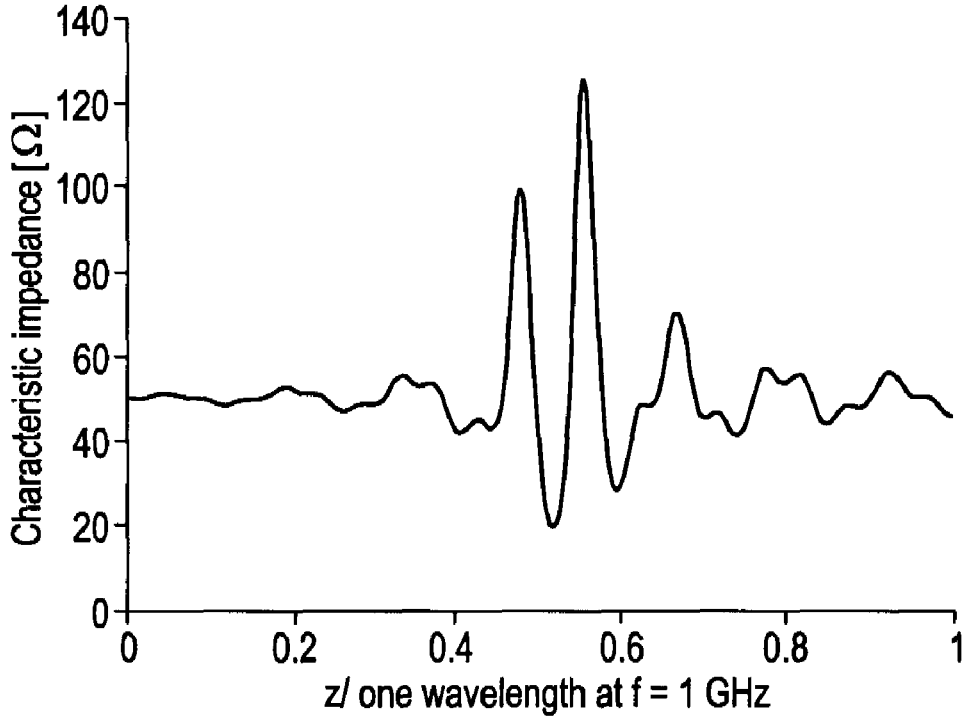
FIG. 3 is a graph showing the distribution of the characteristic impedance of the reflection-type bandpass filter manufactured in Embodiment 1.

A Kaiser window was used for which the reflectance is 1 at frequencies f in the range 3.4 GHz≦f≦10.3 GHz, and is 0 elsewhere, and for which A=30. Design was performed using one wavelength of signals at frequency f=1 GHz propagating in the microstrip as the waveguide length, and setting the system characteristic impedance to 50Ω. FIG. 3 shows the distribution in the z-axis direction of the local characteristic impedance obtained in the inverse problem. The horizontal axis is z divided by one wavelength at f=1 GHz; similar axes are used in FIG. 8, FIG. 13, FIG. 18, and FIG. 23 below. "z" is the length extending in the z-axis direction from the end face on the input end. The horizontal axis indicates the value which is obtained by dividing z by one wavelength at f=1 GHz.

Figure 4:
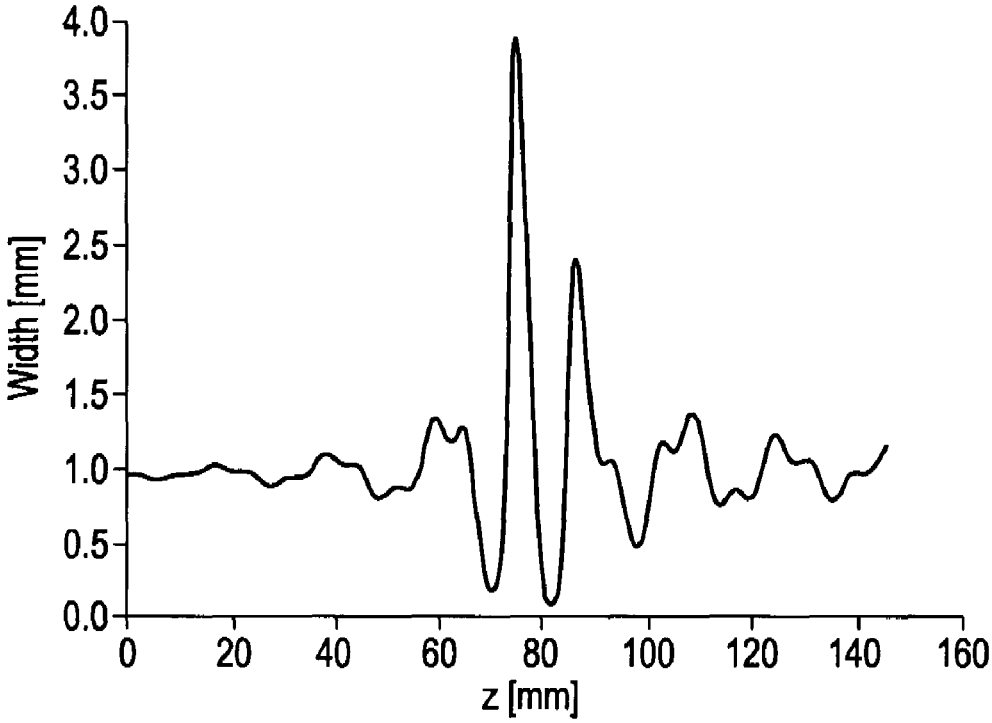
FIG. 4 is a graph showing the center conductor width distribution in the reflection-type bandpass filter manufactured in Embodiment 1.

FIG. 4 shows the distribution in the z-axis of the center conductor width w, when using a dielectric layer 3 of thickness h=2 mm and with relative permittivity $\in_r$=4.2. Tables 1 through 3 list the center conductor widths w.

TABLE 1

Center conductor widths (1/3)

| | z[mm] | | | | | | | | | | | |
|---|---|---|---|---|---|---|---|---|---|---|---|---|
| | 0.00 | 0.15 | 0.29 | 0.44 | 0.59 | 0.73 | 0.88 | 1.02 | 1.17 | 1.32 | 1.46 | 1.61 |
| | w[mm] | | | | | | | | | | | |
| | 0.96 | 0.96 | 0.96 | 0.96 | 0.96 | 0.96 | 0.96 | 0.96 | 0.96 | 0.96 | 0.96 | 0.96 |
| #2 | 1.76 | 1.00 | 2.05 | 2.20 | 2.34 | 2.49 | 2.68 | 2.78 | 2.99 | 3.07 | 3.22 | 3.37 |
| — | 0.96 | 0.96 | 0.96 | 0.96 | 0.96 | 0.96 | 0.96 | 0.96 | 0.96 | 0.96 | 0.96 | 0.96 |
| #3 | 3.51 | 3.66 | 3.81 | 3.95 | 4.10 | 4.25 | 4.39 | 4.54 | 4.68 | 4.83 | 4.98 | 5.12 |
| — | 0.95 | 0.95 | 0.95 | 0.95 | 0.95 | 0.95 | 0.94 | 0.94 | 0.94 | 0.94 | 0.94 | 0.94 |
| #4 | 5.27 | 5.42 | 5.56 | 5.71 | 5.56 | 6.00 | 6.15 | 6.29 | 6.44 | 6.59 | 6.73 | 6.88 |
| — | 0.93 | 0.93 | 0.93 | 0.93 | 0.93 | 0.93 | 0.93 | 0.93 | 0.93 | 0.93 | 0.93 | 0.93 |
| #5 | 7.03 | 7.17 | 7.32 | 7.47 | 7.61 | 7.76 | 7.90 | 8.05 | 8.20 | 8.34 | 8.49 | 8.54 |
| — | 0.93 | 0.93 | 0.93 | 0.93 | 0.94 | 0.94 | 0.94 | 0.94 | 0.94 | 0.94 | 0.95 | 0.95 |
| #6 | 8.78 | 8.93 | 9.08 | 9.22 | 9.37 | 9.52 | 9.66 | 9.81 | 9.95 | 10.10 | 10.25 | 10.39 |
| — | 0.95 | 0.95 | 0.95 | 0.95 | 0.96 | 0.96 | 0.96 | 0.96 | 0.96 | 0.96 | 0.96 | 0.96 |
| #7 | 10.54 | 10.69 | 10.83 | 10.98 | 11.13 | 11.27 | 11.42 | 11.56 | 11.71 | 11.86 | 12.00 | 12.15 |
| — | 0.96 | 0.96 | 0.96 | 0.96 | 0.96 | 0.96 | 0.96 | 0.96 | 0.96 | 0.96 | 0.96 | 0.96 |
| #8 | 12.30 | 12.44 | 12.59 | 12.74 | 12.88 | 13.03 | 13.17 | 13.32 | 13.47 | 13.61 | 13.76 | 13.91 |
| — | 0.96 | 0.97 | 0.97 | 0.97 | 0.97 | 0.97 | 0.97 | 0.97 | 0.97 | 0.97 | 0.98 | 0.98 |
| #9 | 14.05 | 14.20 | 14.35 | 14.49 | 14.64 | 14.78 | 14.93 | 15.08 | 15.22 | 15.37 | 15.52 | 15.66 |
| — | 0.98 | 0.98 | 0.99 | 0.99 | 0.99 | 0.99 | 1.00 | 1.00 | 1.00 | 1.01 | 1.01 | 1.01 |
| #10 | 15.81 | 15.96 | 16.10 | 16.25 | 16.40 | 16.54 | 16.69 | 16.83 | 16.98 | 17.13 | 17.27 | 17.42 |
| — | 1.01 | 1.02 | 1.02 | 1.02 | 1.02 | 1.02 | 1.02 | 1.02 | 1.02 | 1.03 | 1.02 | 1.02 |
| #11 | 17.57 | 17.71 | 17.86 | 18.01 | 18.15 | 18.30 | 18.44 | 18.59 | 18.74 | 18.88 | 19.03 | 19.18 |
| — | 1.02 | 1.02 | 1.02 | 1.02 | 1.02 | 1.02 | 1.01 | 1.01 | 1.01 | 1.01 | 1.00 | 1.00 |
| #12 | 19.32 | 19.47 | 19.62 | 19.76 | 19.91 | 20.06 | 20.20 | 20.35 | 20.49 | 20.64 | 20.79 | 20.93 |
| — | 1.00 | 1.00 | 0.99 | 0.99 | 0.99 | 0.99 | 0.99 | 0.98 | 0.98 | 0.98 | 0.98 | 0.98 |
| #13 | 21.08 | 21.23 | 21.37 | 21.52 | 21.66 | 21.81 | 21.96 | 22.10 | 22.25 | 22.40 | 22.54 | 22.69 |
| — | 0.98 | 0.98 | 0.98 | 0.98 | 0.98 | 0.98 | 0.98 | 0.98 | 0.98 | 0.98 | 0.98 | 0.98 |
| #14 | 22.84 | 22.98 | 23.13 | 23.28 | 23.42 | 23.57 | 23.71 | 23.86 | 24.01 | 24.15 | 24.30 | 24.45 |
| — | 0.98 | 0.98 | 0.98 | 0.98 | 0.97 | 0.97 | 0.97 | 0.97 | 0.97 | 0.96 | 0.96 | 0.96 |
| #15 | 24.59 | 24.74 | 24.89 | 25.03 | 25.18 | 25.32 | 25.47 | 25.62 | 25.76 | 25.91 | 26.06 | 26.20 |
| — | 0.96 | 0.96 | 0.95 | 0.94 | 0.94 | 0.93 | 0.93 | 0.93 | 0.92 | 0.92 | 0.91 | 0.91 |
| #16 | 26.35 | 26.50 | 26.64 | 26.79 | 26.93 | 27.08 | 27.23 | 27.37 | 27.52 | 27.67 | 27.81 | 27.96 |
| — | 0.91 | 0.90 | 0.90 | 0.90 | 0.89 | 0.89 | 0.89 | 0.89 | 0.89 | 0.89 | 0.89 | 0.89 |
| #17 | 28.11 | 28.25 | 28.40 | 28.55 | 28.69 | 28.84 | 28.98 | 29.13 | 29.28 | 29.42 | 29.57 | 29.72 |
| — | 0.89 | 0.89 | 0.89 | 0.89 | 0.89 | 0.90 | 0.90 | 0.90 | 0.90 | 0.91 | 0.91 | 0.91 |
| #18 | 29.86 | 30.01 | 30.16 | 30.30 | 30.45 | 30.59 | 30.74 | 30.89 | 31.03 | 31.18 | 31.33 | 31.47 |
| — | 0.92 | 0.92 | 0.92 | 0.93 | 0.93 | 0.93 | 0.93 | 0.93 | 0.94 | 0.94 | 0.94 | 0.94 |
| #19 | 31.62 | 31.77 | 31.91 | 32.06 | 32.20 | 32.35 | 32.50 | 32.64 | 32.79 | 32.94 | 33.08 | 33.23 |
| — | 0.94 | 0.94 | 0.94 | 0.94 | 0.94 | 0.94 | 0.94 | 0.94 | 0.94 | 0.94 | 0.94 | 0.94 |
| #20 | 33.36 | 33.52 | 33.67 | 33.81 | 33.96 | 34.11 | 34.25 | 34.40 | 34.55 | 34.69 | 34.84 | 34.99 |
| — | 0.94 | 0.94 | 0.94 | 0.94 | 0.94 | 0.96 | 0.96 | 0.96 | 0.96 | 0.96 | 0.96 | 0.97 |
| #21 | 35.19 | 35.28 | 35.43 | 35.57 | 35.72 | 35.86 | 36.01 | 36.16 | 36.30 | 36.46 | 36.60 | 36.74 |
| — | 0.97 | 0.98 | 0.98 | 0.99 | 1.00 | 1.00 | 1.01 | 1.02 | 1.03 | 1.03 | 1.04 | 1.05 |
| #22 | 36.89 | 37.04 | 37.18 | 37.33 | 37.47 | 37.62 | 37.77 | 37.91 | 38.06 | 38.21 | 38.35 | 38.50 |
| — | 1.00 | 1.06 | 1.06 | 1.07 | 1.08 | 1.08 | 1.08 | 1.09 | 1.09 | 1.09 | 1.09 | 1.09 |
| #23 | 38.65 | 38.79 | 38.94 | 39.08 | 39.23 | 39.38 | 39.52 | 39.67 | 39.82 | 39.96 | 40.11 | 40.26 |
| — | 1.09 | 1.09 | 1.09 | 1.09 | 1.08 | 1.08 | 1.08 | 1.07 | 1.07 | 1.06 | 1.06 | 1.05 |
| #24 | 40.40 | 40.55 | 40.70 | 40.84 | 40.99 | 41.13 | 41.28 | 41.43 | 41.57 | 41.72 | 41.87 | 42.01 |
| — | 1.05 | 1.05 | 1.04 | 1.04 | 1.03 | 1.03 | 1.03 | 1.02 | 1.02 | 1.02 | 1.02 | 1.02 |
| #25 | 42.16 | 42.31 | 42.45 | 42.60 | 42.74 | 42.89 | 43.04 | 43.18 | 43.33 | 43.48 | 43.52 | 43.77 |
| — | 1.02 | 1.02 | 1.02 | 1.02 | 1.02 | 1.02 | 1.02 | 1.02 | 1.03 | 1.03 | 1.03 | 1.03 |

TABLE 1-continued

| Center conductor widths (1/3) | | | | | | | | | | | | |
|---|---|---|---|---|---|---|---|---|---|---|---|---|
| | z[mm] | | | | | | | | | | | |
| | 0.00 | 0.15 | 0.29 | 0.44 | 0.59 | 0.73 | 0.88 | 1.02 | 1.17 | 1.32 | 1.46 | 1.61 |
| | w[mm] | | | | | | | | | | | |
| | 0.96 | 0.96 | 0.96 | 0.96 | 0.96 | 0.96 | 0.96 | 0.96 | 0.96 | 0.96 | 0.96 | 0.96 |
| #26 | 43.92 | 44.06 | 44.21 | 44.35 | 44.56 | 44.65 | 44.79 | 44.94 | 45.09 | 45.23 | 45.38 | 45.53 |
| — | 1.02 | 1.02 | 1.02 | 1.02 | 1.02 | 1.02 | 1.01 | 1.01 | 1.00 | 1.00 | 0.99 | 0.98 |
| #27 | 45.67 | 45.82 | 45.96 | 46.11 | 46.25 | 46.48 | 46.55 | 46.70 | 46.84 | 46.99 | 47.14 | 47.28 |
| — | 0.98 | 0.97 | 0.96 | 0.95 | 0.94 | 0.93 | 0.92 | 0.91 | 0.90 | 0.88 | 0.87 | 0.86 |
| #28 | 47.43 | 47.58 | 47.72 | 47.87 | 48.01 | 48.16 | 48.31 | 48.45 | 48.60 | 48.75 | 45.89 | 49.04 |
| — | 0.86 | 0.85 | 0.84 | 0.83 | 0.82 | 0.82 | 0.81 | 0.81 | 0.80 | 0.80 | 0.80 | 0.80 |
| #29 | 49.19 | 49.33 | 49.48 | 49.62 | 49.77 | 49.92 | 50.06 | 50.21 | 50.36 | 50.50 | 50.65 | 50.80 |
| — | 0.80 | 0.80 | 0.80 | 0.80 | 0.80 | 0.81 | 0.81 | 0.81 | 0.82 | 0.82 | 0.83 | 0.83 |
| #30 | 50.94 | 51.00 | 51.23 | 51.38 | 51.53 | 51.67 | 51.82 | 51.97 | 52.11 | 52.26 | 52.41 | 52.55 |
| — | 0.84 | 0.84 | 0.85 | 0.85 | 0.86 | 0.86 | 0.87 | 0.87 | 0.87 | 0.87 | 0.87 | 0.87 |

TABLE 2

| Center conductor widths (2/3) | | | | | | | | | | | | |
|---|---|---|---|---|---|---|---|---|---|---|---|---|
| #31 | 52.76 | 52.84 | 52.99 | 53.14 | 53.28 | 53.43 | 53.58 | 53.72 | 53.87 | 54.02 | 54.16 | 54.31 |
| — | 0.87 | 0.87 | 0.87 | 0.87 | 0.87 | 0.87 | 0.86 | 0.86 | 0.86 | 0.86 | 0.85 | 0.85 |
| #32 | 54.46 | 54.60 | 54.75 | 54.89 | 55.04 | 55.19 | 55.33 | 55.48 | 55.63 | 55.77 | 55.92 | 56.07 |
| — | 0.85 | 0.85 | 0.86 | 0.86 | 0.86 | 0.86 | 0.87 | 0.88 | 0.88 | 0.89 | 0.90 | 0.92 |
| #33 | 56.21 | 56.36 | 56.50 | 56.65 | 56.80 | 56.94 | 57.09 | 57.24 | 57.38 | 57.53 | 57.68 | 57.82 |
| — | 0.93 | 0.94 | 0.96 | 0.98 | 1.00 | 1.02 | 1.04 | 1.06 | 1.08 | 1.10 | 1.12 | 1.14 |
| #34 | 57.97 | 58.11 | 58.20 | 58.41 | 58.55 | 58.70 | 58.85 | 58.99 | 59.14 | 59.29 | 59.43 | 59.58 |
| — | 1.17 | 1.19 | 1.21 | 1.23 | 1.25 | 1.26 | 1.28 | 1.29 | 1.30 | 1.31 | 1.32 | 1.32 |
| #35 | 59.73 | 59.87 | 60.02 | 60.16 | 60.31 | 60.46 | 60.60 | 60.75 | 60.90 | 61.04 | 61.19 | 61.34 |
| — | 1.33 | 1.33 | 1.33 | 1.32 | 1.32 | 1.31 | 1.30 | 1.29 | 1.28 | 1.27 | 1.25 | 1.25 |
| #36 | 61.48 | 61.63 | 61.77 | 61.92 | 62.07 | 62.21 | 62.36 | 62.51 | 62.65 | 62.80 | 62.95 | 63.09 |
| — | 1.24 | 1.23 | 1.22 | 1.21 | 1.20 | 1.19 | 1.18 | 1.18 | 1.18 | 1.17 | 1.17 | 1.18 |
| #37 | 63.24 | 63.38 | 63.63 | 63.68 | 63.82 | 63.97 | 64.12 | 64.26 | 64.41 | 64.56 | 64.70 | 64.85 |
| — | 1.18 | 1.18 | 1.19 | 1.20 | 1.20 | 1.21 | 1.22 | 1.23 | 1.24 | 1.25 | 1.26 | 1.26 |
| #38 | 64.99 | 65.14 | 65.29 | 65.43 | 65.58 | 65.73 | 65.87 | 65.02 | 66.17 | 66.31 | 66.46 | 66.61 |
| — | 1.27 | 1.27 | 1.27 | 1.26 | 1.26 | 1.25 | 1.23 | 1.21 | 1.19 | 1.16 | 1.13 | 1.10 |
| #39 | 66.75 | 66.90 | 67.04 | 67.19 | 67.34 | 67.48 | 67.63 | 67.78 | 67.92 | 68.07 | 68.22 | 68.36 |
| — | 1.06 | 1.01 | 0.97 | 0.92 | 0.87 | 0.82 | 0.77 | 0.72 | 0.66 | 0.61 | 0.56 | 0.52 |
| #40 | 68.51 | 68.65 | 68.80 | 68.95 | 69.09 | 69.24 | 69.39 | 69.53 | 69.68 | 69.83 | 69.97 | 70.12 |
| — | 0.47 | 0.43 | 0.39 | 0.35 | 0.32 | 0.29 | 0.27 | 0.24 | 0.22 | 0.21 | 0.20 | 0.19 |
| #41 | 70.26 | 70.41 | 70.56 | 70.70 | 70.85 | 71.00 | 71.14 | 71.29 | 71.44 | 71.58 | 71.73 | 71.88 |
| — | 0.18 | 0.17 | 0.17 | 0.17 | 0.18 | 0.18 | 0.19 | 0.21 | 0.22 | 0.24 | 0.27 | 0.30 |
| #42 | 72.02 | 72.17 | 72.31 | 72.46 | 72.61 | 72.75 | 72.90 | 73.05 | 73.19 | 73.34 | 73.49 | 73.63 |
| — | 0.34 | 0.30 | 0.45 | 0.51 | 0.58 | 0.66 | 0.76 | 0.86 | 0.97 | 1.10 | 1.23 | 1.38 |
| #43 | 73.78 | 73.92 | 74.07 | 74.22 | 74.36 | 74.51 | 74.66 | 74.80 | 74.95 | 75.10 | 75.24 | 75.39 |
| — | 1.64 | 1.70 | 1.88 | 2.05 | 2.24 | 2.43 | 2.52 | 2.81 | 2.99 | 3.17 | 3.33 | 3.48 |
| #44 | 75.53 | 75.68 | 75.83 | 75.97 | 76.13 | 76.27 | 76.41 | 76.56 | 76.71 | 76.35 | 77.00 | 77.14 |
| — | 3.61 | 3.71 | 3.79 | 3.85 | 3.87 | 3.86 | 3.83 | 3.76 | 3.67 | 3.55 | 3.41 | 3.25 |
| #45 | 77.29 | 77.44 | 77.58 | 77.78 | 77.83 | 78.02 | 78.17 | 78.32 | 78.46 | 78.61 | 78.76 | 78.90 |
| — | 3.07 | 2.89 | 2.69 | 2.49 | 2.29 | 2.09 | 1.90 | 1.71 | 1.53 | 1.36 | 1.20 | 1.05 |
| #46 | 79.05 | 79.19 | 79.34 | 79.49 | 79.63 | 79.78 | 79.93 | 80.07 | 80.22 | 80.37 | 80.51 | 80.66 |
| — | 0.91 | 0.79 | 0.68 | 0.58 | 0.49 | 0.41 | 0.34 | 0.29 | 0.24 | 0.20 | 0.17 | 0.14 |
| #47 | 80.80 | 80.95 | 81.10 | 81.24 | 81.39 | 81.54 | 81.68 | 81.83 | 81.98 | 82.12 | 82.27 | 82.41 |
| — | 0.12 | 0.11 | 0.09 | 0.05 | 0.08 | 0.07 | 0.07 | 0.07 | 0.07 | 0.08 | 0.08 | 0.09 |
| #48 | 82.56 | 82.71 | 82.85 | 83.00 | 83.15 | 83.29 | 83.44 | 83.59 | 83.73 | 83.88 | 84.02 | 84.17 |
| — | 0.10 | 0.11 | 0.13 | 0.15 | 0.18 | 0.21 | 0.25 | 0.30 | 0.35 | 0.41 | 0.43 | 0.55 |
| #49 | 84.32 | 84.46 | 84.61 | 84.76 | 84.90 | 85.05 | 85.20 | 85.34 | 85.49 | 85.64 | 85.78 | 85.93 |
| — | 0.64 | 0.73 | 0.83 | 0.93 | 1.04 | 1.15 | 1.27 | 1.39 | 1.51 | 1.62 | 1.74 | 1.85 |
| #50 | 86.07 | 86.22 | 86.37 | 86.51 | 86.66 | 86.81 | 86.95 | 87.10 | 87.25 | 87.39 | 87.54 | 87.68 |
| — | 1.95 | 2.04 | 2.13 | 2.20 | 2.27 | 2.32 | 2.35 | 2.38 | 2.39 | 2.38 | 2.37 | 2.34 |
| #51 | 87.83 | 87.95 | 88.12 | 88.27 | 88.42 | 88.56 | 88.71 | 88.86 | 89.00 | 89.15 | 89.29 | 89.44 |
| — | 2.30 | 2.25 | 2.20 | 2.13 | 2.07 | 2.00 | 1.93 | 1.85 | 1.78 | 1.71 | 1.64 | 1.57 |
| #52 | 89.59 | 89.73 | 89.88 | 90.03 | 90.17 | 90.32 | 90.47 | 90.61 | 90.76 | 90.91 | 91.05 | 91.20 |
| — | 1.50 | 1.44 | 1.39 | 1.33 | 1.23 | 1.24 | 1.20 | 1.17 | 1.14 | 1.11 | 1.09 | 1.07 |
| #53 | 91.34 | 91.49 | 91.64 | 91.78 | 91.93 | 92.08 | 92.22 | 92.37 | 92.52 | 92.65 | 92.81 | 92.95 |
| — | 1.00 | 1.04 | 1.04 | 1.03 | 1.03 | 1.03 | 1.03 | 1.03 | 1.03 | 1.03 | 1.04 | 1.04 |
| #54 | 93.10 | 93.25 | 93.39 | 93.54 | 93.69 | 93.83 | 93.98 | 94.13 | 94.27 | 94.42 | 94.56 | 94.71 |
| — | 1.04 | 1.04 | 1.04 | 1.04 | 1.03 | 1.03 | 1.02 | 1.01 | 0.99 | 0.98 | 0.96 | 0.94 |
| #55 | 94.86 | 95.00 | 95.15 | 95.30 | 95.44 | 95.59 | 95.74 | 95.88 | 96.03 | 96.17 | 96.32 | 96.47 |
| — | 0.91 | 0.89 | 0.86 | 0.83 | 0.80 | 0.78 | 0.75 | 0.72 | 0.69 | 0.66 | 0.64 | 0.61 |
| #56 | 96.61 | 96.76 | 96.91 | 97.05 | 97.20 | 97.35 | 97.49 | 97.64 | 97.79 | 97.93 | 98.06 | 98.22 |
| — | 0.59 | 0.57 | 0.55 | 0.53 | 0.51 | 0.50 | 0.49 | 0.48 | 0.47 | 0.47 | 0.47 | 0.47 |

TABLE 2-continued

| Center conductor widths (2/3) | | | | | | | | | | | | |
|---|---|---|---|---|---|---|---|---|---|---|---|---|
| #57 | 98.37 | 98.52 | 98.66 | 98.81 | 98.96 | 99.10 | 99.25 | 99.40 | 99.54 | 99.69 | 99.83 | 99.98 |
| — | 0.47 | 0.48 | 0.49 | 0.50 | 0.51 | 0.53 | 0.55 | 0.57 | 0.59 | 0.61 | 0.64 | 0.67 |
| #58 | 100.13 | 100.27 | 100.42 | 100.57 | 100.71 | 100.86 | 101.01 | 101.15 | 101.30 | 101.44 | 101.59 | 101.74 |
| — | 0.70 | 0.73 | 0.75 | 0.79 | 0.83 | 0.86 | 0.89 | 0.92 | 0.95 | 0.98 | 1.01 | 1.04 |
| #59 | 101.88 | 102.03 | 102.18 | 102.32 | 102.47 | 102.62 | 102.76 | 102.91 | 103.06 | 103.20 | 103.35 | 103.49 |
| — | 1.06 | 1.08 | 1.10 | 1.12 | 1.13 | 1.14 | 1.15 | 1.15 | 1.16 | 1.16 | 1.16 | 1.16 |
| #60 | 103.64 | 103.79 | 103.93 | 104.08 | 104.23 | 104.37 | 104.52 | 104.67 | 104.81 | 104.95 | 105.10 | 105.25 |
| — | 1.15 | 1.15 | 1.14 | 1.14 | 1.13 | 1.13 | 1.12 | 1.11 | 1.11 | 1.11 | 1.10 | 1.10 |

TABLE 3

| Center conductor widths (3/3) | | | | | | | | | | | | |
|---|---|---|---|---|---|---|---|---|---|---|---|---|
| #61 | 105.40 | 105.54 | 105.63 | 105.84 | 105.98 | 106.13 | 106.28 | 106.42 | 106.57 | 106.71 | 106.86 | 107.01 |
| — | 1.10 | 1.11 | 1.11 | 1.12 | 1.12 | 1.13 | 1.14 | 1.15 | 1.16 | 1.18 | 1.18 | 1.21 |
| #62 | 107.15 | 107.30 | 107.45 | 107.59 | 107.74 | 107.89 | 108.03 | 108.18 | 108.32 | 108.47 | 108.62 | 108.76 |
| — | 1.22 | 1.24 | 1.26 | 1.27 | 1.29 | 1.30 | 1.31 | 1.33 | 1.34 | 1.34 | 1.35 | 1.35 |
| #63 | 108.93 | 109.09 | 109.29 | 109.35 | 109.50 | 109.64 | 109.79 | 109.94 | 110.08 | 110.23 | 110.37 | 110.52 |
| — | 1.35 | 1.35 | 1.35 | 1.34 | 1.33 | 1.31 | 1.30 | 1.26 | 1.26 | 1.24 | 1.21 | 1.19 |
| #64 | 110.67 | 110.81 | 110.96 | 111.11 | 111.25 | 111.40 | 111.55 | 111.60 | 111.84 | 111.98 | 112.13 | 112.28 |
| — | 1.16 | 1.13 | 1.10 | 1.08 | 1.05 | 1.02 | 0.99 | 0.96 | 0.94 | 0.91 | 0.89 | 0.87 |
| #65 | 112.42 | 112.57 | 112.72 | 112.86 | 113.01 | 113.16 | 113.30 | 113.46 | 113.59 | 113.74 | 113.89 | 114.03 |
| — | 0.83 | 0.83 | 0.81 | 0.80 | 0.79 | 0.77 | 0.76 | 0.76 | 0.75 | 0.75 | 0.75 | 0.74 |
| #66 | 114.18 | 114.33 | 114.47 | 114.62 | 114.77 | 114.91 | 115.06 | 115.21 | 115.36 | 115.50 | 115.64 | 115.79 |
| — | 0.75 | 0.75 | 0.75 | 0.75 | 0.76 | 0.77 | 0.77 | 0.78 | 0.79 | 0.80 | 0.80 | 0.81 |
| #67 | 115.84 | 116.08 | 116.23 | 116.38 | 116.52 | 116.67 | 116.82 | 116.96 | 117.11 | 117.25 | 117.40 | 117.55 |
| — | 0.82 | 0.82 | 0.83 | 0.83 | 0.84 | 0.84 | 0.85 | 0.85 | 0.85 | 0.85 | 0.85 | 0.85 |
| #68 | 117.69 | 117.84 | 117.99 | 118.13 | 118.23 | 118.43 | 118.57 | 118.72 | 118.86 | 119.01 | 119.16 | 119.30 |
| — | 0.84 | 0.84 | 0.83 | 0.82 | 0.82 | 0.82 | 0.81 | 0.81 | 0.80 | 0.80 | 0.80 | 0.79 |
| #69 | 119.45 | 119.60 | 119.74 | 119.89 | 120.04 | 120.18 | 120.33 | 120.47 | 120.62 | 120.77 | 120.91 | 121.06 |
| — | 0.79 | 0.79 | 0.79 | 0.79 | 0.79 | 0.80 | 0.80 | 0.81 | 0.82 | 0.82 | 0.84 | 0.85 |
| #70 | 121.21 | 121.35 | 121.50 | 121.65 | 121.79 | 121.94 | 122.09 | 122.23 | 122.38 | 122.52 | 122.67 | 122.82 |
| — | 0.86 | 0.87 | 0.89 | 0.91 | 0.92 | 0.94 | 0.96 | 0.98 | 1.00 | 1.02 | 1.04 | 1.06 |
| #71 | 122.98 | 123.11 | 123.28 | 123.40 | 123.56 | 123.70 | 123.84 | 123.99 | 124.13 | 124.28 | 124.43 | 124.57 |
| — | 1.08 | 1.10 | 1.12 | 1.13 | 1.15 | 1.16 | 1.18 | 1.19 | 1.20 | 1.20 | 1.21 | 1.21 |
| #72 | 124.72 | 124.87 | 125.01 | 125.16 | 125.31 | 125.46 | 125.60 | 125.74 | 125.80 | 126.04 | 126.18 | 126.33 |
| — | 1.21 | 1.21 | 1.21 | 1.21 | 1.20 | 1.20 | 1.18 | 1.18 | 1.17 | 1.16 | 1.15 | 1.14 |
| #73 | 126.48 | 126.62 | 126.77 | 126.92 | 127.06 | 127.21 | 127.38 | 127.50 | 127.65 | 127.79 | 127.94 | 128.09 |
| — | 1.13 | 1.12 | 1.11 | 1.10 | 1.00 | 1.08 | 1.07 | 1.06 | 1.05 | 1.05 | 1.04 | 1.03 |
| #74 | 128.23 | 128.38 | 128.53 | 128.67 | 128.82 | 128.97 | 129.11 | 129.26 | 129.40 | 129.55 | 129.70 | 129.84 |
| — | 1.03 | 1.03 | 1.03 | 1.03 | 1.03 | 1.03 | 1.03 | 1.03 | 1.03 | 1.03 | 1.04 | 1.04 |
| #75 | 129.99 | 130.14 | 130.28 | 130.43 | 130.58 | 130.72 | 130.87 | 131.01 | 131.16 | 131.31 | 131.45 | 131.60 |
| | 1.04 | 1.04 | 1.04 | 1.04 | 1.04 | 1.04 | 1.04 | 1.04 | 1.04 | 1.03 | 1.03 | 1.02 |
| #76 | 131.75 | 131.89 | 132.04 | 132.19 | 132.33 | 132.48 | 132.52 | 132.77 | 132.92 | 133.06 | 133.21 | 133.36 |
| — | 1.02 | 1.01 | 1.00 | 0.99 | 0.98 | 0.97 | 0.95 | 0.94 | 0.93 | 0.92 | 0.90 | 0.89 |
| #77 | 133.50 | 133.65 | 133.80 | 133.94 | 134.09 | 134.24 | 134.38 | 134.53 | 134.67 | 134.82 | 134.87 | 135.11 |
| — | 0.88 | 0.86 | 0.85 | 0.84 | 0.83 | 0.82 | 0.81 | 0.80 | 0.79 | 0.79 | 0.78 | 0.78 |
| #78 | 135.26 | 135.41 | 135.55 | 135.76 | 135.85 | 135.99 | 136.14 | 136.28 | 136.43 | 136.58 | 136.72 | 136.87 |
| — | 0.77 | 0.77 | 0.77 | 0.77 | 0.78 | 0.78 | 0.78 | 0.79 | 0.79 | 0.80 | 0.81 | 0.81 |
| #79 | 137.02 | 137.16 | 137.31 | 137.46 | 137.66 | 137.75 | 137.89 | 138.04 | 138.19 | 138.33 | 138.48 | 138.63 |
| — | 0.82 | 0.83 | 0.84 | 0.85 | 0.86 | 0.87 | 0.88 | 0.89 | 0.90 | 0.91 | 0.92 | 0.93 |
| #80 | 138.77 | 138.92 | 139.07 | 139.21 | 139.36 | 139.50 | 139.65 | 139.80 | 139.94 | 140.09 | 140.24 | 140.38 |
| — | 0.93 | 0.94 | 0.94 | 0.95 | 0.95 | 0.96 | 0.96 | 0.96 | 0.96 | 0.96 | 0.96 | 0.96 |
| #81 | 140.53 | 140.68 | 140.82 | 140.97 | 141.12 | 141.26 | 141.41 | 141.55 | 141.70 | 141.85 | 141.90 | 142.14 |
| — | 0.96 | 0.96 | 0.96 | 0.96 | 0.95 | 0.95 | 0.95 | 0.95 | 0.95 | 0.95 | 0.95 | 0.95 |
| #82 | 142.20 | 142.43 | 142.58 | 142.73 | 142.87 | 143.02 | 143.16 | 143.31 | 143.46 | 143.60 | 143.75 | 143.90 |
| — | 0.95 | 0.96 | 0.96 | 0.96 | 0.97 | 0.98 | 0.98 | 0.99 | 1.00 | 1.00 | 1.01 | 1.02 |
| #83 | 144.04 | 144.19 | 144.34 | 144.48 | 144.63 | 144.77 | 144.92 | 145.07 | 145.21 | 145.36 | 145.51 | 145.65 |
| — | 1.03 | 1.04 | 1.05 | 1.06 | 1.07 | 1.08 | 1.08 | 1.09 | 1.10 | 1.11 | 1.11 | 1.12 |
| #84 | 145.80 | 145.95 | 146.09 | 146.24 | 146.39 | | | | | | | |
| — | 1.12 | 1.13 | 1.13 | 1.13 | 1.13 | | | | | | | |

Figure 5:
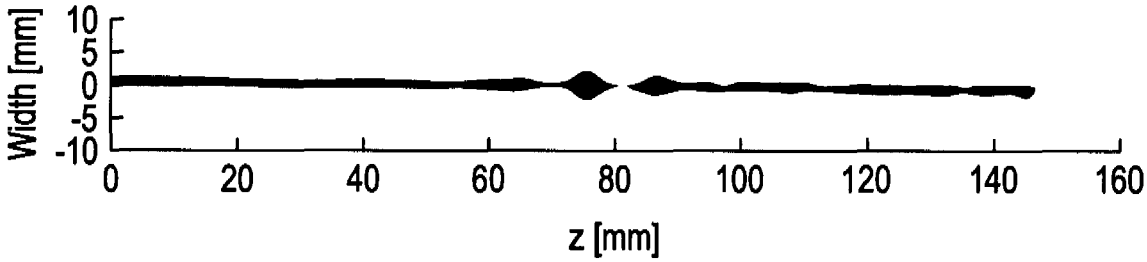
FIG. 5 is a graph showing the shape of the center conductor in the reflection-type bandpass filter manufactured in Embodiment 1.

FIG. 5 shows the shape of the center conductor 6 in the reflection-type bandpass filter 1 of Embodiment 1. In the figure, the dark portion represents the center conductor 6. A non-reflecting terminator, or an R=50Ω resistance, is provided on the terminating side (the face at z=146.39 mm) of this reflection-type bandpass filter 1. The non-reflecting terminator or resistance may be connected directly to the terminating end of the reflection-type bandpass filter 1. The thicknesses of the metal films of the conducting layers 4, 5 and of the center conductor 6 may be thick compared with the skin depth at f=1 GHz, $\delta s=\sqrt{\{2/(\omega\mu_0\sigma)\}}$. Here $\omega$, $\mu_0$, and $\sigma$ are respectively the angular frequency, permittivity in vacuum, and the conductivity of the metal. For example, when using copper, the thickness of the conducting layers 4, 5 and of the center conductor 6 may be 2.1 μm or greater. This bandpass filter is used in a system with a characteristic impedance of 50Ω.

Figure 6:
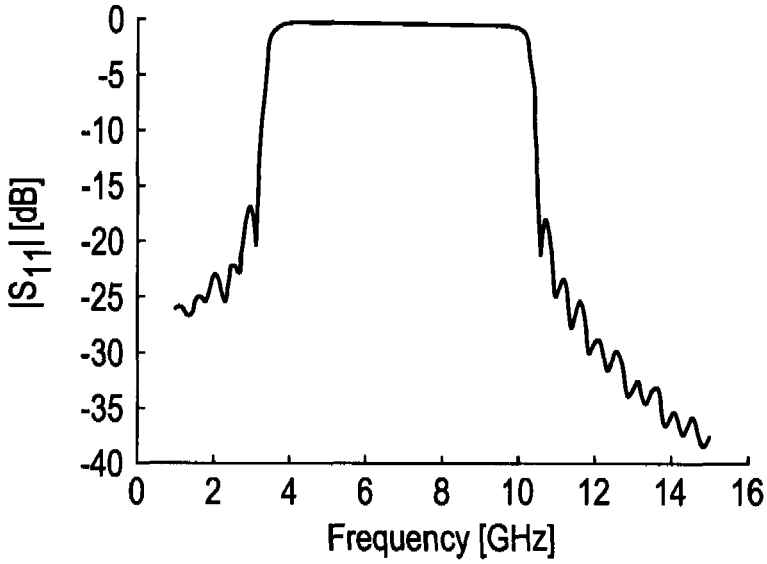
FIG. 6 is a graph showing the reflected-wave amplitude characteristic in the reflection-type bandpass filter manufactured in Embodiment 1.
Figure 7:
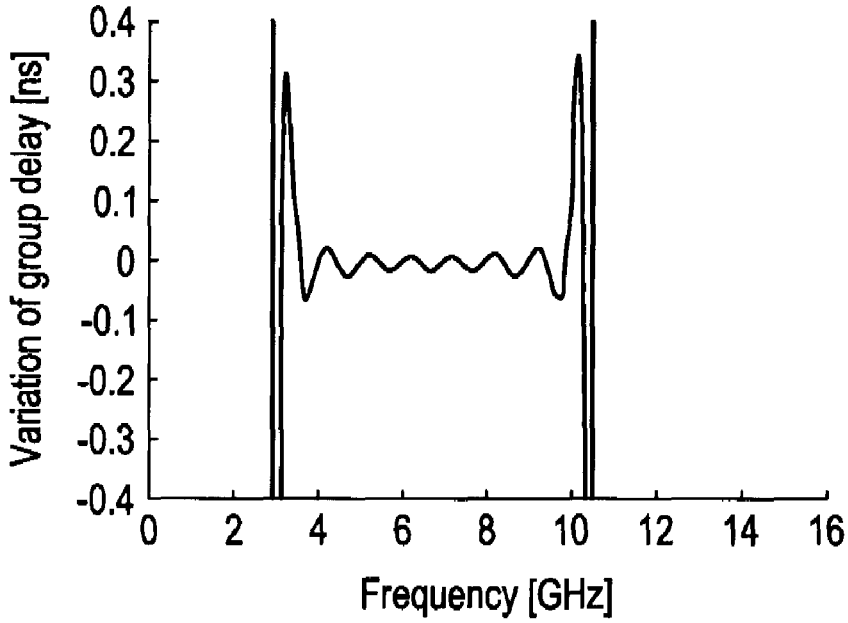
FIG. 7 is a graph showing the reflected-wave group delay characteristic in the reflection-type bandpass filter manufactured in Embodiment 1.

FIG. 6 and FIG. 7 show the amplitude characteristic and group delay characteristic respectively of reflected waves ($S_{11}$) in the bandpass filter 1 of Embodiment 1. As shown in the figures, in the range of frequencies f for which 3.7 GHz≦f≦10.0 GHz, the reflectance is −1 dB or greater, and the group delay variation is within ±0.05 ns. In the region f<3.1 GHz or f>10.6 GHz, the reflectance is −17 dB or lower.

Embodiment 2

Figure 8:
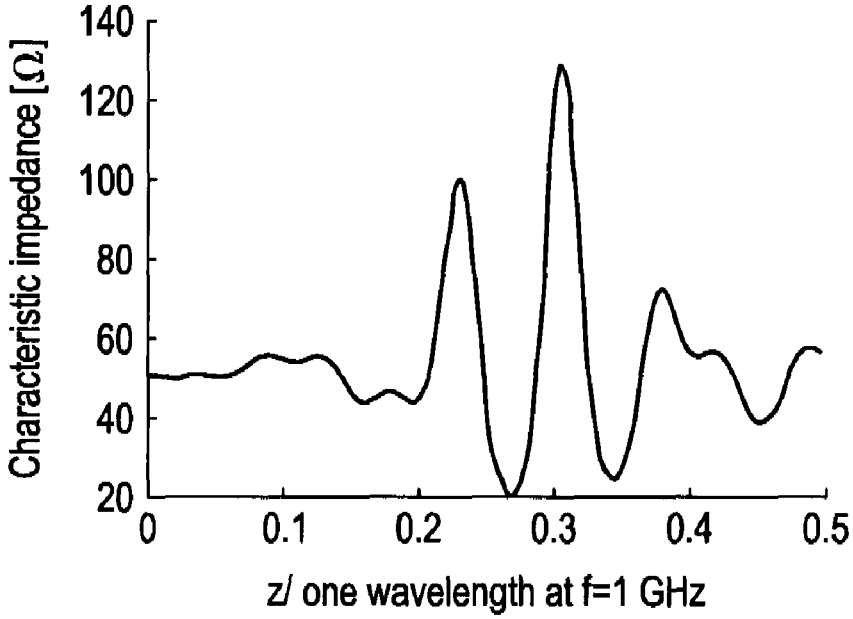
FIG. 8 is a graph showing the characteristic impedance distribution of the reflection-type bandpass filter manufactured in Embodiment 2.

A Kaiser window was used for which the reflectance is 1 at frequencies f in the range 3.4 GHz≦f≦10.3 GHz, and is 0 elsewhere, and for which A=30. Design was performed using one-half the wavelength of signals at frequency f=1 GHz propagating in the microstrip as the waveguide length, and setting the system characteristic impedance to 50Ω. FIG. 8 shows the distribution in the z-axis direction of the local characteristic impedance obtained in the inverse problem.

Figure 9:
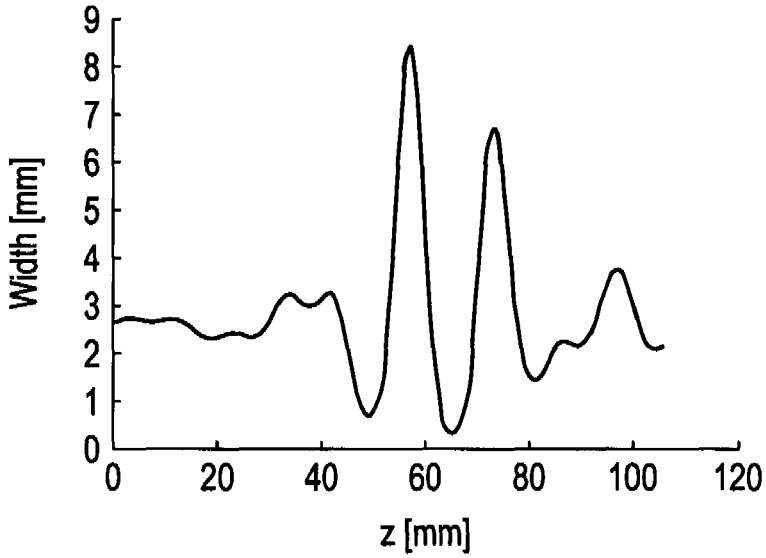
FIG. 9 is a graph showing the center conductor width distribution in the reflection-type bandpass filter manufactured in Embodiment 2.

FIG. 9 shows the z-axis distribution of the center conductor width w, when using a dielectric layer 3 of thickness h=3 mm and with relative permittivity $\in_r$=2. Tables 4 through 6 list the center conductor widths w.

TABLE 4

Center conductor widths (1/3)

| | z[mm] | | | | | | | | | | | |
|---|---|---|---|---|---|---|---|---|---|---|---|---|
| | 0.00 | 0.11 | 0.21 | 0.32 | 0.42 | 0.53 | 0.64 | 0.74 | 0.85 | 0.95 | 1.06 | 1.17 |
| | w[mm] | | | | | | | | | | | |
| | 2.68 | 2.68 | 2.68 | 2.68 | 2.69 | 2.69 | 2.69 | 2.70 | 2.70 | 2.70 | 2.71 | 2.71 |
| #2 | 1.27 | 1.58 | 1.48 | 1.50 | 1.70 | 1.80 | 1.91 | 2.02 | 2.12 | 2.23 | 2.33 | 2.44 |
| — | 2.71 | 2.71 | 2.71 | 2.72 | 2.72 | 2.72 | 2.72 | 2.72 | 2.72 | 2.72 | 2.72 | 2.73 |
| #3 | 2.55 | 2.65 | 2.70 | 2.80 | 2.97 | 3.08 | 3.18 | 3.29 | 3.39 | 3.50 | 3.61 | 3.71 |
| — | 2.73 | 2.73 | 2.73 | 2.73 | 2.73 | 2.73 | 2.72 | 2.72 | 2.72 | 2.73 | 2.72 | 2.72 |
| #4 | 3.82 | 3.92 | 4.03 | 4.14 | 4.24 | 4.35 | 4.45 | 4.56 | 4.67 | 4.77 | 4.88 | 4.99 |
| — | 2.72 | 2.72 | 2.72 | 2.71 | 2.71 | 2.71 | 2.71 | 2.71 | 2.71 | 2.70 | 2.70 | 2.70 |
| #5 | 5.09 | 5.20 | 5.30 | 5.41 | 5.52 | 5.62 | 5.73 | 5.83 | 5.94 | 6.05 | 6.15 | 6.26 |
| — | 2.70 | 2.70 | 2.70 | 2.69 | 2.69 | 2.69 | 2.69 | 2.69 | 2.69 | 2.69 | 2.69 | 2.68 |
| #6 | 6.36 | 6.47 | 6.68 | 6.68 | 6.79 | 6.89 | 7.00 | 7.11 | 7.21 | 7.32 | 7.42 | 7.53 |
| — | 2.68 | 2.68 | 2.68 | 2.68 | 2.68 | 2.68 | 2.68 | 2.68 | 2.68 | 2.68 | 2.68 | 2.68 |
| #7 | 7.64 | 7.74 | 7.85 | 7.95 | 8.06 | 8.17 | 8.27 | 8.38 | 8.40 | 8.50 | 8.70 | 8.80 |
| — | 2.68 | 2.69 | 2.69 | 2.69 | 2.69 | 2.69 | 2.69 | 2.69 | 2.69 | 2.70 | 2.70 | 2.70 |
| #8 | 8.91 | 9.02 | 9.12 | 9.23 | 9.33 | 9.44 | 9.55 | 9.65 | 9.76 | 9.80 | 9.97 | 10.08 |
| — | 2.70 | 2.70 | 2.70 | 2.71 | 2.71 | 2.71 | 2.71 | 2.71 | 2.71 | 2.71 | 2.71 | 2.71 |
| #9 | 10.18 | 10.29 | 10.30 | 10.50 | 10.61 | 10.71 | 10.82 | 10.92 | 11.03 | 11.14 | 11.24 | 11.36 |
| — | 2.72 | 2.72 | 2.72 | 2.72 | 2.72 | 2.72 | 2.71 | 2.71 | 2.71 | 2.71 | 2.71 | 2.71 |
| #10 | 11.46 | 11.56 | 11.67 | 11.77 | 11.88 | 11.98 | 12.09 | 12.20 | 12.30 | 12.41 | 12.52 | 12.62 |
| — | 2.71 | 2.70 | 2.70 | 2.70 | 2.69 | 2.69 | 2.69 | 2.68 | 2.68 | 2.67 | 2.67 | 2.66 |
| #11 | 12.73 | 12.83 | 12.94 | 13.06 | 13.16 | 13.26 | 13.36 | 13.47 | 13.58 | 13.68 | 13.79 | 13.89 |
| — | 2.65 | 2.65 | 2.64 | 2.63 | 2.63 | 2.62 | 2.61 | 2.61 | 2.60 | 2.59 | 2.58 | 2.57 |
| #12 | 14.00 | 14.31 | 14.21 | 14.32 | 14.42 | 14.53 | 14.64 | 14.74 | 14.85 | 14.90 | 15.00 | 15.17 |
| — | 2.57 | 2.55 | 2.55 | 2.54 | 2.53 | 2.52 | 2.51 | 2.50 | 2.50 | 2.49 | 2.48 | 2.47 |
| #13 | 15.27 | 15.38 | 15.49 | 15.59 | 15.70 | 15.80 | 15.91 | 16.02 | 16.12 | 16.23 | 16.33 | 16.44 |
| — | 2.46 | 2.45 | 2.45 | 2.44 | 2.43 | 2.42 | 2.42 | 2.41 | 2.40 | 2.40 | 2.39 | 2.38 |
| #14 | 16.55 | 16.65 | 16.76 | 16.86 | 16.97 | 17.06 | 17.18 | 17.29 | 17.39 | 17.50 | 17.61 | 17.71 |
| — | 2.38 | 2.37 | 2.37 | 2.36 | 2.36 | 2.36 | 2.35 | 2.35 | 2.35 | 2.34 | 2.34 | 2.34 |
| #15 | 17.82 | 17.93 | 18.03 | 18.14 | 18.24 | 18.35 | 18.46 | 18.56 | 18.67 | 18.77 | 18.88 | 18.99 |
| — | 2.34 | 2.34 | 2.34 | 2.34 | 2.34 | 2.34 | 2.34 | 2.34 | 2.34 | 2.34 | 2.34 | 2.34 |
| #16 | 19.00 | 19.20 | 19.30 | 19.41 | 19.52 | 19.62 | 19.73 | 19.83 | 19.94 | 20.05 | 20.15 | 20.26 |
| — | 2.35 | 2.35 | 2.35 | 2.35 | 2.36 | 2.36 | 2.36 | 2.37 | 2.37 | 2.37 | 2.38 | 2.38 |
| #17 | 20.36 | 20.47 | 20.58 | 20.68 | 20.79 | 20.90 | 21.00 | 21.11 | 21.21 | 21.32 | 21.43 | 21.53 |
| — | 2.38 | 2.39 | 2.39 | 2.39 | 2.40 | 2.40 | 2.40 | 2.40 | 2.41 | 2.41 | 2.41 | 2.41 |
| #18 | 21.64 | 21.74 | 21.85 | 21.96 | 22.06 | 22.17 | 22.27 | 22.38 | 22.49 | 22.59 | 22.70 | 22.80 |
| — | 2.42 | 2.42 | 2.42 | 2.42 | 2.42 | 2.42 | 2.42 | 2.42 | 2.42 | 2.42 | 2.42 | 2.42 |
| #19 | 22.91 | 23.02 | 23.12 | 23.23 | 23.33 | 23.44 | 23.55 | 23.65 | 23.76 | 23.86 | 23.97 | 24.08 |
| — | 2.42 | 2.41 | 2.41 | 2.41 | 2.41 | 2.41 | 2.40 | 2.40 | 2.40 | 2.39 | 2.39 | 2.39 |
| #20 | 24.18 | 24.29 | 24.40 | 24.50 | 24.61 | 24.71 | 24.82 | 24.93 | 25.03 | 25.14 | 25.24 | 25.35 |
| — | 2.38 | 2.38 | 2.38 | 2.37 | 2.37 | 2.37 | 2.36 | 2.36 | 2.36 | 2.36 | 2.35 | 2.35 |
| #21 | 25.46 | 25.56 | 25.67 | 25.77 | 25.88 | 25.99 | 26.09 | 26.20 | 26.30 | 26.41 | 26.52 | 26.62 |
| — | 2.35 | 2.35 | 2.35 | 2.35 | 2.35 | 2.35 | 2.35 | 2.35 | 2.35 | 2.35 | 2.35 | 2.36 |
| #22 | 26.73 | 26.83 | 26.94 | 27.05 | 27.15 | 27.26 | 27.37 | 27.47 | 27.58 | 27.68 | 27.79 | 27.90 |
| — | 2.36 | 2.36 | 2.37 | 2.37 | 2.38 | 2.39 | 2.39 | 2.40 | 2.41 | 2.42 | 2.43 | 2.44 |
| #23 | 28.00 | 28.11 | 28.21 | 28.32 | 28.43 | 28.53 | 28.64 | 28.74 | 28.85 | 28.98 | 29.00 | 29.17 |
| — | 2.45 | 2.46 | 2.48 | 2.49 | 2.50 | 2.52 | 2.53 | 2.55 | 2.56 | 2.58 | 2.60 | 2.62 |
| #24 | 29.27 | 29.38 | 29.49 | 29.59 | 29.70 | 29.80 | 29.91 | 30.02 | 30.12 | 30.23 | 30.33 | 30.44 |
| — | 2.63 | 2.65 | 2.67 | 2.69 | 2.71 | 2.73 | 2.75 | 2.77 | 2.79 | 2.82 | 2.84 | 2.86 |
| #25 | 30.55 | 30.55 | 30.76 | 30.87 | 30.97 | 31.08 | 31.18 | 31.29 | 31.40 | 31.50 | 31.61 | 31.71 |
| — | 2.88 | 2.90 | 2.92 | 2.94 | 2.96 | 2.98 | 3.00 | 3.02 | 3.04 | 3.06 | 3.07 | 3.09 |
| #26 | 31.82 | 31.93 | 32.03 | 32.14 | 32.24 | 32.35 | 32.46 | 32.56 | 32.67 | 32.77 | 32.88 | 32.99 |
| — | 3.11 | 3.12 | 3.14 | 3.15 | 3.16 | 3.18 | 3.19 | 3.20 | 3.21 | 3.22 | 3.23 | 3.23 |

TABLE 4-continued

| Center conductor widths (1/3) | | | | | | | | | | | | |
|---|---|---|---|---|---|---|---|---|---|---|---|---|
| | z[mm] | | | | | | | | | | | |
| | 0.00 | 0.11 | 0.21 | 0.32 | 0.42 | 0.53 | 0.64 | 0.74 | 0.85 | 0.95 | 1.06 | 1.17 |
| | w[mm] | | | | | | | | | | | |
| | 2.68 | 2.68 | 2.68 | 2.68 | 2.69 | 2.69 | 2.69 | 2.70 | 2.70 | 2.70 | 2.71 | 2.71 |
| #27 | 33.09 | 33.20 | 33.30 | 33.41 | 33.52 | 33.62 | 33.73 | 33.84 | 33.94 | 34.05 | 34.15 | 34.26 |
| — | 3.24 | 3.24 | 3.25 | 3.25 | 3.25 | 3.25 | 3.25 | 3.25 | 3.25 | 3.25 | 3.25 | 3.24 |
| #28 | 34.37 | 34.47 | 34.58 | 34.68 | 34.79 | 34.90 | 35.00 | 35.11 | 35.21 | 35.32 | 35.43 | 35.53 |
| — | 3.24 | 3.23 | 3.23 | 3.22 | 3.21 | 3.20 | 3.20 | 3.19 | 3.18 | 3.17 | 3.16 | 3.15 |
| #29 | 35.64 | 35.74 | 35.85 | 35.96 | 36.06 | 36.17 | 36.27 | 36.38 | 36.49 | 36.50 | 36.70 | 36.80 |
| — | 3.14 | 3.13 | 3.12 | 3.12 | 3.11 | 3.10 | 3.09 | 3.08 | 3.07 | 3.07 | 3.06 | 3.05 |
| #30 | 36.91 | 37.02 | 37.12 | 37.23 | 37.34 | 37.44 | 37.55 | 37.65 | 37.76 | 37.87 | 37.97 | 38.08 |
| — | 3.05 | 3.04 | 3.04 | 3.04 | 3.03 | 3.03 | 3.03 | 3.03 | 3.03 | 3.03 | 3.03 | 3.04 |

TABLE 5

| Center conductor widths (2/3) | | | | | | | | | | | | |
|---|---|---|---|---|---|---|---|---|---|---|---|---|
| #31 | 38.18 | 38.29 | 38.40 | 38.50 | 38.61 | 38.71 | 38.82 | 38.93 | 39.03 | 39.14 | 39.24 | 39.35 |
| — | 3.04 | 3.04 | 3.05 | 3.05 | 3.06 | 3.07 | 3.08 | 3.08 | 3.09 | 3.10 | 3.11 | 3.12 |
| #32 | 39.46 | 39.56 | 39.67 | 39.77 | 39.88 | 39.90 | 40.09 | 40.20 | 40.31 | 40.41 | 40.52 | 40.62 |
| — | 3.13 | 3.14 | 3.15 | 3.17 | 3.18 | 3.19 | 3.20 | 3.21 | 3.22 | 3.23 | 3.24 | 3.25 |
| #33 | 40.73 | 40.84 | 40.94 | 41.05 | 41.15 | 41.26 | 41.37 | 41.47 | 41.58 | 41.68 | 41.79 | 41.90 |
| — | 3.26 | 3.27 | 3.27 | 3.28 | 3.28 | 3.29 | 3.29 | 3.29 | 3.29 | 3.28 | 3.28 | 3.27 |
| #34 | 42.00 | 42.11 | 42.21 | 42.32 | 42.43 | 42.53 | 42.64 | 42.74 | 42.85 | 42.96 | 43.06 | 43.17 |
| — | 3.26 | 3.25 | 3.24 | 3.22 | 3.21 | 3.19 | 3.17 | 3.14 | 3.12 | 3.09 | 3.06 | 3.02 |
| #35 | 43.27 | 43.38 | 43.49 | 43.59 | 43.70 | 43.81 | 43.91 | 44.02 | 44.12 | 44.23 | 44.34 | 44.44 |
| — | 2.99 | 2.95 | 2.91 | 2.87 | 2.83 | 2.78 | 2.73 | 2.69 | 2.64 | 2.58 | 2.53 | 2.48 |
| #36 | 44.55 | 44.65 | 44.76 | 44.87 | 44.97 | 45.08 | 45.18 | 45.29 | 45.40 | 45.50 | 45.61 | 45.71 |
| — | 2.42 | 2.37 | 2.31 | 2.25 | 2.19 | 2.14 | 2.08 | 2.02 | 1.96 | 1.99 | 1.85 | 1.79 |
| #37 | 45.82 | 45.93 | 46.03 | 46.14 | 46.24 | 46.35 | 46.46 | 46.56 | 46.67 | 46.78 | 46.88 | 46.99 |
| — | 1.73 | 1.68 | 1.63 | 1.57 | 1.52 | 1.47 | 1.42 | 1.37 | 1.33 | 1.28 | 1.24 | 1.20 |
| #38 | 47.09 | 47.20 | 47.31 | 47.41 | 47.52 | 47.62 | 47.73 | 47.84 | 47.94 | 48.05 | 48.15 | 48.26 |
| — | 1.16 | 1.12 | 1.08 | 1.05 | 1.01 | 0.98 | 0.95 | 0.93 | 0.90 | 0.88 | 0.86 | 0.84 |
| #39 | 48.37 | 48.47 | 48.58 | 48.68 | 48.79 | 48.90 | 49.00 | 49.11 | 49.21 | 49.32 | 49.43 | 49.53 |
| — | 0.82 | 0.80 | 0.79 | 0.78 | 0.77 | 0.76 | 0.76 | 0.75 | 0.75 | 0.75 | 0.75 | 0.76 |
| #40 | 49.64 | 49.74 | 49.65 | 49.96 | 50.06 | 50.17 | 50.28 | 50.38 | 50.49 | 50.59 | 50.70 | 50.81 |
| — | 0.76 | 0.77 | 0.78 | 0.80 | 0.81 | 0.83 | 0.85 | 0.87 | 0.90 | 0.93 | 0.96 | 1.00 |
| #41 | 50.01 | 51.02 | 51.12 | 51.23 | 51.34 | 51.44 | 51.55 | 51.65 | 51.76 | 51.87 | 51.97 | 52.08 |
| — | 1.03 | 1.07 | 1.12 | 1.17 | 1.22 | 1.27 | 1.33 | 1.40 | 1.47 | 1.54 | 1.61 | 1.69 |
| #42 | 52.18 | 52.29 | 52.40 | 52.50 | 52.61 | 52.71 | 52.82 | 52.93 | 53.03 | 53.14 | 53.25 | 53.35 |
| — | 1.78 | 1.87 | 1.96 | 2.06 | 2.17 | 2.28 | 2.39 | 2.51 | 2.63 | 2.76 | 2.90 | 3.04 |
| #43 | 53.46 | 53.56 | 53.67 | 53.78 | 53.88 | 53.99 | 54.09 | 54.20 | 54.31 | 54.41 | 54.52 | 54.62 |
| — | 3.18 | 3.33 | 3.49 | 3.65 | 3.81 | 3.98 | 4.15 | 4.33 | 4.51 | 4.69 | 4.88 | 5.07 |
| #44 | 54.73 | 54.84 | 54.94 | 55.05 | 55.15 | 55.26 | 55.37 | 55.47 | 55.58 | 55.68 | 55.79 | 55.80 |
| — | 5.26 | 5.45 | 5.64 | 5.83 | 6.03 | 6.22 | 6.41 | 6.59 | 6.77 | 6.95 | 7.12 | 7.29 |
| #45 | 56.00 | 56.11 | 56.21 | 56.32 | 56.43 | 56.53 | 56.64 | 56.75 | 56.85 | 56.96 | 57.06 | 57.17 |
| — | 7.45 | 7.60 | 7.74 | 7.87 | 7.99 | 8.10 | 8.20 | 8.28 | 8.35 | 8.41 | 8.45 | 8.48 |
| #46 | 57.28 | 57.38 | 57.49 | 57.59 | 57.70 | 57.81 | 57.91 | 58.02 | 58.12 | 58.23 | 58.34 | 58.44 |
| — | 8.49 | 8.48 | 8.47 | 8.43 | 8.38 | 8.32 | 8.24 | 8.15 | 8.05 | 7.93 | 7.80 | 7.66 |
| #47 | 58.55 | 58.65 | 58.76 | 58.87 | 58.97 | 59.08 | 59.18 | 59.29 | 59.40 | 59.50 | 59.61 | 59.72 |
| — | 7.51 | 7.35 | 7.18 | 7.01 | 6.82 | 6.64 | 6.44 | 6.29 | 6.05 | 5.84 | 5.64 | 5.44 |
| #48 | 59.82 | 59.93 | 60.03 | 60.14 | 60.25 | 60.35 | 60.46 | 60.56 | 60.67 | 60.78 | 60.88 | 60.99 |
| — | 5.23 | 5.03 | 4.83 | 4.63 | 4.43 | 4.24 | 4.05 | 3.87 | 3.68 | 3.51 | 3.33 | 3.17 |
| #49 | 61.09 | 61.20 | 61.31 | 61.41 | 61.52 | 61.62 | 61.73 | 61.84 | 61.94 | 62.05 | 62.15 | 62.25 |
| — | 3.00 | 2.85 | 2.70 | 2.55 | 2.41 | 2.27 | 2.15 | 2.02 | 1.90 | 1.79 | 1.68 | 1.58 |
| #50 | 62.37 | 62.47 | 62.58 | 62.69 | 62.79 | 62.90 | 63.00 | 63.11 | 63.22 | 63.32 | 63.43 | 63.53 |
| — | 1.48 | 1.39 | 1.30 | 1.22 | 1.15 | 1.07 | 1.01 | 0.94 | 0.88 | 0.83 | 0.78 | 0.73 |
| #51 | 63.64 | 63.76 | 63.85 | 63.96 | 64.06 | 64.17 | 64.28 | 64.38 | 64.49 | 64.59 | 64.70 | 64.81 |
| — | 0.69 | 0.65 | 0.61 | 0.58 | 0.55 | 0.52 | 0.50 | 0.48 | 0.46 | 0.44 | 0.43 | 0.41 |
| #52 | 64.91 | 65.02 | 65.12 | 65.23 | 65.34 | 65.44 | 65.55 | 65.65 | 65.76 | 65.87 | 65.97 | 66.08 |
| — | 0.40 | 0.39 | 0.39 | 0.38 | 0.38 | 0.38 | 0.38 | 0.38 | 0.39 | 0.39 | 0.40 | 0.41 |
| #53 | 66.19 | 66.29 | 66.40 | 66.50 | 66.61 | 66.72 | 66.82 | 66.93 | 67.03 | 67.14 | 67.25 | 67.35 |
| — | 0.42 | 0.44 | 0.46 | 0.47 | 0.50 | 0.52 | 0.55 | 0.57 | 0.61 | 0.64 | 0.68 | 0.72 |
| #54 | 67.46 | 67.56 | 67.67 | 67.78 | 67.88 | 67.99 | 68.09 | 68.20 | 68.31 | 68.41 | 68.52 | 68.62 |
| — | 0.76 | 0.81 | 0.86 | 0.92 | 0.96 | 1.04 | 1.11 | 1.18 | 1.26 | 1.33 | 1.42 | 1.51 |
| #55 | 68.73 | 68.84 | 68.94 | 69.05 | 69.16 | 69.25 | 69.37 | 69.47 | 69.58 | 69.69 | 69.79 | 69.90 |
| — | 1.60 | 1.70 | 1.80 | 1.90 | 2.01 | 2.13 | 2.24 | 2.37 | 2.49 | 2.52 | 2.76 | 2.89 |
| #56 | 70.00 | 70.11 | 70.22 | 70.32 | 70.43 | 70.53 | 70.64 | 70.75 | 70.86 | 70.96 | 71.00 | 71.17 |
| — | 3.03 | 3.18 | 3.32 | 3.47 | 3.62 | 3.77 | 3.93 | 4.08 | 4.24 | 4.40 | 4.55 | 4.71 |
| #57 | 71.28 | 71.38 | 71.49 | 71.59 | 71.70 | 71.81 | 71.91 | 72.02 | 72.12 | 72.23 | 72.34 | 72.44 |
| — | 4.86 | 5.01 | 5.16 | 5.31 | 5.45 | 5.59 | 5.72 | 5.85 | 5.97 | 6.08 | 6.19 | 6.28 |

TABLE 5-continued

| Center conductor widths (2/3) | | | | | | | | | | | | |
|---|---|---|---|---|---|---|---|---|---|---|---|---|
| #58 | 72.55 | 72.66 | 72.76 | 72.87 | 72.97 | 73.08 | 73.19 | 73.29 | 73.40 | 73.50 | 73.61 | 73.72 |
| — | 6.38 | 6.46 | 6.54 | 6.60 | 6.65 | 6.70 | 6.73 | 6.76 | 6.77 | 6.77 | 6.77 | 6.75 |
| #59 | 73.82 | 73.93 | 74.03 | 74.14 | 74.25 | 74.35 | 74.46 | 74.56 | 74.67 | 74.78 | 74.88 | 74.90 |
| — | 6.72 | 6.69 | 6.64 | 6.59 | 6.52 | 6.45 | 6.37 | 6.29 | 6.19 | 6.09 | 5.99 | 5.88 |
| #60 | 75.09 | 75.20 | 75.31 | 75.41 | 75.52 | 75.63 | 75.73 | 75.84 | 75.94 | 76.05 | 76.16 | 76.25 |
| — | 5.77 | 5.65 | 5.53 | 5.41 | 5.28 | 5.15 | 5.02 | 4.90 | 4.77 | 4.64 | 4.51 | 4.38 |

TABLE 6

| Center conductor widths (3/3) | | | | | | | | | | | | |
|---|---|---|---|---|---|---|---|---|---|---|---|---|
| #61 | 76.37 | 76.47 | 76.58 | 76.69 | 76.79 | 76.90 | 77.00 | 77.11 | 77.22 | 77.32 | 77.43 | 77.53 |
| — | 4.25 | 4.13 | 4.01 | 3.88 | 3.77 | 3.65 | 3.53 | 3.42 | 3.32 | 3.21 | 3.11 | 3.01 |
| #62 | 77.64 | 77.75 | 77.85 | 77.96 | 78.06 | 78.17 | 78.28 | 78.38 | 78.49 | 78.59 | 78.70 | 78.81 |
| — | 2.92 | 2.82 | 2.74 | 2.65 | 2.57 | 2.49 | 2.41 | 2.34 | 2.28 | 2.21 | 2.15 | 2.09 |
| #63 | 78.91 | 79.02 | 79.13 | 79.23 | 79.34 | 79.44 | 79.55 | 79.66 | 79.76 | 79.87 | 79.97 | 80.08 |
| — | 2.03 | 1.98 | 1.93 | 1.89 | 1.84 | 1.80 | 1.77 | 1.73 | 1.70 | 1.67 | 1.64 | 1.62 |
| #64 | 80.19 | 80.29 | 80.40 | 80.50 | 80.61 | 80.72 | 80.82 | 80.93 | 81.03 | 81.14 | 81.25 | 81.35 |
| — | 1.59 | 1.57 | 1.56 | 1.54 | 1.53 | 1.52 | 1.51 | 1.50 | 1.50 | 1.49 | 1.49 | 1.49 |
| #65 | 81.46 | 51.56 | 81.67 | 81.78 | 81.88 | 81.99 | 82.10 | 82.20 | 82.31 | 82.41 | 82.52 | 82.03 |
| — | 1.49 | 1.50 | 1.50 | 1.51 | 1.52 | 1.53 | 1.54 | 1.55 | 1.56 | 1.58 | 1.59 | 1.61 |
| #66 | 82.73 | 82.84 | 82.94 | 83.05 | 83.16 | 83.26 | 83.37 | 83.47 | 83.58 | 83.69 | 83.79 | 83.90 |
| — | 1.63 | 1.65 | 1.67 | 1.69 | 1.71 | 1.73 | 1.75 | 1.77 | 1.80 | 1.82 | 1.84 | 1.86 |
| #67 | 84.00 | 84.11 | 84.22 | 84.32 | 84.43 | 84.53 | 84.64 | 84.75 | 84.85 | 84.96 | 85.06 | 85.17 |
| — | 1.89 | 1.91 | 1.93 | 1.96 | 1.98 | 2.00 | 2.02 | 2.04 | 2.07 | 2.09 | 2.10 | 2.12 |
| #68 | 85.28 | 85.38 | 85.49 | 85.60 | 85.70 | 85.81 | 85.91 | 86.02 | 86.13 | 86.23 | 86.34 | 86.44 |
| — | 2.14 | 2.16 | 2.17 | 2.19 | 2.20 | 2.22 | 2.23 | 2.24 | 2.25 | 2.26 | 2.27 | 2.28 |
| #69 | 86.55 | 86.66 | 86.76 | 86.87 | 86.97 | 87.86 | 87.19 | 87.29 | 87.40 | 87.59 | 87.61 | 87.72 |
| — | 2.28 | 2.29 | 2.29 | 2.30 | 2.30 | 2.30 | 2.30 | 2.30 | 2.30 | 2.30 | 2.30 | 2.29 |
| #70 | 87.82 | 87.93 | 88.03 | 88.14 | 88.25 | 88.35 | 88.46 | 88.57 | 88.67 | 88.78 | 88.88 | 88.99 |
| — | 2.29 | 2.29 | 2.29 | 2.28 | 2.28 | 2.27 | 2.27 | 2.27 | 2.26 | 2.26 | 2.26 | 2.25 |
| #71 | 89.10 | 89.20 | 89.31 | 89.41 | 89.52 | 89.63 | 89.73 | 89.84 | 89.94 | 90.05 | 90.16 | 90.26 |
| — | 2.25 | 2.25 | 2.25 | 2.25 | 2.24 | 2.24 | 2.25 | 2.25 | 2.25 | 2.25 | 2.26 | 2.26 |
| #72 | 90.37 | 90.47 | 90.58 | 90.69 | 90.79 | 90.90 | 91.00 | 91.11 | 91.22 | 91.32 | 91.43 | 91.53 |
| — | 2.27 | 2.27 | 2.28 | 2.29 | 2.30 | 2.31 | 2.33 | 2.34 | 2.35 | 2.37 | 2.39 | 2.41 |
| #73 | 91.64 | 91.75 | 91.85 | 91.06 | 92.07 | 92.17 | 92.28 | 92.38 | 92.49 | 92.60 | 92.70 | 92.81 |
| — | 2.43 | 2.45 | 2.47 | 2.49 | 2.52 | 2.54 | 2.57 | 2.60 | 2.63 | 2.66 | 2.69 | 2.72 |
| #74 | 92.91 | 93.02 | 93.13 | 93.23 | 93.34 | 93.44 | 93.55 | 93.65 | 93.76 | 93.87 | 93.97 | 94.08 |
| — | 2.75 | 2.78 | 2.82 | 2.85 | 2.89 | 2.93 | 2.96 | 3.00 | 3.04 | 3.08 | 3.11 | 3.15 |
| #75 | 94.19 | 94.29 | 94.40 | 94.50 | 94.61 | 94.72 | 94.82 | 94.93 | 95.04 | 95.14 | 95.25 | 95.35 |
| — | 3.19 | 3.23 | 3.27 | 3.30 | 3.34 | 3.38 | 3.41 | 3.45 | 3.48 | 3.52 | 3.55 | 3.58 |
| #76 | 95.46 | 95.57 | 95.67 | 95.78 | 95.88 | 95.99 | 96.10 | 96.20 | 96.31 | 96.41 | 96.52 | 96.63 |
| — | 3.61 | 3.64 | 3.66 | 3.69 | 3.71 | 3.73 | 3.75 | 3.77 | 3.78 | 3.79 | 3.81 | 3.81 |
| #77 | 98.73 | 96.84 | 96.94 | 97.05 | 97.16 | 97.26 | 97.37 | 97.47 | 97.58 | 97.69 | 97.79 | 97.90 |
| — | 3.82 | 3.82 | 3.83 | 3.82 | 3.82 | 3.82 | 3.81 | 3.80 | 3.79 | 3.77 | 3.76 | 3.74 |
| #78 | 98.00 | 98.11 | 98.22 | 98.32 | 98.43 | 98.54 | 98.64 | 98.75 | 98.85 | 98.96 | 99.07 | 99.17 |
| — | 3.72 | 3.69 | 3.67 | 3.64 | 3.62 | 3.59 | 3.56 | 3.52 | 3.49 | 3.46 | 3.42 | 3.38 |
| #79 | 99.28 | 99.38 | 99.49 | 99.60 | 99.70 | 99.81 | 99.91 | 100.02 | 100.13 | 100.23 | 100.34 | 100.44 |
| — | 3.35 | 3.31 | 3.27 | 3.23 | 3.19 | 3.15 | 3.12 | 3.08 | 3.04 | 3.00 | 2.96 | 2.92 |
| #80 | 100.55 | 100.66 | 100.76 | 100.87 | 100.97 | 101.08 | 101.19 | 101.29 | 101.40 | 101.51 | 101.61 | 101.72 |
| — | 2.88 | 2.85 | 2.81 | 2.77 | 2.74 | 2.70 | 2.67 | 2.64 | 2.60 | 2.57 | 2.54 | 2.51 |
| #81 | 101.82 | 101.93 | 102.04 | 102.14 | 102.25 | 102.35 | 102.46 | 102.57 | 102.67 | 102.78 | 102.88 | 102.99 |
| — | 2.49 | 2.46 | 2.43 | 2.41 | 2.39 | 2.36 | 2.34 | 2.32 | 2.31 | 2.29 | 2.27 | 2.26 |
| #82 | 103.10 | 103.20 | 103.31 | 103.41 | 103.52 | 103.63 | 103.73 | 103.84 | 103.94 | 104.05 | 104.16 | 104.26 |
| — | 2.24 | 2.23 | 2.22 | 2.21 | 2.20 | 2.19 | 2.19 | 2.18 | 2.18 | 2.17 | 2.17 | 2.17 |
| #83 | 104.37 | 104.48 | 104.58 | 104.69 | 104.79 | 104.90 | 105.01 | 105.11 | 105.22 | 105.32 | 105.43 | 105.54 |
| — | 2.17 | 2.16 | 2.17 | 2.17 | 2.17 | 2.17 | 2.17 | 2.18 | 2.18 | 2.19 | 2.19 | 2.20 |
| #84 | 105.64 | 105.75 | 105.85 | 105.96 | 106.07 | | | | | | | |
| — | 2.20 | 2.21 | 2.21 | 2.22 | 2.22 | | | | | | | |

Figure 10:
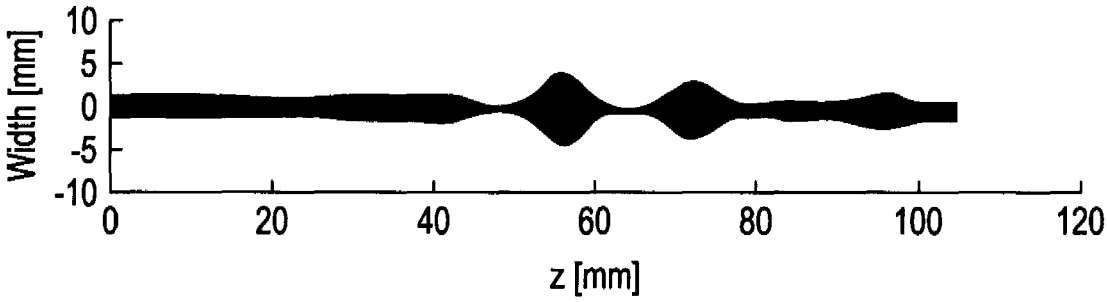
FIG. 10 is a graph showing the shape of the center conductor in the reflection-type bandpass filter manufactured in Embodiment 2.

FIG. 10 shows the shape of the center conductor 6 in the reflection-type bandpass filter 1 of Embodiment 2. In the figure, the dark portion represents the center conductor 6. A non-reflecting terminator, or an R=50Ω resistance, is provided on the terminating side (the face at z=106.07 mm) of this reflection-type bandpass filter 1. The thicknesses of the conducting layers 4, 5 and of the center conductor 6 may be thick compared with the skin depth at f=1 GHz. For example, when using copper, the thickness of the conducting layers 4, 5 and of the center conductor 6 may be 2.1 μm or greater. This bandpass filter is used in a system with a characteristic impedance of 50Ω.

Figure 11:
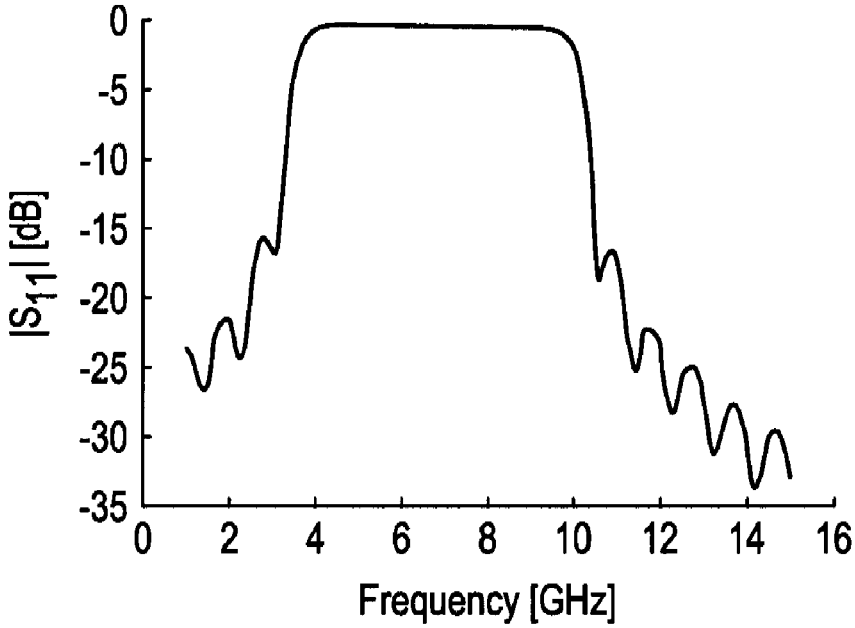
FIG. 11 is a graph showing the reflected-wave amplitude characteristic in the reflection-type bandpass filter manufactured in Embodiment 2.
Figure 12:
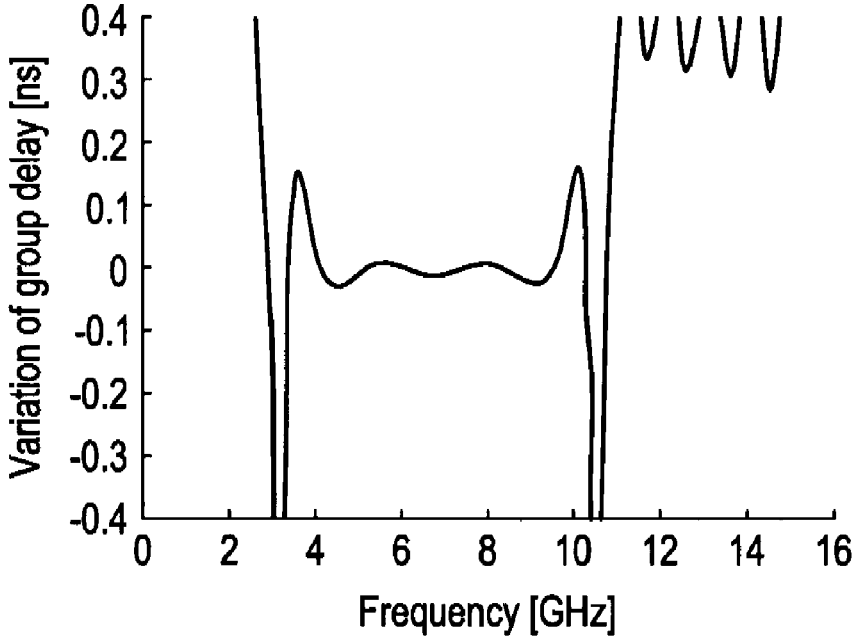
FIG. 12 is a graph showing the reflected-wave group delay characteristic in the reflection-type bandpass filter manufactured in Embodiment 2.

FIG. 11 and FIG. 12 show the amplitude characteristic and group delay characteristic respectively of reflected waves ($S_{11}$) in the bandpass filter of Embodiment 2. As shown in the figures, in the range of frequencies f for which 3.9 GHz≦f≦9.8 GHz, the reflectance is −1 dB or greater, and the group delay variation is within ±0.07 ns. In the region f<3.1 GHz or f>10.6 GHz, the reflectance is −15 dB or lower.

Embodiment 3

Figure 13:
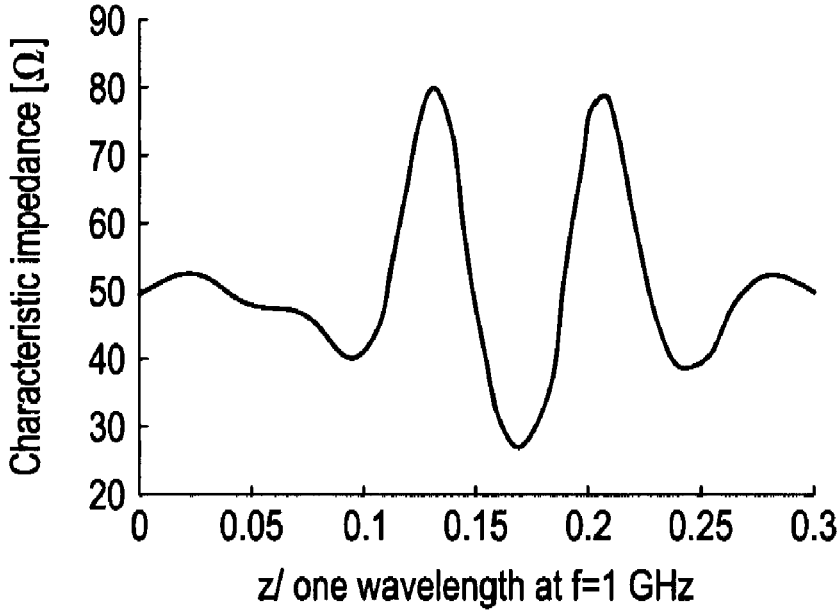
FIG. 13 is a graph showing the characteristic impedance distribution of the reflection-type bandpass filter manufactured in Embodiment 3.

A Kaiser window was used for which the reflectance is 0.9 at frequencies f in the range 4.0 GHz≦f≦9.6 GHz, and is 0 elsewhere, and for which A=30. Design was performed using the wavelength of signals at frequency f=0.3 GHz propagating in the microstrip as the waveguide length, and setting the system characteristic impedance to 50Ω. FIG. 13 shows the distribution in the z-axis direction of the local characteristic impedance obtained in the inverse problem.

Figure 14:
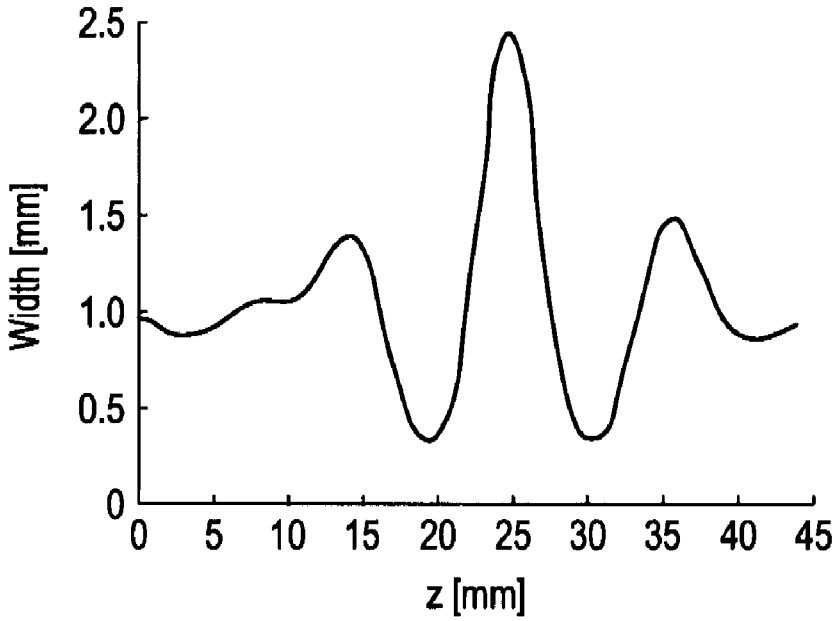
FIG. 14 is a graph showing the center conductor width distribution in the reflection-type bandpass filter manufactured in Embodiment 3.

FIG. 14 shows the z-axis distribution of the center conductor width w, when using a dielectric layer 3 of thickness h=2 mm and with relative permittivity $\in_r$=4.2. Tables 7 and 8 list the center conductor widths.

TABLE 7

Center conductor widths (1/2)

| | z[mm] | | | | | | | | | | | |
|---|---|---|---|---|---|---|---|---|---|---|---|---|
| | 0.00 | 0.07 | 0.15 | 0.22 | 0.29 | 0.37 | 0.44 | 0.51 | 0.59 | 0.66 | 0.73 | 0.81 |
| | w[mm] | | | | | | | | | | | |
| | 0.96 | 0.96 | 0.96 | 0.96 | 0.96 | 0.95 | 0.95 | 0.95 | 0.95 | 0.94 | 0.94 | 0.94 |
| #2 | 0.88 | 0.95 | 1.02 | 1.10 | 1.17 | 1.24 | 1.32 | 1.39 | 1.46 | 1.54 | 1.61 | 1.68 |
| — | 0.93 | 0.93 | 0.93 | 0.93 | 0.92 | 0.92 | 0.92 | 0.92 | 0.91 | 0.91 | 0.91 | 0.90 |
| #3 | 1.76 | 1.83 | 1.90 | 1.98 | 2.05 | 2.12 | 2.20 | 2.27 | 2.34 | 2.42 | 2.49 | 2.56 |
| — | 0.90 | 0.90 | 0.90 | 0.90 | 0.89 | 0.89 | 0.89 | 0.89 | 0.89 | 0.88 | 0.88 | 0.88 |
| #4 | 2.63 | 2.71 | 2.78 | 2.86 | 2.93 | 3.00 | 3.07 | 3.15 | 3.22 | 3.29 | 3.37 | 3.44 |
| — | 0.88 | 0.88 | 0.88 | 0.88 | 0.88 | 0.88 | 0.88 | 0.88 | 0.88 | 0.88 | 0.88 | 0.88 |
| #5 | 3.51 | 3.59 | 3.68 | 3.73 | 3.81 | 3.88 | 3.95 | 4.03 | 4.10 | 4.17 | 4.25 | 4.32 |
| — | 0.88 | 0.88 | 0.88 | 0.88 | 0.88 | 0.89 | 0.89 | 0.89 | 0.89 | 0.89 | 0.90 | 0.90 |
| #6 | 4.39 | 4.46 | 4.54 | 4.61 | 4.68 | 4.76 | 4.83 | 4.90 | 4.98 | 5.05 | 5.12 | 5.20 |
| — | 0.90 | 0.91 | 0.91 | 0.91 | 0.91 | 0.92 | 0.92 | 0.93 | 0.93 | 0.93 | 0.94 | 0.94 |
| #7 | 5.27 | 5.34 | 5.42 | 5.49 | 5.56 | 5.64 | 5.71 | 5.78 | 5.86 | 5.93 | 6.00 | 6.07 |
| — | 0.94 | 0.95 | 0.95 | 0.96 | 0.96 | 0.96 | 0.97 | 0.97 | 0.98 | 0.98 | 0.98 | 0.99 |
| #8 | 6.15 | 6.22 | 6.29 | 6.37 | 6.44 | 6.51 | 6.59 | 6.66 | 6.73 | 6.81 | 6.88 | 6.95 |
| — | 0.99 | 1.00 | 1.00 | 1.00 | 1.01 | 1.01 | 1.01 | 1.02 | 1.02 | 1.02 | 1.03 | 1.03 |
| #9 | 7.03 | 7.10 | 7.17 | 7.25 | 7.32 | 7.39 | 7.47 | 7.54 | 7.61 | 7.69 | 7.76 | 7.83 |
| — | 1.03 | 1.03 | 1.04 | 1.04 | 1.04 | 1.04 | 1.04 | 1.04 | 1.04 | 1.05 | 1.05 | 1.05 |
| #10 | 7.90 | 7.98 | 8.05 | 8.12 | 8.20 | 8.27 | 8.34 | 8.42 | 8.49 | 8.56 | 8.64 | 8.71 |
| — | 1.05 | 1.05 | 1.05 | 1.05 | 1.05 | 1.05 | 1.05 | 1.05 | 1.05 | 1.05 | 1.05 | 1.05 |
| #11 | 8.78 | 8.86 | 8.93 | 9.00 | 9.08 | 9.15 | 9.22 | 9.30 | 9.37 | 9.44 | 9.52 | 9.59 |
| — | 1.05 | 1.05 | 1.05 | 1.05 | 1.05 | 1.05 | 1.05 | 1.05 | 1.05 | 1.05 | 1.05 | 1.05 |
| #12 | 9.66 | 9.73 | 9.81 | 9.88 | 9.95 | 10.03 | 10.10 | 10.17 | 10.25 | 10.32 | 10.39 | 10.47 |
| — | 1.06 | 1.06 | 1.06 | 1.06 | 1.06 | 1.06 | 1.07 | 1.07 | 1.07 | 1.07 | 1.08 | 1.08 |
| #13 | 10.54 | 10.61 | 10.69 | 10.76 | 10.83 | 10.91 | 10.98 | 11.05 | 11.13 | 11.20 | 11.27 | 11.34 |
| — | 1.09 | 1.09 | 1.09 | 1.10 | 1.10 | 1.11 | 1.12 | 1.12 | 1.13 | 1.13 | 1.14 | 1.15 |
| #14 | 11.42 | 11.40 | 11.56 | 11.64 | 11.71 | 11.78 | 11.86 | 11.93 | 12.00 | 12.05 | 12.15 | 12.22 |
| — | 1.16 | 1.16 | 1.17 | 1.18 | 1.19 | 1.20 | 1.21 | 1.21 | 1.22 | 1.23 | 1.24 | 1.25 |
| #15 | 12.30 | 12.37 | 12.44 | 12.52 | 12.59 | 12.66 | 12.74 | 12.81 | 12.88 | 12.96 | 13.03 | 13.10 |
| — | 1.26 | 1.27 | 1.28 | 1.29 | 1.30 | 1.31 | 1.31 | 1.32 | 1.33 | 1.34 | 1.35 | 1.35 |
| #16 | 13.17 | 13.25 | 13.32 | 13.39 | 13.47 | 13.54 | 13.61 | 13.69 | 13.76 | 13.83 | 13.91 | 13.98 |
| — | 1.36 | 1.37 | 1.37 | 1.38 | 1.38 | 1.39 | 1.39 | 1.39 | 1.39 | 1.40 | 1.40 | 1.40 |
| #17 | 14.05 | 14.13 | 14.20 | 14.27 | 14.35 | 14.42 | 14.49 | 14.57 | 14.64 | 14.71 | 17.78 | 14.86 |
| — | 1.39 | 1.39 | 1.39 | 1.38 | 1.38 | 1.37 | 1.37 | 1.36 | 1.35 | 1.34 | 1.33 | 1.31 |
| #18 | 14.93 | 15.00 | 15.08 | 15.15 | 15.22 | 15.30 | 15.37 | 15.44 | 15.52 | 15.59 | 15.66 | 15.74 |
| — | 1.30 | 1.29 | 1.27 | 1.26 | 1.24 | 1.22 | 1.20 | 1.18 | 1.17 | 1.14 | 1.12 | 1.10 |
| #19 | 15.81 | 15.88 | 15.96 | 16.03 | 16.10 | 16.18 | 16.25 | 16.32 | 16.40 | 16.47 | 16.54 | 16.61 |
| — | 1.08 | 1.06 | 1.03 | 1.01 | 0.99 | 0.96 | 0.94 | 0.92 | 0.89 | 0.87 | 0.84 | 0.82 |
| #20 | 16.69 | 16.76 | 16.83 | 16.91 | 16.98 | 17.05 | 17.13 | 17.20 | 17.27 | 17.35 | 17.42 | 17.49 |
| — | 0.80 | 0.77 | 0.75 | 0.73 | 0.71 | 0.68 | 0.66 | 0.64 | 0.62 | 0.60 | 0.58 | 0.56 |
| #21 | 17.57 | 17.64 | 17.71 | 17.79 | 17.86 | 17.93 | 18.01 | 18.08 | 18.15 | 18.22 | 18.30 | 18.37 |
| — | 0.55 | 0.53 | 0.51 | 0.50 | 0.48 | 0.47 | 0.45 | 0.44 | 0.43 | 0.42 | 0.40 | 0.39 |
| #22 | 18.44 | 18.52 | 18.59 | 18.66 | 18.74 | 18.81 | 18.88 | 18.96 | 19.03 | 19.10 | 19.18 | 19.25 |
| — | 0.39 | 0.38 | 0.37 | 0.36 | 0.36 | 0.35 | 0.35 | 0.34 | 0.34 | 0.34 | 0.33 | 0.33 |
| #23 | 19.32 | 19.40 | 19.47 | 19.54 | 19.62 | 19.69 | 19.76 | 19.84 | 19.91 | 19.98 | 20.05 | 20.13 |
| — | 0.33 | 0.33 | 0.33 | 0.34 | 0.34 | 0.34 | 0.35 | 0.35 | 0.36 | 0.37 | 0.37 | 0.38 |
| #24 | 20.20 | 20.27 | 20.35 | 20.42 | 20.49 | 20.57 | 20.64 | 20.71 | 20.79 | 20.86 | 20.93 | 21.01 |
| — | 0.39 | 0.40 | 0.42 | 0.43 | 0.44 | 0.46 | 0.48 | 0.49 | 0.51 | 0.53 | 0.55 | 0.58 |
| #25 | 21.08 | 21.15 | 21.23 | 21.30 | 21.37 | 21.45 | 21.52 | 21.59 | 21.66 | 21.74 | 21.81 | 21.88 |
| — | 0.60 | 0.63 | 0.65 | 0.68 | 0.71 | 0.74 | 0.78 | 0.81 | 0.84 | 0.88 | 0.92 | 0.96 |
| #26 | 21.90 | 22.03 | 22.10 | 22.18 | 22.25 | 22.32 | 32.40 | 22.47 | 22.54 | 22.62 | 22.69 | 22.76 |
| — | 1.00 | 1.04 | 1.08 | 1.13 | 1.17 | 1.22 | 1.27 | 1.31 | 1.36 | 1.41 | 1.46 | 1.51 |
| #27 | 22.84 | 22.91 | 22.98 | 23.06 | 23.13 | 23.20 | 23.28 | 23.35 | 23.42 | 23.49 | 23.57 | 23.64 |
| — | 1.56 | 1.61 | 1.66 | 1.71 | 1.76 | 1.81 | 1.86 | 1.91 | 1.96 | 2.01 | 2.05 | 2.09 |
| #28 | 23.71 | 23.79 | 23.86 | 23.93 | 24.01 | 24.08 | 24.15 | 24.23 | 24.30 | 24.37 | 24.45 | 24.52 |
| — | 2.14 | 2.18 | 2.22 | 2.25 | 2.29 | 2.32 | 2.35 | 2.37 | 2.39 | 2.41 | 2.43 | 2.45 |
| #29 | 24.59 | 24.67 | 24.74 | 24.81 | 24.89 | 24.96 | 25.03 | 25.11 | 25.18 | 25.25 | 25.32 | 25.40 |
| — | 2.46 | 2.46 | 2.47 | 2.47 | 2.47 | 2.46 | 2.45 | 2.44 | 2.42 | 2.40 | 2.38 | 2.36 |
| #30 | 25.47 | 25.54 | 25.62 | 25.69 | 25.76 | 25.84 | 25.91 | 25.98 | 26.06 | 26.13 | 26.20 | 26.28 |
| — | 2.33 | 2.30 | 2.27 | 2.23 | 2.19 | 2.15 | 2.11 | 2.07 | 2.03 | 1.98 | 1.93 | 1.88 |

TABLE 8

| Center conductor widths (2/2) | | | | | | | | | | | | |
|---|---|---|---|---|---|---|---|---|---|---|---|---|
| #31 | 25.35 | 26.42 | 26.50 | 26.57 | 26.64 | 26.72 | 26.79 | 26.86 | 26.93 | 27.01 | 27.08 | 27.15 |
| — | 1.84 | 1.79 | 1.74 | 1.69 | 1.64 | 1.59 | 1.54 | 1.49 | 1.44 | 1.39 | 1.34 | 1.29 |
| #32 | 27.23 | 27.30 | 27.37 | 27.45 | 27.52 | 27.59 | 27.67 | 27.74 | 27.81 | 27.80 | 27.96 | 28.03 |
| — | 1.24 | 1.20 | 1.15 | 1.11 | 1.07 | 1.02 | 0.98 | 0.94 | 0.91 | 0.87 | 0.83 | 0.80 |
| #33 | 28.11 | 28.18 | 28.26 | 28.33 | 28.40 | 28.47 | 28.55 | 28.62 | 28.69 | 28.76 | 28.84 | 28.91 |
| — | 0.77 | 0.73 | 0.70 | 0.68 | 0.65 | 0.62 | 0.60 | 0.58 | 0.55 | 0.53 | 0.51 | 0.40 |
| #34 | 28.99 | 29.06 | 29.13 | 29.20 | 29.28 | 29.35 | 29.42 | 29.50 | 29.57 | 29.64 | 29.72 | 29.79 |
| — | 0.48 | 0.46 | 0.45 | 0.43 | 0.42 | 0.41 | 0.40 | 0.39 | 0.38 | 0.37 | 0.37 | 0.36 |
| #35 | 29.86 | 29.94 | 30.01 | 30.08 | 30.16 | 30.23 | 30.30 | 30.37 | 30.45 | 30.52 | 30.59 | 30.67 |
| — | 0.36 | 0.35 | 0.35 | 0.35 | 0.35 | 0.34 | 0.34 | 0.35 | 0.35 | 0.35 | 0.35 | 0.36 |
| #36 | 30.74 | 30.81 | 30.89 | 30.96 | 31.03 | 31.11 | 31.18 | 31.25 | 31.33 | 31.40 | 31.47 | 31.56 |
| — | 0.36 | 0.37 | 0.37 | 0.38 | 0.39 | 0.40 | 0.40 | 0.41 | 0.43 | 0.44 | 0.45 | 0.46 |
| #37 | 31.62 | 31.69 | 31.77 | 31.84 | 31.91 | 31.99 | 32.06 | 32.13 | 32.20 | 32.28 | 32.35 | 32.42 |
| — | 0.48 | 0.49 | 0.51 | 0.52 | 0.54 | 0.56 | 0.57 | 0.59 | 0.61 | 0.63 | 0.65 | 0.68 |
| #38 | 32.50 | 32.57 | 32.64 | 32.72 | 32.79 | 32.86 | 32.94 | 33.01 | 33.08 | 33.16 | 33.23 | 33.30 |
| — | 0.70 | 0.72 | 0.74 | 0.77 | 0.79 | 0.82 | 0.84 | 0.87 | 0.89 | 0.92 | 0.94 | 0.97 |
| #39 | 33.38 | 33.45 | 33.52 | 33.60 | 33.67 | 33.74 | 33.81 | 33.89 | 33.96 | 34.03 | 34.11 | 34.18 |
| — | 1.00 | 1.02 | 1.05 | 1.07 | 1.10 | 1.12 | 1.15 | 1.17 | 1.19 | 1.22 | 1.24 | 1.26 |
| #40 | 34.25 | 34.33 | 34.40 | 34.47 | 34.55 | 34.62 | 34.69 | 34.77 | 34.84 | 34.91 | 34.99 | 35.06 |
| — | 1.28 | 1.30 | 1.32 | 1.34 | 1.36 | 1.37 | 1.39 | 1.40 | 1.42 | 1.43 | 1.44 | 1.45 |
| #41 | 35.13 | 35.21 | 35.28 | 35.35 | 35.43 | 35.50 | 35.57 | 35.64 | 35.72 | 35.79 | 35.86 | 35.94 |
| — | 1.46 | 1.47 | 1.47 | 1.48 | 1.48 | 1.49 | 1.49 | 1.49 | 1.49 | 1.49 | 1.49 | 1.49 |
| #42 | 36.01 | 36.08 | 36.16 | 36.23 | 36.30 | 36.38 | 36.45 | 36.52 | 36.60 | 36.67 | 36.74 | 36.82 |
| — | 1.48 | 1.48 | 1.47 | 1.46 | 1.46 | 1.46 | 1.44 | 1.43 | 1.42 | 1.41 | 1.40 | 1.39 |
| #43 | 36.89 | 36.96 | 37.04 | 37.11 | 37.18 | 37.25 | 37.33 | 37.40 | 37.47 | 37.55 | 37.62 | 37.69 |
| — | 1.37 | 1.36 | 1.35 | 1.34 | 1.32 | 1.31 | 1.30 | 1.28 | 1.27 | 1.25 | 1.24 | 1.22 |
| #44 | 37.77 | 37.84 | 37.91 | 37.99 | 38.06 | 38.13 | 38.21 | 38.28 | 38.35 | 38.43 | 38.50 | 38.57 |
| — | 1.21 | 1.20 | 1.18 | 1.17 | 1.16 | 1.14 | 1.13 | 1.12 | 1.10 | 1.00 | 1.08 | 1.07 |
| #45 | 38.65 | 38.72 | 38.79 | 38.87 | 38.94 | 39.01 | 39.08 | 39.16 | 39.23 | 39.30 | 39.38 | 39.45 |
| — | 1.06 | 1.04 | 1.03 | 1.02 | 1.01 | 1.00 | 0.99 | 0.99 | 0.98 | 0.97 | 0.96 | 0.95 |
| #46 | 39.52 | 39.60 | 39.67 | 39.74 | 39.82 | 39.89 | 39.96 | 40.04 | 40.11 | 40.18 | 40.26 | 40.33 |
| — | 0.95 | 0.94 | 0.93 | 0.93 | 0.92 | 0.92 | 0.91 | 0.91 | 0.90 | 0.90 | 0.90 | 0.89 |
| #47 | 40.40 | 40.48 | 40.55 | 40.62 | 40.70 | 40.77 | 40.84 | 40.91 | 40.99 | 41.06 | 41.13 | 41.21 |
| — | 0.89 | 0.89 | 0.88 | 0.88 | 0.88 | 0.88 | 0.88 | 0.88 | 0.88 | 0.88 | 0.88 | 0.88 |
| #48 | 41.28 | 41.35 | 41.43 | 41.50 | 41.57 | 41.65 | 41.72 | 41.79 | 41.87 | 41.94 | 42.01 | 42.09 |
| — | 0.88 | 0.88 | 0.88 | 0.88 | 0.88 | 0.88 | 0.88 | 0.88 | 0.89 | 0.89 | 0.89 | 0.89 |
| #49 | 42.16 | 42.23 | 42.31 | 42.38 | 42.45 | 42.52 | 42.60 | 42.67 | 42.74 | 42.82 | 42.89 | 42.96 |
| — | 0.89 | 0.90 | 0.90 | 0.90 | 0.90 | 0.90 | 0.91 | 0.91 | 0.91 | 0.91 | 0.92 | 0.92 |
| #50 | 43.04 | 43.11 | 43.18 | 43.26 | 43.33 | 43.40 | 43.48 | 43.55 | 43.62 | 43.70 | 43.77 | 43.84 |
| — | 0.92 | 0.92 | 0.93 | 0.93 | 0.93 | 0.93 | 0.93 | 0.94 | 0.94 | 0.94 | 0.94 | 0.94 |
| #51 | 43.92 | | | | | | | | | | | |
| — | 0.95 | | | | | | | | | | | |

Figure 15:
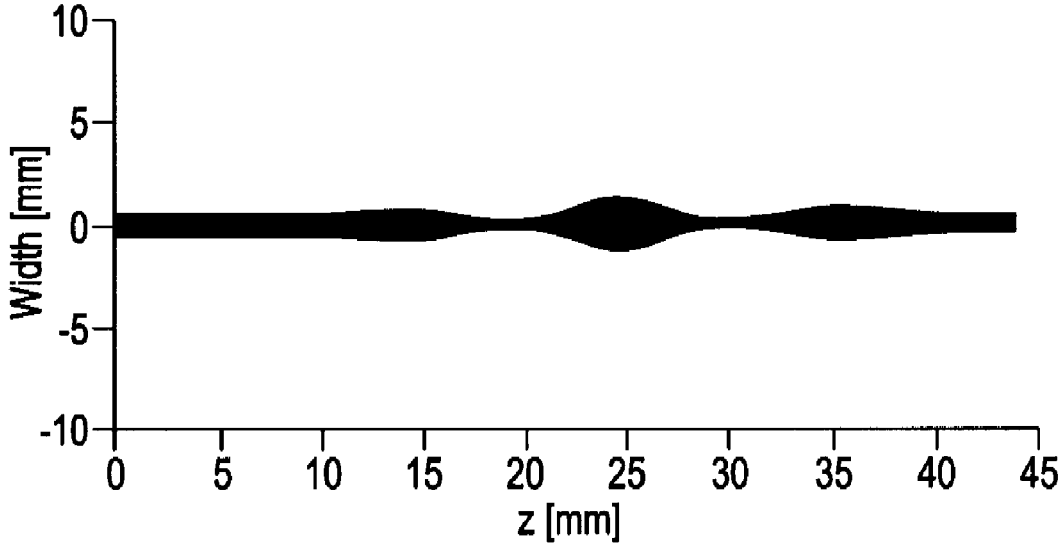
FIG. 15 is a graph showing the shape of the center conductor in the reflection-type bandpass filter manufactured in Embodiment 3.

FIG. 15 shows the shape of the center conductor 6 in the reflection-type bandpass filter 1 of Embodiment 3. In the figure, the dark portion represents the center conductor 6. A non-reflecting terminator, or an R=50Ω resistance, is provided on the terminating side (the face at z=43.92 mm) of this reflection-type bandpass filter 1. The thicknesses of the conducting layers 4, 5 and of the center conductor 6 may be thick compared with the skin depth at f=1 GHz. For example, when using copper, the thickness of the conducting layers 4, 5 and of the center conductor 6 may be 2.1 μm or greater. This bandpass filter is used in a system with a characteristic impedance of 50Ω.

Figure 16:
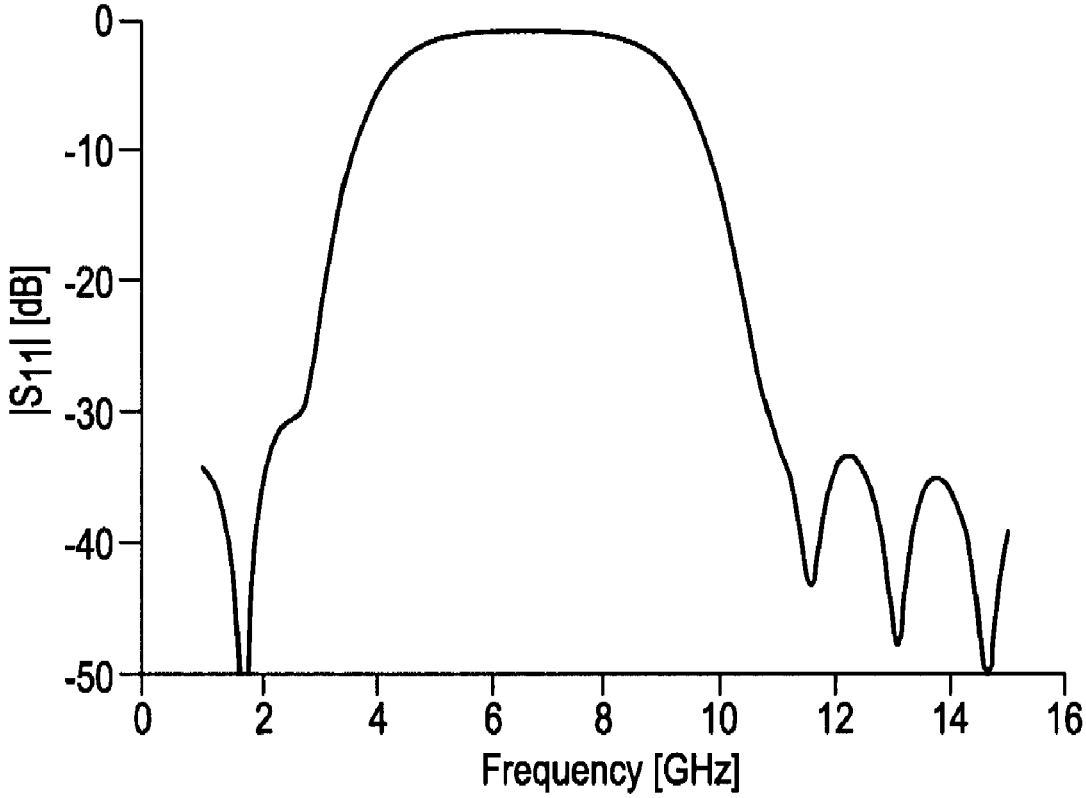
FIG. 16 is a graph showing the reflected-wave amplitude characteristic in the reflection-type bandpass filter manufactured in Embodiment 3.
Figure 17:
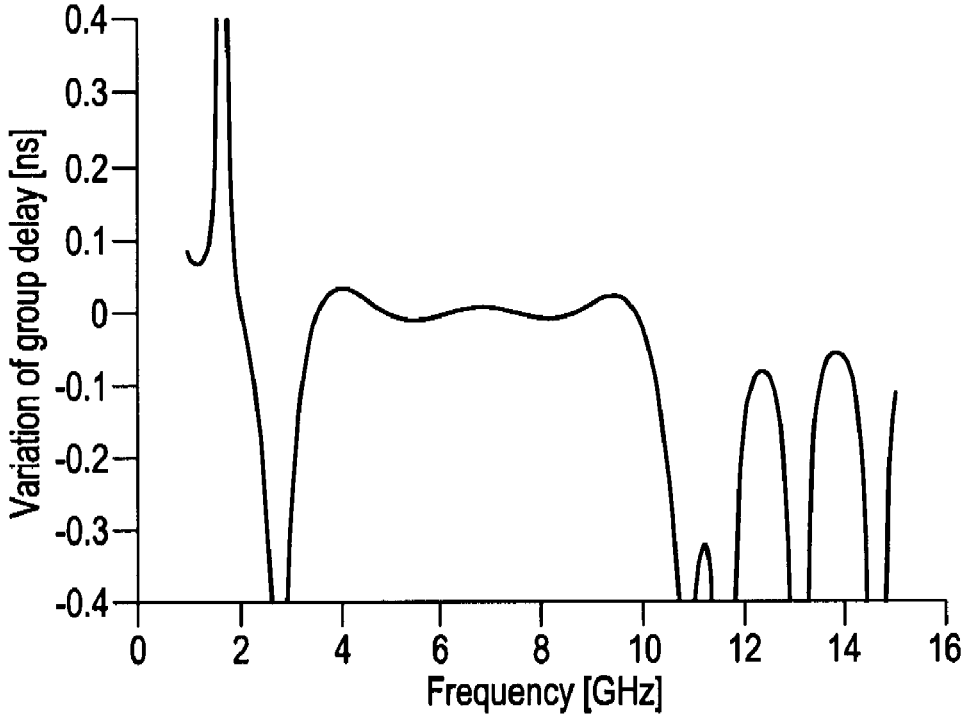
FIG. 17 is a graph showing the reflected-wave group delay characteristic in the reflection-type bandpass filter manufactured in Embodiment 3.

FIG. 16 and FIG. 17 show the amplitude characteristic and group delay characteristic respectively of reflected waves ($S_{11}$) in the bandpass filter of Embodiment 3. As shown in the figures, in the range of frequencies f for which 4.4 GHz≦f≦9.2 GHz, the reflectance is −5 dB or greater, and the group delay variation is within ±0.05 ns. In the region f<3.1 GHz or f>10.6 GHz, the reflectance is −20 dB or lower.

Embodiment 4

Figure 18:
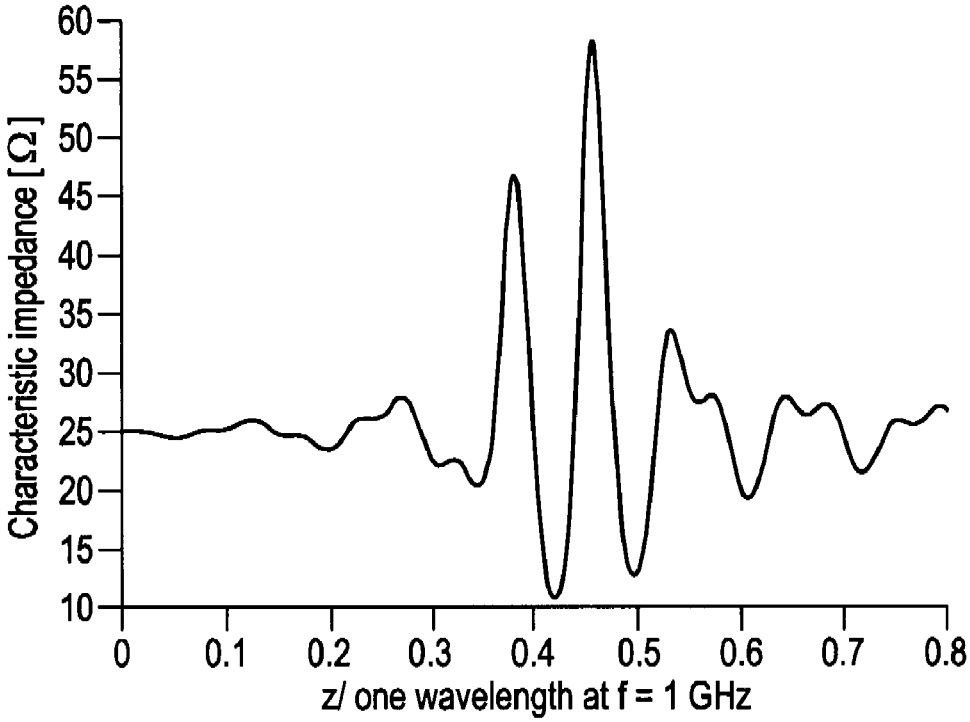
FIG. 18 is a graph showing the characteristic impedance distribution of the reflection-type bandpass filter manufactured in Embodiment 4.

A Kaiser window was used for which the reflectance is 1 at frequencies f in the range 3.6 GHz≦f≦10.0 GHz, and is 0 elsewhere, and for which A=35. Design was performed using 0.8 times the wavelength of signals at frequency f=1 GHz propagating in the microstrip as the waveguide length, and setting the system characteristic impedance to 25Ω. FIG. 18 shows the distribution in the z-axis direction of the local characteristic impedance obtained in the inverse problem.

Figure 19:
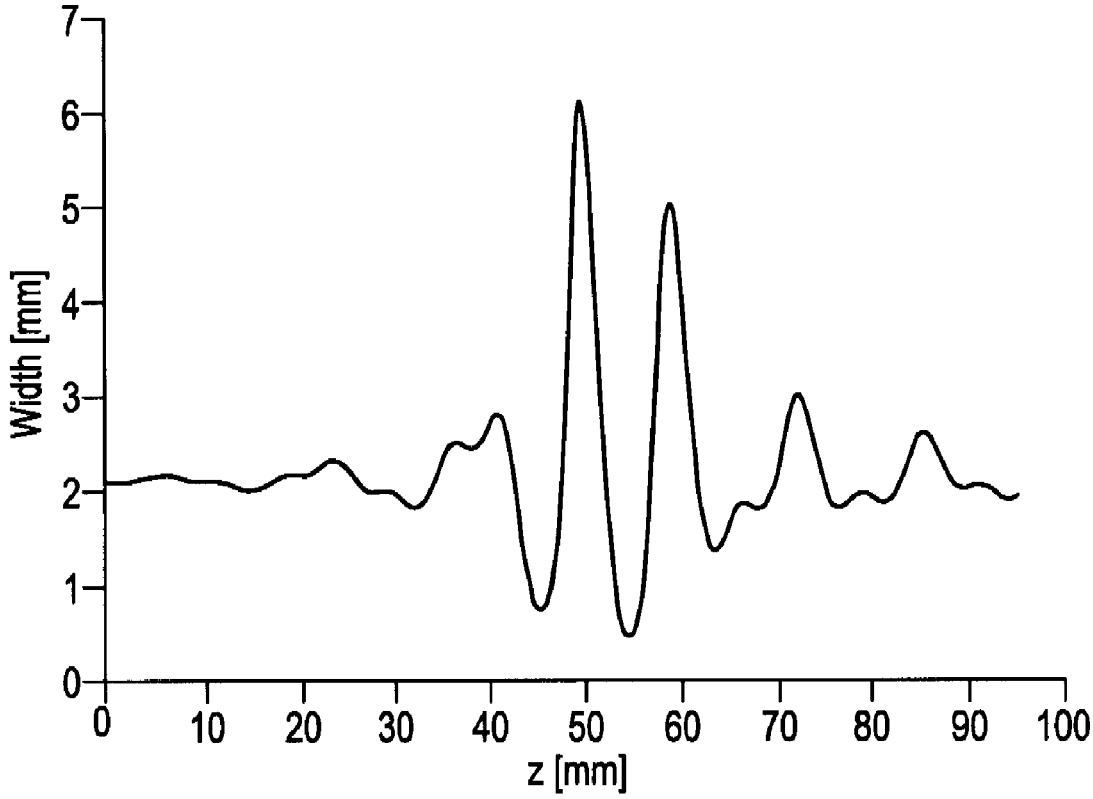
FIG. 19 is a graph showing the center conductor width distribution in the reflection-type bandpass filter manufactured in Embodiment 4.

FIG. 19 shows the z-axis distribution of the center conductor width w, when using a dielectric layer 3 of thickness h=2 mm and with relative permittivity $\in_r$=6.35. Tables 9 through 11 list the center conductor widths w.

TABLE 9

| Center conductor widths (1/3) | | | | | | | | | | | | |
|---|---|---|---|---|---|---|---|---|---|---|---|---|
| | z[mm] | | | | | | | | | | | |
| | 0.00 | 0.10 | 0.19 | 0.29 | 0.38 | 0.48 | 0.57 | 0.67 | 0.76 | 0.86 | 0.95 | 1.05 |
| | w[mm] | | | | | | | | | | | |
| | 2.11 | 2.11 | 2.11 | 2.11 | 2.11 | 2.11 | 2.11 | 2.11 | 2.11 | 2.11 | 2.11 | 2.11 |
| #2 | 1.14 | 1.24 | 1.33 | 1.43 | 1.52 | 1.62 | 1.71 | 1.81 | 1.90 | 2.00 | 2.10 | 2.19 |
| — | 2.11 | 2.11 | 2.11 | 2.11 | 2.11 | 2.11 | 2.11 | 2.11 | 2.11 | 2.11 | 2.11 | 2.11 |
| #3 | 2.29 | 2.38 | 2.48 | 2.57 | 2.67 | 2.76 | 2.86 | 2.95 | 3.05 | 3.14 | 3.24 | 3.33 |
| — | 2.11 | 2.11 | 2.11 | 2.12 | 2.12 | 2.12 | 2.12 | 2.12 | 2.12 | 2.12 | 2.12 | 2.12 |
| #4 | 3.43 | 3.52 | 3.62 | 3.71 | 3.81 | 3.90 | 4.00 | 4.10 | 4.19 | 4.29 | 4.38 | 4.48 |
| — | 2.13 | 2.13 | 2.13 | 2.13 | 2.13 | 2.14 | 2.14 | 2.14 | 2.14 | 2.15 | 2.15 | 2.15 |
| #5 | 4.57 | 4.67 | 4.76 | 4.86 | 4.95 | 5.05 | 5.14 | 5.24 | 5.33 | 5.43 | 5.52 | 5.62 |
| — | 2.15 | 2.15 | 2.16 | 2.16 | 2.16 | 2.16 | 2.16 | 2.17 | 2.17 | 2.17 | 2.17 | 2.17 |
| #6 | 5.71 | 5.81 | 5.90 | 6.00 | 6.10 | 6.19 | 6.29 | 6.38 | 6.48 | 6.57 | 6.67 | 6.76 |
| — | 2.17 | 2.17 | 2.17 | 2.17 | 2.17 | 2.17 | 2.17 | 2.17 | 2.17 | 2.17 | 2.17 | 2.17 |
| #7 | 6.86 | 6.96 | 7.05 | 7.14 | 7.24 | 7.33 | 7.43 | 7.52 | 7.62 | 7.71 | 7.81 | 7.91 |
| — | 2.16 | 2.16 | 2.16 | 2.16 | 2.16 | 2.15 | 2.15 | 2.15 | 2.15 | 2.14 | 2.14 | 2.14 |
| #8 | 8.00 | 8.10 | 8.19 | 8.29 | 8.38 | 8.48 | 8.57 | 8.67 | 8.76 | 8.86 | 8.95 | 9.05 |
| — | 2.13 | 2.13 | 2.13 | 2.13 | 2.12 | 2.12 | 2.12 | 2.12 | 2.12 | 2.11 | 2.11 | 2.11 |
| #9 | 9.14 | 9.24 | 9.33 | 9.43 | 9.52 | 9.62 | 9.71 | 9.81 | 9.91 | 10.00 | 10.10 | 10.19 |
| — | 2.11 | 2.11 | 2.11 | 2.11 | 2.10 | 2.10 | 2.10 | 2.10 | 2.10 | 2.10 | 2.10 | 2.10 |
| #10 | 10.29 | 10.38 | 10.48 | 10.57 | 10.67 | 10.76 | 10.85 | 10.95 | 11.05 | 11.14 | 11.24 | 11.33 |
| — | 2.10 | 2.10 | 2.10 | 2.10 | 2.10 | 2.10 | 2.10 | 2.10 | 2.10 | 2.10 | 2.10 | 2.10 |
| #11 | 11.43 | 11.52 | 11.62 | 11.71 | 11.81 | 11.91 | 12.00 | 12.10 | 12.19 | 12.29 | 12.38 | 12.48 |
| — | 2.10 | 2.10 | 2.10 | 2.09 | 2.09 | 2.09 | 2.09 | 2.09 | 2.08 | 2.08 | 2.08 | 2.07 |
| #12 | 12.57 | 12.67 | 12.76 | 12.85 | 12.95 | 13.05 | 13.14 | 13.24 | 13.33 | 13.43 | 13.52 | 13.62 |
| — | 2.07 | 2.07 | 2.06 | 2.06 | 2.06 | 2.05 | 2.05 | 2.04 | 2.04 | 2.04 | 2.03 | 2.03 |
| #13 | 13.71 | 13.81 | 13.91 | 14.00 | 14.10 | 14.19 | 14.29 | 14.38 | 14.48 | 14.57 | 14.67 | 14.76 |
| — | 2.02 | 2.02 | 2.02 | 2.02 | 2.01 | 2.01 | 2.01 | 2.01 | 2.00 | 2.00 | 2.00 | 2.00 |
| #14 | 14.86 | 14.95 | 15.05 | 15.14 | 15.24 | 15.33 | 15.43 | 15.52 | 15.62 | 15.71 | 15.81 | 15.91 |
| — | 2.00 | 2.00 | 2.00 | 2.01 | 2.01 | 2.01 | 2.01 | 2.02 | 2.02 | 2.02 | 2.03 | 2.03 |
| #15 | 16.00 | 16.10 | 16.19 | 16.29 | 16.38 | 16.48 | 16.57 | 16.67 | 16.76 | 16.86 | 16.95 | 17.05 |
| — | 2.04 | 2.04 | 2.05 | 2.05 | 2.06 | 2.06 | 2.07 | 2.07 | 2.08 | 2.09 | 2.09 | 2.10 |
| #16 | 17.14 | 17.24 | 17.33 | 17.43 | 17.52 | 17.62 | 17.71 | 17.81 | 17.91 | 18.00 | 18.10 | 18.19 |
| — | 2.10 | 2.11 | 2.11 | 2.12 | 2.12 | 2.13 | 2.13 | 2.14 | 2.14 | 2.14 | 2.15 | 2.15 |
| #17 | 18.29 | 18.38 | 18.48 | 18.57 | 18.67 | 18.76 | 18.86 | 18.95 | 19.05 | 19.14 | 19.24 | 19.33 |
| — | 2.15 | 2.15 | 2.15 | 2.16 | 2.16 | 2.16 | 2.16 | 2.16 | 2.16 | 2.16 | 2.16 | 2.16 |
| #18 | 19.43 | 19.52 | 19.62 | 19.71 | 19.81 | 19.91 | 20.00 | 20.10 | 20.19 | 20.29 | 20.38 | 20.48 |
| — | 2.16 | 2.16 | 2.16 | 2.16 | 2.16 | 2.16 | 2.16 | 2.16 | 2.16 | 2.16 | 2.16 | 2.17 |
| #19 | 20.57 | 20.67 | 20.76 | 20.86 | 20.95 | 21.05 | 21.14 | 21.24 | 21.33 | 21.43 | 21.52 | 21.62 |
| — | 2.17 | 2.17 | 2.17 | 2.18 | 2.18 | 2.18 | 2.19 | 2.19 | 2.20 | 2.20 | 2.21 | 2.21 |
| #20 | 21.71 | 21.81 | 21.91 | 22.00 | 22.10 | 22.19 | 22.29 | 22.38 | 22.48 | 22.57 | 22.67 | 22.76 |
| — | 2.22 | 2.23 | 2.23 | 2.24 | 2.25 | 2.25 | 2.26 | 2.27 | 2.27 | 2.28 | 2.28 | 2.29 |
| #21 | 22.86 | 22.95 | 23.05 | 23.14 | 23.24 | 23.33 | 23.43 | 23.52 | 23.62 | 23.72 | 23.81 | 23.91 |
| — | 2.29 | 2.30 | 2.30 | 2.30 | 2.31 | 2.31 | 2.31 | 2.31 | 2.31 | 2.31 | 2.31 | 2.31 |
| #22 | 24.00 | 24.10 | 24.19 | 24.29 | 24.38 | 24.48 | 24.57 | 24.67 | 24.76 | 24.86 | 24.96 | 25.05 |
| — | 2.30 | 2.30 | 2.29 | 2.29 | 2.28 | 2.27 | 2.26 | 2.25 | 2.24 | 2.23 | 2.22 | 2.21 |
| #23 | 25.14 | 25.24 | 25.33 | 25.43 | 25.52 | 25.62 | 25.72 | 25.81 | 25.91 | 26.00 | 26.10 | 26.19 |
| — | 2.20 | 2.19 | 2.18 | 2.17 | 2.16 | 2.14 | 2.13 | 2.12 | 2.11 | 2.10 | 2.09 | 2.08 |
| #24 | 26.29 | 26.38 | 26.48 | 26.57 | 26.67 | 26.76 | 26.86 | 26.95 | 27.05 | 27.14 | 27.24 | 27.33 |
| — | 2.07 | 2.06 | 2.05 | 2.04 | 2.03 | 2.02 | 2.02 | 2.01 | 2.01 | 2.00 | 2.00 | 1.99 |
| #25 | 27.43 | 27.52 | 27.62 | 27.72 | 27.81 | 27.91 | 28.00 | 28.10 | 28.19 | 28.29 | 28.38 | 28.48 |
| — | 1.99 | 1.99 | 1.99 | 1.99 | 1.99 | 1.99 | 1.99 | 1.99 | 1.99 | 1.99 | 1.99 | 1.99 |
| #26 | 28.57 | 28.67 | 28.76 | 28.86 | 28.95 | 29.05 | 29.14 | 29.24 | 29.33 | 29.43 | 29.52 | 29.62 |
| — | 1.99 | 1.99 | 1.99 | 1.99 | 1.99 | 1.99 | 1.99 | 1.99 | 1.99 | 1.99 | 1.99 | 1.98 |
| #27 | 29.72 | 29.81 | 29.91 | 30.00 | 30.10 | 30.19 | 30.29 | 30.38 | 30.49 | 30.57 | 30.67 | 30.76 |
| — | 1.98 | 1.98 | 1.97 | 1.97 | 1.96 | 1.96 | 1.95 | 1.94 | 1.93 | 1.93 | 1.92 | 1.91 |
| #28 | 30.86 | 30.95 | 31.05 | 31.14 | 31.24 | 31.33 | 31.43 | 31.52 | 31.62 | 31.72 | 31.81 | 31.91 |
| — | 1.90 | 1.89 | 1.88 | 1.87 | 1.87 | 1.86 | 1.85 | 1.84 | 1.84 | 1.83 | 1.82 | 1.82 |
| #29 | 32.00 | 32.10 | 32.19 | 32.29 | 32.38 | 32.48 | 32.57 | 32.67 | 32.76 | 32.86 | 32.95 | 33.05 |
| — | 1.82 | 1.81 | 1.81 | 1.81 | 1.81 | 1.81 | 1.82 | 1.82 | 1.83 | 1.83 | 1.84 | 1.85 |
| #30 | 33.14 | 33.24 | 33.33 | 33.43 | 33.52 | 33.62 | 33.72 | 33.81 | 33.91 | 34.00 | 34.10 | 34.10 |
| — | 1.86 | 1.87 | 1.89 | 1.90 | 1.92 | 1.94 | 1.95 | 1.97 | 1.98 | 2.02 | 2.04 | 2.06 |

TABLE 10

| Center conductor widths (2/3) | | | | | | | | | | | | |
|---|---|---|---|---|---|---|---|---|---|---|---|---|
| #31 | 34.29 | 34.38 | 34.45 | 34.57 | 34.67 | 34.76 | 34.86 | 34.95 | 35.05 | 35.14 | 35.24 | 35.33 |
| — | 2.09 | 2.11 | 2.14 | 2.16 | 2.18 | 2.21 | 2.23 | 2.26 | 2.28 | 2.30 | 2.33 | 2.35 |
| #32 | 35.43 | 35.52 | 35.62 | 35.72 | 35.81 | 35.91 | 36.00 | 36.10 | 36.19 | 36.29 | 36.38 | 36.48 |
| — | 2.37 | 2.39 | 2.40 | 2.42 | 2.44 | 2.45 | 2.46 | 2.47 | 2.48 | 2.49 | 2.49 | 2.49 |

TABLE 10-continued

| Center conductor widths (2/3) | | | | | | | | | | | | |
|---|---|---|---|---|---|---|---|---|---|---|---|---|
| #33 | 36.57 | 36.67 | 36.76 | 36.86 | 36.95 | 37.05 | 37.14 | 37.24 | 37.33 | 37.43 | 37.52 | 37.62 |
| — | 2.50 | 2.50 | 2.50 | 2.50 | 2.49 | 2.49 | 2.49 | 2.48 | 2.47 | 2.47 | 2.46 | 2.46 |
| #34 | 37.72 | 37.81 | 37.91 | 38.00 | 38.10 | 38.19 | 38.29 | 38.38 | 38.48 | 38.57 | 38.67 | 38.76 |
| — | 2.45 | 2.45 | 2.44 | 2.44 | 2.43 | 2.43 | 2.43 | 2.43 | 2.43 | 2.44 | 2.44 | 2.45 |
| #35 | 38.86 | 38.95 | 39.05 | 39.14 | 39.24 | 39.33 | 39.43 | 39.53 | 39.62 | 39.72 | 39.91 | 39.91 |
| — | 2.45 | 2.45 | 2.47 | 2.48 | 2.50 | 2.51 | 2.53 | 2.55 | 2.56 | 2.58 | 2.60 | 2.62 |
| #36 | 40.00 | 40.10 | 40.19 | 40.29 | 40.38 | 40.48 | 40.57 | 40.67 | 40.76 | 40.86 | 40.95 | 41.05 |
| — | 2.64 | 2.66 | 2.68 | 2.70 | 2.72 | 2.74 | 2.75 | 2.77 | 2.78 | 2.79 | 2.79 | 2.79 |
| #37 | 41.14 | 41.24 | 41.33 | 41.43 | 41.53 | 41.62 | 41.72 | 41.81 | 41.91 | 42.00 | 42.10 | 42.19 |
| — | 2.79 | 2.79 | 2.78 | 2.76 | 2.74 | 2.72 | 2.69 | 2.66 | 2.62 | 2.58 | 2.53 | 2.48 |
| #38 | 42.29 | 42.38 | 42.48 | 42.57 | 42.67 | 42.76 | 42.86 | 42.95 | 43.05 | 43.14 | 43.24 | 43.33 |
| — | 2.43 | 2.37 | 2.31 | 2.24 | 2.18 | 2.11 | 2.04 | 1.96 | 1.89 | 1.82 | 1.74 | 1.67 |
| #39 | 43.43 | 43.53 | 43.62 | 43.72 | 43.81 | 43.91 | 44.00 | 44.10 | 44.19 | 44.29 | 44.38 | 44.48 |
| — | 1.60 | 1.53 | 1.40 | 1.39 | 1.33 | 1.26 | 1.21 | 1.16 | 1.10 | 1.05 | 1.00 | 0.96 |
| #40 | 44.57 | 44.67 | 44.76 | 44.86 | 44.95 | 45.05 | 45.14 | 45.24 | 45.33 | 45.43 | 45.53 | 45.62 |
| — | 0.92 | 0.88 | 0.85 | 0.82 | 0.80 | 0.78 | 0.76 | 0.75 | 0.74 | 0.74 | 0.74 | 0.74 |
| #41 | 45.72 | 45.81 | 45.91 | 46.00 | 46.10 | 46.19 | 46.29 | 46.38 | 46.48 | 46.57 | 46.67 | 46.76 |
| — | 0.75 | 0.75 | 0.78 | 0.80 | 0.83 | 0.86 | 0.89 | 0.94 | 0.99 | 1.04 | 1.10 | 1.17 |
| #42 | 46.86 | 46.95 | 47.05 | 47.14 | 47.24 | 47.33 | 47.43 | 47.53 | 47.62 | 47.72 | 47.81 | 47.91 |
| — | 1.26 | 1.33 | 1.42 | 1.52 | 1.62 | 1.74 | 1.86 | 1.99 | 2.13 | 2.28 | 2.43 | 2.60 |
| #43 | 48.00 | 48.10 | 48.19 | 48.29 | 48.38 | 48.48 | 48.57 | 48.67 | 48.76 | 48.86 | 48.95 | 49.05 |
| — | 2.77 | 2.95 | 3.14 | 3.33 | 3.53 | 3.73 | 3.94 | 4.41 | 4.35 | 4.55 | 4.75 | 4.94 |
| #44 | 49.14 | 49.24 | 49.33 | 49.43 | 49.53 | 49.62 | 49.72 | 49.81 | 49.91 | 50.00 | 50.10 | 50.19 |
| — | 5.13 | 5.30 | 5.46 | 5.61 | 5.74 | 5.84 | 5.93 | 6.00 | 6.04 | 6.05 | 6.04 | 6.01 |
| #45 | 50.29 | 50.38 | 50.48 | 50.57 | 50.67 | 50.76 | 50.86 | 50.95 | 51.05 | 51.14 | 51.24 | 51.33 |
| — | 5.95 | 5.87 | 5.76 | 5.64 | 5.49 | 5.33 | 5.15 | 4.95 | 4.76 | 4.55 | 4.34 | 4.12 |
| #46 | 51.43 | 51.53 | 51.62 | 51.72 | 51.81 | 51.91 | 52.00 | 52.10 | 52.19 | 52.29 | 52.38 | 52.48 |
| — | 3.90 | 3.69 | 3.47 | 3.26 | 3.05 | 2.85 | 2.66 | 2.47 | 2.29 | 2.13 | 1.97 | 1.81 |
| #47 | 52.57 | 52.67 | 52.76 | 52.86 | 52.95 | 53.05 | 53.14 | 53.24 | 53.34 | 53.43 | 53.53 | 53.62 |
| — | 1.67 | 1.54 | 1.42 | 1.30 | 1.20 | 1.10 | 1.01 | 0.93 | 0.85 | 0.79 | 0.73 | 0.68 |
| #48 | 53.72 | 53.81 | 53.91 | 54.00 | 54.10 | 54.19 | 54.29 | 54.38 | 54.48 | 54.57 | 54.67 | 54.76 |
| — | 0.63 | 0.59 | 0.55 | 0.52 | 0.50 | 0.48 | 0.46 | 0.45 | 0.45 | 0.44 | 0.45 | 0.45 |
| #49 | 54.86 | 54.95 | 55.05 | 55.14 | 55.24 | 55.34 | 55.43 | 55.53 | 55.62 | 55.72 | 55.83 | 55.91 |
| — | 0.46 | 0.48 | 0.49 | 0.52 | 0.54 | 0.58 | 0.62 | 0.66 | 0.71 | 0.76 | 0.83 | 0.89 |
| #50 | 56.00 | 56.10 | 56.19 | 56.29 | 56.38 | 56.48 | 56.57 | 56.67 | 56.76 | 56.86 | 56.95 | 57.05 |
| — | 0.97 | 1.05 | 1.14 | 1.24 | 1.34 | 1.45 | 1.57 | 1.69 | 1.83 | 1.96 | 2.11 | 2.26 |
| #51 | 57.14 | 57.24 | 57.34 | 57.43 | 57.53 | 57.62 | 57.72 | 57.81 | 57.91 | 58.00 | 58.10 | 58.19 |
| — | 2.42 | 2.58 | 2.75 | 2.92 | 3.09 | 3.26 | 3.43 | 3.60 | 3.77 | 3.93 | 4.09 | 4.24 |
| #52 | 58.29 | 58.38 | 58.48 | 58.57 | 58.67 | 58.76 | 58.86 | 58.95 | 59.05 | 59.14 | 59.24 | 59.34 |
| — | 4.38 | 4.51 | 4.62 | 4.73 | 4.81 | 4.89 | 4.94 | 4.98 | 5.00 | 5.00 | 4.98 | 4.95 |
| #53 | 59.43 | 59.53 | 59.62 | 59.72 | 59.81 | 59.91 | 60.00 | 60.10 | 60.19 | 60.29 | 60.38 | 60.48 |
| — | 4.90 | 4.84 | 4.76 | 4.67 | 4.57 | 4.46 | 4.34 | 4.21 | 4.08 | 3.95 | 3.81 | 3.67 |
| #54 | 60.57 | 60.67 | 60.76 | 60.86 | 60.95 | 61.05 | 61.14 | 61.24 | 61.34 | 61.43 | 61.53 | 61.62 |
| — | 3.52 | 3.38 | 3.25 | 3.11 | 2.98 | 2.85 | 2.72 | 2.60 | 2.49 | 2.38 | 2.28 | 2.18 |
| #55 | 61.72 | 61.81 | 61.91 | 62.00 | 62.10 | 62.19 | 62.29 | 62.38 | 62.48 | 62.57 | 62.67 | 62.76 |
| — | 2.09 | 2.01 | 1.93 | 1.85 | 1.76 | 1.72 | 1.66 | 1.61 | 1.57 | 1.53 | 1.49 | 1.46 |
| #56 | 62.86 | 62.95 | 63.05 | 63.14 | 63.24 | 63.34 | 63.43 | 63.53 | 63.62 | 63.72 | 63.81 | 63.91 |
| — | 1.43 | 1.41 | 1.39 | 1.37 | 1.36 | 1.35 | 1.35 | 1.35 | 1.35 | 1.36 | 1.36 | 1.37 |
| #57 | 64.00 | 64.10 | 64.19 | 64.29 | 64.38 | 64.48 | 64.57 | 64.67 | 64.76 | 64.86 | 64.95 | 65.05 |
| — | 1.39 | 1.40 | 1.42 | 1.44 | 1.46 | 1.48 | 1.50 | 1.52 | 1.55 | 1.57 | 1.59 | 1.62 |
| #58 | 65.14 | 65.24 | 65.34 | 65.43 | 65.53 | 65.62 | 65.72 | 65.81 | 65.91 | 66.00 | 66.10 | 66.19 |
| — | 1.64 | 1.67 | 1.69 | 1.71 | 1.73 | 1.75 | 1.76 | 1.78 | 1.79 | 1.81 | 1.82 | 1.83 |
| #59 | 66.20 | 66.38 | 66.48 | 66.57 | 66.67 | 66.76 | 66.86 | 66.95 | 67.05 | 67.14 | 67.24 | 67.34 |
| — | 1.83 | 1.84 | 1.84 | 1.84 | 1.85 | 1.84 | 1.84 | 1.84 | 1.84 | 1.83 | 1.83 | 1.82 |
| #60 | 67.43 | 67.53 | 67.62 | 67.72 | 67.81 | 67.91 | 68.00 | 68.10 | 68.19 | 68.29 | 68.38 | 68.48 |
| — | 1.81 | 1.81 | 1.80 | 1.80 | 1.79 | 1.79 | 1.79 | 1.79 | 1.79 | 1.79 | 1.79 | 1.80 |

TABLE 11

| Center conductor widths (3/3) | | | | | | | | | | | | |
|---|---|---|---|---|---|---|---|---|---|---|---|---|
| #61 | 68.57 | 68.67 | 68.76 | 68.86 | 68.95 | 69.05 | 69.15 | 69.24 | 69.34 | 69.43 | 69.53 | 69.62 |
| — | 1.80 | 1.81 | 1.82 | 1.84 | 1.85 | 1.87 | 1.89 | 1.91 | 1.93 | 1.96 | 1.99 | 2.02 |
| #62 | 69.72 | 69.81 | 69.91 | 70.00 | 70.10 | 70.19 | 70.29 | 70.38 | 70.48 | 70.57 | 70.67 | 70.76 |
| — | 2.05 | 2.09 | 2.12 | 2.16 | 2.20 | 2.24 | 2.28 | 2.33 | 2.37 | 2.41 | 2.46 | 2.50 |
| #63 | 70.86 | 70.95 | 71.05 | 71.15 | 71.24 | 71.34 | 71.43 | 71.53 | 71.62 | 71.72 | 71.81 | 71.91 |
| — | 2.55 | 2.59 | 2.64 | 2.68 | 2.72 | 2.76 | 2.79 | 2.83 | 2.86 | 2.89 | 2.91 | 2.93 |
| #64 | 72.00 | 72.10 | 72.19 | 72.29 | 72.38 | 72.48 | 72.57 | 72.67 | 72.76 | 72.86 | 72.95 | 73.05 |
| — | 2.95 | 2.96 | 2.97 | 2.98 | 2.98 | 2.97 | 2.97 | 2.96 | 2.94 | 2.92 | 2.90 | 2.88 |
| #65 | 73.15 | 73.24 | 73.34 | 73.43 | 73.53 | 73.62 | 73.72 | 73.81 | 73.91 | 74.00 | 74.10 | 74.19 |
| — | 2.85 | 2.81 | 2.78 | 2.74 | 2.71 | 2.67 | 2.62 | 2.58 | 2.54 | 2.49 | 2.45 | 2.41 |
| #66 | 74.29 | 74.38 | 74.48 | 74.57 | 74.67 | 74.76 | 74.86 | 74.96 | 75.05 | 75.15 | 75.24 | 75.34 |
| — | 2.36 | 2.32 | 2.28 | 2.24 | 2.20 | 2.16 | 2.12 | 2.09 | 2.06 | 2.03 | 2.00 | 1.97 |

TABLE 11-continued

| Center conductor widths (3/3) | | | | | | | | | | | | |
|---|---|---|---|---|---|---|---|---|---|---|---|---|
| #67 | 75.43 | 75.53 | 75.62 | 75.72 | 75.81 | 75.91 | 76.00 | 76.10 | 76.19 | 76.29 | 76.38 | 76.48 |
| — | 1.94 | 1.92 | 1.90 | 1.88 | 1.86 | 1.85 | 1.84 | 1.82 | 1.82 | 1.81 | 1.80 | 1.80 |
| #68 | 76.57 | 76.67 | 76.76 | 76.86 | 76.95 | 77.05 | 77.15 | 77.24 | 77.34 | 77.43 | 77.53 | 77.62 |
| — | 1.80 | 1.80 | 1.80 | 1.80 | 1.80 | 1.81 | 1.82 | 1.82 | 1.83 | 1.84 | 1.85 | 1.86 |
| #69 | 77.72 | 77.81 | 77.91 | 78.00 | 78.10 | 78.19 | 78.29 | 78.38 | 78.48 | 78.57 | 78.67 | 78.76 |
| — | 1.86 | 1.87 | 1.88 | 1.89 | 1.90 | 1.91 | 1.92 | 1.92 | 1.93 | 1.93 | 1.94 | 1.94 |
| #70 | 78.86 | 78.95 | 79.05 | 79.15 | 79.24 | 79.34 | 79.43 | 79.53 | 79.62 | 79.72 | 79.81 | 79.91 |
| — | 1.95 | 1.95 | 1.95 | 1.95 | 1.95 | 1.95 | 1.95 | 1.94 | 1.94 | 1.93 | 1.93 | 1.92 |
| #71 | 80.00 | 80.10 | 80.19 | 80.29 | 80.38 | 80.48 | 80.57 | 80.67 | 80.76 | 80.86 | 80.95 | 81.05 |
| — | 1.92 | 1.91 | 1.90 | 1.90 | 1.89 | 1.89 | 1.88 | 1.87 | 1.87 | 1.86 | 1.86 | 1.86 |
| #72 | 81.15 | 81.24 | 81.34 | 81.43 | 81.53 | 81.62 | 81.72 | 81.81 | 81.91 | 82.00 | 82.10 | 82.19 |
| — | 1.86 | 1.85 | 1.85 | 1.86 | 1.86 | 1.86 | 1.87 | 1.87 | 1.88 | 1.89 | 1.90 | 1.91 |
| #73 | 82.29 | 82.38 | 82.48 | 82.57 | 82.67 | 82.76 | 82.86 | 82.95 | 83.05 | 83.15 | 83.24 | 83.34 |
| — | 1.93 | 1.94 | 1.96 | 1.98 | 1.99 | 2.01 | 2.04 | 2.06 | 2.08 | 2.11 | 2.13 | 2.16 |
| #74 | 83.43 | 83.53 | 83.62 | 83.72 | 83.81 | 83.91 | 84.00 | 84.10 | 84.19 | 84.29 | 84.38 | 84.48 |
| — | 2.18 | 2.21 | 2.24 | 2.26 | 2.29 | 2.32 | 2.34 | 2.37 | 2.39 | 2.42 | 2.44 | 2.46 |
| #75 | 84.57 | 84.67 | 84.76 | 84.86 | 84.96 | 85.05 | 85.15 | 85.24 | 85.34 | 85.43 | 85.53 | 85.62 |
| — | 2.48 | 2.50 | 2.52 | 2.52 | 2.53 | 2.56 | 2.57 | 2.58 | 2.58 | 2.58 | 2.59 | 2.58 |
| #76 | 89.72 | 85.81 | 85.91 | 86.00 | 86.10 | 86.19 | 86.29 | 86.38 | 86.48 | 86.57 | 86.67 | 86.76 |
| — | 2.58 | 2.57 | 2.57 | 2.56 | 2.55 | 2.53 | 2.52 | 2.50 | 2.49 | 2.47 | 2.45 | 2.43 |
| #77 | 86.86 | 86.96 | 87.05 | 87.15 | 87.24 | 87.34 | 87.43 | 87.53 | 87.62 | 87.72 | 87.81 | 87.91 |
| — | 2.41 | 2.38 | 2.36 | 2.34 | 2.32 | 2.30 | 2.27 | 2.25 | 2.23 | 2.21 | 2.19 | 2.17 |
| #78 | 88.00 | 88.10 | 88.19 | 88.29 | 88.38 | 88.48 | 88.57 | 88.67 | 88.76 | 88.86 | 88.96 | 89.05 |
| — | 2.15 | 2.13 | 2.12 | 2.10 | 2.09 | 2.07 | 2.06 | 2.05 | 2.04 | 2.03 | 2.02 | 2.02 |
| #79 | 89.15 | 89.24 | 89.34 | 89.43 | 89.53 | 89.62 | 89.72 | 89.81 | 89.91 | 90.00 | 90.10 | 90.19 |
| — | 2.01 | 2.01 | 2.00 | 2.00 | 2.00 | 2.00 | 2.00 | 2.00 | 2.00 | 2.00 | 2.01 | 2.01 |
| #80 | 90.29 | 90.38 | 90.48 | 90.57 | 90.67 | 90.76 | 90.86 | 90.96 | 91.05 | 91.15 | 91.24 | 91.34 |
| — | 2.01 | 2.01 | 2.02 | 2.02 | 2.02 | 2.03 | 2.03 | 2.03 | 2.03 | 2.03 | 2.04 | 2.04 |
| #81 | 91.43 | 91.53 | 91.62 | 91.72 | 91.81 | 91.91 | 92.00 | 92.10 | 92.19 | 92.29 | 92.38 | 92.48 |
| — | 2.04 | 2.03 | 2.03 | 2.03 | 2.03 | 2.03 | 2.02 | 2.02 | 2.01 | 2.01 | 2.00 | 1.99 |
| #82 | 92.57 | 92.67 | 92.76 | 92.86 | 92.96 | 93.05 | 93.15 | 93.24 | 93.34 | 93.43 | 93.53 | 99.62 |
| — | 1.99 | 1.98 | 1.97 | 1.96 | 1.95 | 1.95 | 1.94 | 1.93 | 1.92 | 1.92 | 1.91 | 1.90 |
| #83 | 93.72 | 93.81 | 93.91 | 94.00 | 94.10 | 94.19 | 94.29 | 94.38 | 94.48 | 94.57 | 94.67 | 94.76 |
| — | 1.90 | 1.89 | 1.89 | 1.88 | 1.88 | 1.88 | 1.87 | 1.87 | 1.87 | 1.88 | 1.88 | 1.88 |
| #84 | 94.86 | 94.96 | 95.05 | 95.15 | 95.24 | | | | | | | |
| — | 1.89 | 1.89 | 1.90 | 1.91 | 1.91 | | | | | | | |

Figure 20:
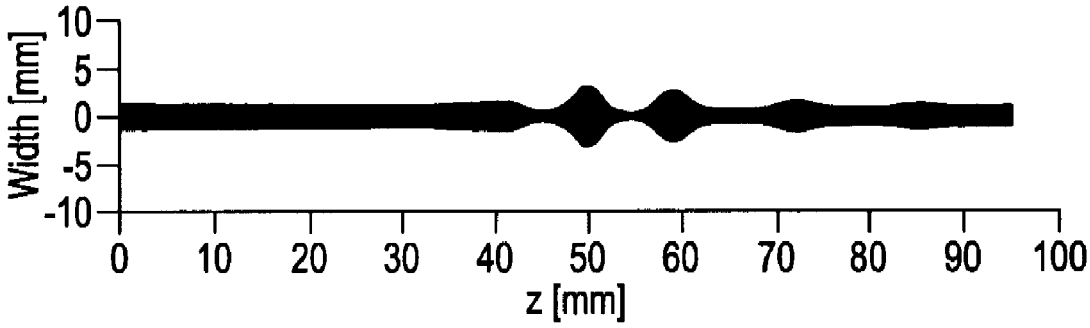
FIG. 20 is a graph showing the shape of the center conductor in the reflection-type bandpass filter manufactured in Embodiment 4.

FIG. 20 shows the shape of the center conductor 6 in the reflection-type bandpass filter 1 of Embodiment 4. In the figure, the dark portion represents the center conductor 6. A non-reflecting terminator, or an R=25Ω resistance, is provided on the terminating side (the face at z=95.24 mm) of this reflection-type bandpass filter 1. The thicknesses of the conducting layers 4, 5 and of the center conductor 6 may be thick compared with the skin depth at f=1 GHz. For example, when using copper, the thickness of the conducting layers 4, 5 and of the center conductor 6 may be 2.1 μm or greater. This bandpass filter is used in a system with a characteristic impedance of 50Ω.

Figure 21:
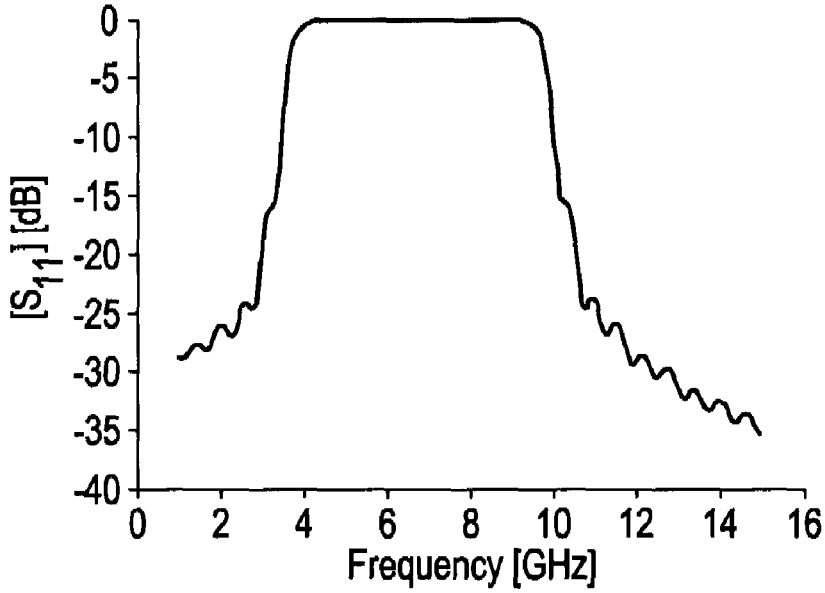
FIG. 21 is a graph showing the reflected-wave amplitude characteristic in the reflection-type bandpass filter manufactured in Embodiment 4.
Figure 22:
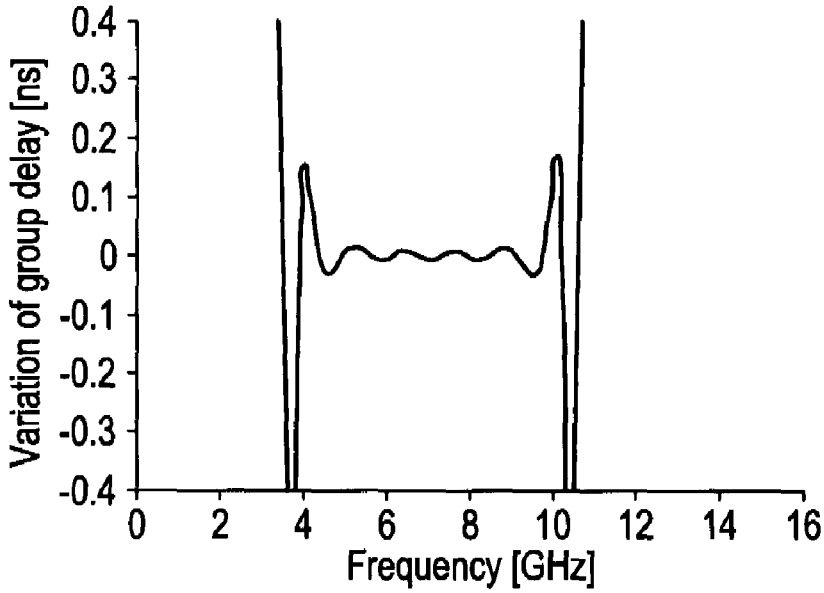
FIG. 22 is a graph showing the reflected-wave group delay characteristic in the reflection-type bandpass filter manufactured in Embodiment 4.

FIG. 21 and FIG. 22 show the amplitude characteristic and group delay characteristic respectively of reflected waves ($S_{11}$) in the bandpass filter of Embodiment 4. As shown in the figures, in the range of frequencies f for which 3.8 GHz≦f≦9.8 GHz, the reflectance is −3 dB or greater, and the group delay variation is within ±0.2 ns. In the region f<3.1 GHz or f>10.6 GHz, the reflectance is −17 dB or lower.

Embodiment 5

Figure 23:
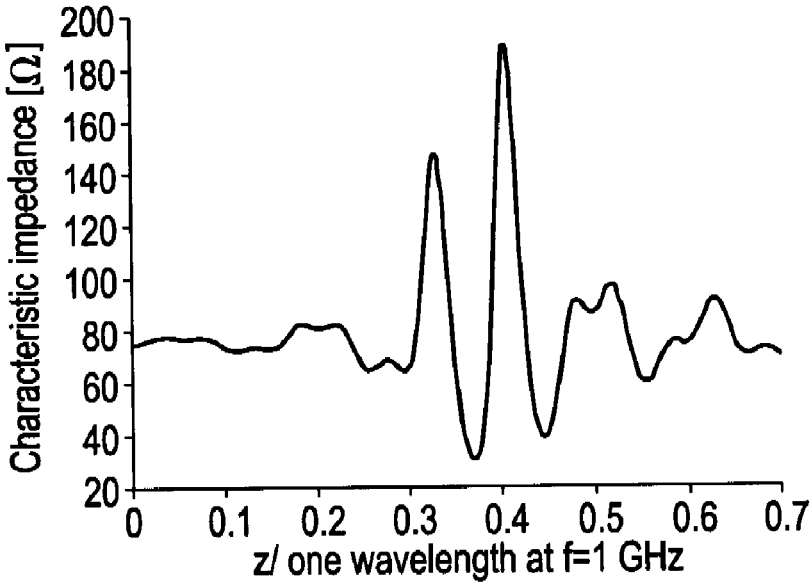
FIG. 23 is a graph showing the characteristic impedance distribution of the reflection-type bandpass filter manufactured in Embodiment 5.

A Kaiser window was used for which the reflectance is 1 at frequencies f in the range 3.4 GHz≦f≦10.3 GHz, and is 0 elsewhere, and for which A=30. Design was performed using 0.7 times the wavelength of signals at frequency f=1 GHz propagating in the microstrip as the waveguide length, and setting the system characteristic impedance to 75Ω. FIG. 23 shows the distribution in the z-axis direction of the local characteristic impedance obtained in the inverse problem.

Figure 24:
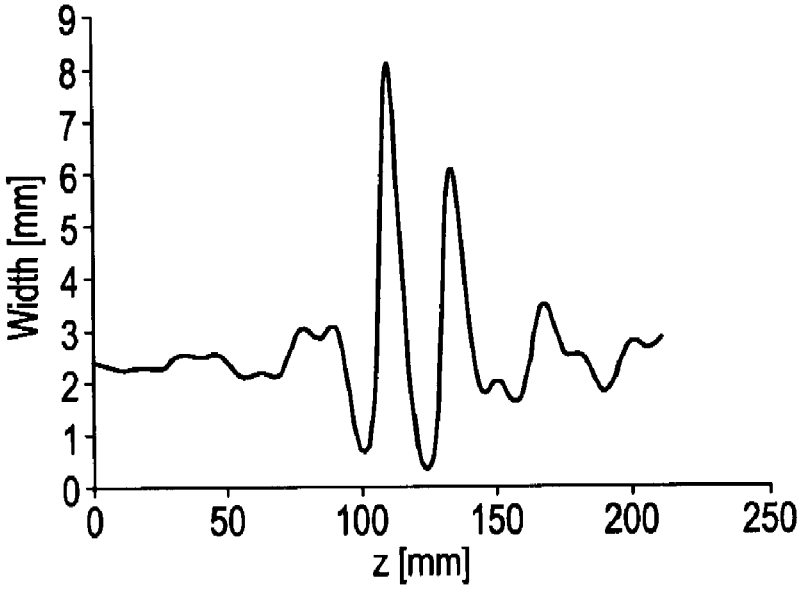
FIG. 24 is a graph showing the center conductor width distribution in the reflection-type bandpass filter manufactured in Embodiment 5.

FIG. 24 shows the z-axis distribution of the center conductor width w, when using a dielectric layer 3 of thickness h=3 mm and with relative permittivity $\epsilon_r$=1. Tables 12 through 14 list the center conductor widths w.

TABLE 12

| Center conductor widths (1/3) | | | | | | | | | | | | |
|---|---|---|---|---|---|---|---|---|---|---|---|---|
| | z[mm] | | | | | | | | | | | |
| | 0.00 | 0.21 | 0.42 | 0.63 | 0.84 | 1.05 | 1.26 | 1.47 | 1.68 | 1.89 | 2.10 | 2.31 |
| | w[mm] | | | | | | | | | | | |
| | 2.45 | 2.45 | 2.45 | 2.45 | 2.45 | 2.45 | 2.45 | 2.45 | 2.45 | 2.45 | 2.45 | 2.45 |
| #2 | 2.52 | 2.73 | 2.94 | 3.15 | 3.36 | 3.57 | 3.78 | 3.99 | 4.20 | 4.41 | 4.62 | 4.83 |
| — | 2.44 | 2.44 | 2.44 | 2.44 | 2.44 | 2.43 | 2.43 | 2.43 | 2.43 | 2.42 | 2.42 | 2.42 |

TABLE 12-continued

| Center conductor widths (1/3) | | | | | | | | | | | | |
|---|---|---|---|---|---|---|---|---|---|---|---|---|
| | z[mm] | | | | | | | | | | | |
| | 0.00 | 0.21 | 0.42 | 0.63 | 0.84 | 1.05 | 1.26 | 1.47 | 1.68 | 1.89 | 2.10 | 2.31 |
| | w[mm] | | | | | | | | | | | |
| | 2.45 | 2.45 | 2.45 | 2.45 | 2.45 | 2.45 | 2.45 | 2.45 | 2.45 | 2.45 | 2.45 | 2.45 |
| #3 | 5.04 | 5.25 | 5.46 | 5.67 | 5.88 | 6.09 | 6.30 | 6.61 | 6.72 | 6.93 | 7.14 | 7.35 |
| — | 2.41 | 2.41 | 2.40 | 2.40 | 2.40 | 2.39 | 2.39 | 2.38 | 2.38 | 2.37 | 2.37 | 2.36 |
| #4 | 7.56 | 7.77 | 7.98 | 8.19 | 8.40 | 8.61 | 8.82 | 9.03 | 9.24 | 9.45 | 9.66 | 9.87 |
| — | 2.36 | 2.35 | 2.35 | 2.35 | 2.34 | 2.34 | 2.33 | 2.33 | 2.33 | 2.32 | 2.32 | 2.32 |
| #5 | 10.08 | 10.29 | 10.50 | 10.71 | 10.92 | 11.13 | 11.34 | 11.55 | 11.76 | 11.97 | 12.18 | 12.39 |
| — | 2.32 | 2.31 | 2.31 | 2.31 | 2.31 | 2.31 | 2.31 | 2.31 | 2.31 | 2.31 | 2.31 | 2.31 |
| #6 | 12.60 | 12.81 | 13.02 | 13.23 | 13.44 | 13.65 | 13.86 | 14.07 | 14.28 | 14.49 | 14.70 | 14.91 |
| — | 2.31 | 2.31 | 2.31 | 2.31 | 2.31 | 2.31 | 2.31 | 2.32 | 2.32 | 2.32 | 2.32 | 2.32 |
| #7 | 15.12 | 15.33 | 15.54 | 15.75 | 15.96 | 16.17 | 16.38 | 16.59 | 16.80 | 17.01 | 17.22 | 17.43 |
| — | 2.32 | 2.33 | 2.33 | 2.33 | 2.33 | 2.33 | 2.33 | 2.34 | 2.34 | 2.34 | 2.34 | 2.34 |
| #8 | 17.64 | 17.85 | 18.06 | 18.27 | 18.48 | 18.69 | 18.90 | 19.11 | 19.32 | 19.53 | 19.74 | 19.95 |
| — | 2.34 | 2.34 | 2.34 | 2.34 | 2.34 | 2.34 | 2.34 | 2.34 | 2.34 | 2.34 | 2.34 | 2.33 |
| #9 | 20.16 | 20.37 | 20.58 | 20.79 | 21.00 | 21.21 | 21.42 | 21.63 | 21.84 | 22.05 | 22.26 | 22.47 |
| — | 2.33 | 2.33 | 2.33 | 2.33 | 2.33 | 2.33 | 2.32 | 2.32 | 2.32 | 2.32 | 2.32 | 2.32 |
| #10 | 22.68 | 22.89 | 23.10 | 23.31 | 23.52 | 23.73 | 23.94 | 24.15 | 24.86 | 24.57 | 24.78 | 24.99 |
| — | 2.32 | 2.32 | 2.32 | 2.32 | 2.32 | 2.32 | 2.32 | 2.32 | 2.33 | 2.33 | 2.33 | 2.33 |
| #11 | 25.20 | 25.41 | 25.62 | 25.83 | 26.04 | 26.25 | 26.46 | 26.67 | 26.88 | 27.09 | 27.30 | 27.51 |
| — | 2.34 | 2.34 | 2.35 | 2.35 | 2.36 | 2.36 | 2.37 | 2.38 | 2.38 | 2.39 | 2.40 | 2.41 |
| #12 | 27.72 | 27.93 | 28.14 | 28.35 | 28.56 | 28.77 | 28.98 | 29.19 | 29.40 | 29.61 | 29.82 | 30.03 |
| — | 2.41 | 2.42 | 2.43 | 2.44 | 2.45 | 2.45 | 2.46 | 2.47 | 2.48 | 2.49 | 2.50 | 2.50 |
| #13 | 30.24 | 30.45 | 30.86 | 30.87 | 31.08 | 31.29 | 31.50 | 31.71 | 31.92 | 32.13 | 32.34 | 32.55 |
| — | 2.51 | 2.52 | 2.53 | 2.53 | 2.54 | 2.55 | 2.55 | 2.56 | 2.56 | 2.57 | 2.57 | 2.57 |
| #14 | 32.76 | 32.97 | 33.18 | 33.39 | 33.60 | 33.81 | 34.02 | 34.23 | 34.44 | 34.65 | 34.86 | 35.07 |
| — | 2.58 | 2.58 | 2.58 | 2.58 | 2.58 | 2.58 | 2.58 | 2.58 | 2.58 | 2.58 | 2.58 | 2.58 |
| #15 | 35.28 | 35.49 | 35.70 | 35.91 | 36.12 | 36.33 | 36.54 | 36.75 | 36.96 | 37.17 | 37.38 | 37.59 |
| — | 2.57 | 2.57 | 2.57 | 2.57 | 2.56 | 2.56 | 2.56 | 2.55 | 2.55 | 2.55 | 2.54 | 2.54 |
| #16 | 37.80 | 38.01 | 38.22 | 38.43 | 38.64 | 38.85 | 39.06 | 39.27 | 39.48 | 39.69 | 39.90 | 40.11 |
| — | 2.54 | 2.53 | 2.53 | 2.53 | 2.53 | 2.52 | 2.52 | 2.52 | 2.52 | 2.52 | 2.52 | 2.52 |
| #17 | 40.32 | 40.53 | 40.74 | 40.95 | 41.16 | 41.37 | 41.58 | 41.79 | 42.00 | 42.21 | 42.42 | 42.63 |
| — | 2.52 | 2.52 | 2.52 | 2.53 | 2.53 | 2.53 | 2.53 | 2.53 | 2.54 | 2.54 | 2.54 | 2.55 |
| #18 | 42.84 | 43.05 | 43.26 | 43.47 | 43.68 | 43.89 | 44.10 | 44.31 | 44.52 | 44.73 | 44.94 | 45.15 |
| — | 2.55 | 2.55 | 2.55 | 2.56 | 2.56 | 2.56 | 2.56 | 2.56 | 2.57 | 2.57 | 2.57 | 2.56 |
| #19 | 45.36 | 45.57 | 45.78 | 45.99 | 46.20 | 46.41 | 46.62 | 46.83 | 47.04 | 47.25 | 47.46 | 47.67 |
| — | 2.56 | 2.56 | 2.56 | 2.56 | 2.55 | 2.55 | 2.54 | 2.54 | 2.53 | 2.52 | 2.51 | 2.50 |
| #20 | 47.88 | 48.09 | 48.30 | 48.51 | 48.72 | 48.93 | 49.14 | 49.35 | 49.56 | 49.77 | 49.98 | 50.19 |
| — | 2.49 | 2.48 | 2.47 | 2.46 | 2.45 | 2.44 | 2.42 | 2.41 | 2.40 | 2.38 | 2.37 | 2.35 |
| #21 | 50.40 | 50.61 | 50.82 | 51.03 | 51.24 | 51.45 | 51.66 | 51.87 | 52.08 | 52.29 | 52.50 | 52.71 |
| — | 2.34 | 2.33 | 2.33 | 2.30 | 2.38 | 2.27 | 2.26 | 2.24 | 2.23 | 2.22 | 2.21 | 2.19 |
| #22 | 52.92 | 53.13 | 53.34 | 53.55 | 53.76 | 53.97 | 54.18 | 54.39 | 54.60 | 54.81 | 55.02 | 55.23 |
| — | 2.18 | 2.17 | 2.17 | 2.16 | 2.15 | 2.14 | 2.14 | 2.13 | 2.13 | 2.12 | 2.12 | 2.12 |
| #23 | 55.44 | 55.65 | 55.86 | 56.07 | 56.28 | 56.49 | 56.70 | 56.91 | 57.12 | 57.33 | 57.54 | 57.75 |
| — | 2.12 | 2.12 | 2.12 | 2.12 | 2.12 | 2.12 | 2.12 | 2.12 | 2.13 | 2.13 | 2.14 | 2.14 |
| #24 | 57.96 | 58.17 | 58.38 | 58.59 | 58.80 | 59.01 | 59.22 | 59.43 | 59.64 | 59.85 | 60.06 | 60.27 |
| — | 2.15 | 2.15 | 2.16 | 2.16 | 2.17 | 2.17 | 2.18 | 2.18 | 2.19 | 2.19 | 2.19 | 2.20 |
| #25 | 60.48 | 60.69 | 60.90 | 61.11 | 61.32 | 61.53 | 61.74 | 61.95 | 62.16 | 62.37 | 62.58 | 62.79 |
| — | 2.20 | 2.20 | 2.20 | 2.21 | 2.21 | 2.21 | 2.21 | 2.21 | 2.20 | 2.20 | 2.20 | 2.20 |
| #26 | 63.00 | 63.21 | 63.42 | 63.63 | 63.84 | 64.05 | 64.26 | 64.47 | 64.68 | 64.89 | 65.10 | 65.31 |
| — | 2.19 | 2.19 | 2.19 | 2.18 | 2.18 | 2.17 | 2.17 | 2.16 | 2.16 | 2.15 | 2.15 | 2.14 |
| #27 | 65.52 | 65.73 | 65.94 | 66.15 | 66.36 | 66.57 | 66.78 | 66.99 | 67.20 | 67.41 | 67.62 | 67.83 |
| — | 2.14 | 2.14 | 2.13 | 2.13 | 2.13 | 2.13 | 2.13 | 2.13 | 2.13 | 2.13 | 2.14 | 2.14 |
| #28 | 68.04 | 68.25 | 68.46 | 68.67 | 68.88 | 69.09 | 69.30 | 69.51 | 69.72 | 69.93 | 70.14 | 70.35 |
| — | 2.15 | 2.18 | 2.16 | 2.17 | 2.19 | 2.20 | 2.21 | 2.23 | 2.25 | 2.26 | 2.28 | 2.30 |
| #29 | 70.56 | 70.77 | 70.98 | 71.19 | 71.40 | 71.61 | 71.82 | 72.03 | 72.24 | 72.45 | 72.66 | 72.87 |
| — | 2.33 | 2.33 | 2.37 | 2.40 | 2.42 | 2.45 | 2.48 | 2.51 | 2.54 | 2.57 | 2.60 | 2.63 |
| #30 | 73.08 | 73.29 | 73.50 | 73.71 | 73.92 | 74.13 | 74.34 | 74.55 | 74.76 | 74.97 | 75.18 | 75.39 |
| — | 2.68 | 2.69 | 2.72 | 2.75 | 2.77 | 2.80 | 2.83 | 2.86 | 2.88 | 2.90 | 2.93 | 2.95 |

TABLE 13

| Center conductor widths (2/3) | | | | | | | | | | | | |
|---|---|---|---|---|---|---|---|---|---|---|---|---|
| #31 | 75.60 | 75.81 | 76.02 | 76.23 | 76.44 | 76.65 | 76.86 | 77.07 | 77.28 | 77.49 | 77.70 | 77.91 |
| — | 2.97 | 2.98 | 3.00 | 3.01 | 3.03 | 3.04 | 3.04 | 3.05 | 3.05 | 3.06 | 3.06 | 3.06 |
| #32 | 78.12 | 78.33 | 78.54 | 78.75 | 78.96 | 79.17 | 70.38 | 79.58 | 79.80 | 80.01 | 80.22 | 80.43 |
| — | 3.05 | 3.05 | 3.04 | 3.03 | 3.03 | 3.02 | 3.01 | 2.99 | 2.98 | 2.97 | 2.96 | 2.94 |
| #33 | 80.64 | 80.85 | 81.06 | 81.27 | 81.48 | 81.69 | 81.90 | 82.11 | 82.32 | 82.53 | 82.74 | 82.95 |
| — | 2.93 | 2.92 | 2.91 | 2.90 | 2.88 | 2.87 | 2.86 | 2.86 | 2.85 | 2.84 | 2.84 | 2.84 |

TABLE 13-continued

| Center conductor widths (2/3) | | | | | | | | | | | | |
|---|---|---|---|---|---|---|---|---|---|---|---|---|
| #34 | 83.16 | 83.37 | 83.58 | 83.79 | 84.00 | 84.21 | 84.42 | 84.63 | 84.84 | 85.05 | 85.26 | 85.47 |
| — | 2.83 | 2.83 | 2.84 | 2.84 | 2.84 | 2.85 | 2.86 | 2.86 | 2.87 | 2.89 | 2.90 | 2.91 |
| #35 | 85.68 | 85.89 | 86.10 | 86.31 | 86.52 | 86.73 | 86.94 | 87.15 | 87.36 | 87.57 | 87.78 | 87.99 |
| — | 2.93 | 2.94 | 2.96 | 2.97 | 2.98 | 3.00 | 3.02 | 3.03 | 3.05 | 3.06 | 3.07 | 3.08 |
| #36 | 88.20 | 88.41 | 88.62 | 88.83 | 89.04 | 89.25 | 89.46 | 89.67 | 89.88 | 90.09 | 90.39 | 90.51 |
| — | 3.08 | 3.09 | 3.09 | 3.09 | 3.08 | 3.07 | 3.06 | 3.04 | 3.02 | 3.00 | 2.97 | 2.94 |
| #37 | 90.72 | 90.93 | 91.14 | 91.36 | 91.56 | 91.77 | 91.98 | 92.19 | 92.40 | 92.61 | 92.82 | 93.03 |
| — | 2.90 | 2.86 | 2.81 | 2.76 | 2.71 | 2.65 | 2.59 | 2.52 | 2.45 | 2.38 | 2.31 | 2.24 |
| #38 | 93.24 | 93.45 | 93.66 | 93.87 | 94.08 | 94.29 | 94.50 | 94.71 | 94.92 | 95.13 | 95.34 | 95.55 |
| — | 2.16 | 2.08 | 2.01 | 1.93 | 1.85 | 1.77 | 1.70 | 1.62 | 1.55 | 1.47 | 1.40 | 1.33 |
| #39 | 95.76 | 95.97 | 96.18 | 96.39 | 96.60 | 96.81 | 97.02 | 97.23 | 97.44 | 97.65 | 97.85 | 98.07 |
| — | 1.27 | 1.21 | 1.15 | 1.09 | 1.04 | 0.99 | 0.94 | 0.90 | 0.86 | 0.82 | 0.79 | 0.76 |
| #40 | 98.28 | 98.49 | 98.70 | 98.91 | 99.12 | 99.33 | 99.54 | 99.75 | 99.96 | 100.17 | 100.38 | 100.59 |
| — | 0.73 | 0.71 | 0.69 | 0.68 | 0.67 | 0.66 | 0.66 | 0.66 | 0.65 | 0.67 | 0.68 | 0.69 |
| #41 | 100.80 | 101.01 | 101.22 | 101.43 | 101.64 | 101.85 | 102.06 | 102.27 | 102.48 | 102.69 | 102.90 | 103.11 |
| — | 0.71 | 0.74 | 0.76 | 0.80 | 0.84 | 0.88 | 0.93 | 0.99 | 1.05 | 1.12 | 1.20 | 1.28 |
| #42 | 103.32 | 103.53 | 103.74 | 103.95 | 104.16 | 104.37 | 104.58 | 104.79 | 105.00 | 105.21 | 105.42 | 105.63 |
| — | 1.38 | 1.48 | 1.58 | 1.70 | 1.83 | 1.96 | 2.11 | 2.26 | 2.43 | 2.60 | 2.79 | 2.98 |
| #43 | 105.84 | 106.06 | 106.26 | 106.47 | 106.68 | 106.89 | 107.10 | 107.31 | 107.52 | 107.73 | 107.94 | 108.15 |
| — | 3.18 | 3.39 | 3.61 | 3.84 | 4.07 | 4.32 | 4.50 | 4.82 | 5.07 | 5.33 | 5.58 | 5.84 |
| #44 | 108.36 | 108.57 | 108.78 | 108.99 | 109.20 | 109.41 | 109.62 | 109.83 | 110.04 | 110.25 | 110.46 | 110.67 |
| — | 6.09 | 6.34 | 6.57 | 6.80 | 7.02 | 7.32 | 7.40 | 7.56 | 7.70 | 7.82 | 7.91 | 7.97 |
| #45 | 110.88 | 111.00 | 111.30 | 111.51 | 111.72 | 111.93 | 112.14 | 112.35 | 112.56 | 112.77 | 112.98 | 113.19 |
| — | 8.01 | 8.02 | 8.00 | 7.95 | 7.88 | 7.77 | 7.65 | 7.49 | 7.32 | 7.12 | 6.91 | 6.68 |
| #46 | 113.40 | 113.61 | 113.82 | 114.03 | 114.24 | 114.45 | 114.66 | 114.87 | 115.08 | 115.29 | 115.50 | 116.71 |
| — | 6.44 | 6.19 | 5.93 | 5.65 | 5.39 | 5.12 | 4.85 | 4.58 | 4.31 | 4.05 | 3.80 | 3.55 |
| #47 | 115.92 | 116.13 | 116.34 | 116.55 | 116.76 | 116.97 | 117.18 | 117.39 | 117.60 | 117.81 | 118.02 | 118.23 |
| — | 3.31 | 3.08 | 2.86 | 2.65 | 2.45 | 2.26 | 2.08 | 1.91 | 1.75 | 1.60 | 1.46 | 1.33 |
| #48 | 118.44 | 118.65 | 118.85 | 119.07 | 119.28 | 119.49 | 119.70 | 119.91 | 120.12 | 120.33 | 120.54 | 120.75 |
| — | 1.21 | 1.10 | 1.00 | 0.91 | 0.83 | 0.75 | 0.69 | 0.63 | 0.57 | 0.53 | 0.49 | 0.46 |
| #49 | 120.96 | 121.17 | 121.38 | 121.59 | 121.80 | 122.01 | 122.22 | 122.43 | 122.64 | 122.85 | 123.06 | 123.27 |
| — | 0.42 | 0.40 | 0.37 | 0.35 | 0.34 | 0.33 | 0.33 | 0.32 | 0.32 | 0.32 | 0.33 | 0.34 |
| #50 | 123.48 | 123.69 | 123.90 | 124.11 | 124.32 | 124.53 | 124.74 | 124.95 | 125.16 | 125.37 | 125.58 | 125.79 |
| — | 0.35 | 0.37 | 0.39 | 0.41 | 0.44 | 0.47 | 0.51 | 0.55 | 0.60 | 0.66 | 0.72 | 0.79 |
| #51 | 126.00 | 126.21 | 126.42 | 126.63 | 126.84 | 127.05 | 127.26 | 127.47 | 127.68 | 127.89 | 128.19 | 128.31 |
| — | 0.86 | 0.94 | 1.03 | 1.13 | 1.24 | 1.35 | 1.47 | 1.60 | 1.73 | 1.88 | 2.03 | 2.10 |
| #52 | 128.52 | 125.73 | 126.94 | 129.15 | 129.36 | 129.57 | 129.78 | 129.99 | 130.20 | 130.41 | 130.02 | 130.83 |
| — | 2.35 | 2.52 | 2.70 | 2.88 | 3.07 | 3.26 | 3.45 | 3.65 | 3.84 | 4.04 | 4.23 | 4.42 |
| #53 | 131.04 | 131.25 | 131.46 | 131.67 | 131.88 | 132.09 | 132.30 | 132.51 | 132.72 | 132.93 | 133.14 | 133.35 |
| — | 4.61 | 4.79 | 4.97 | 5.13 | 5.29 | 5.43 | 5.56 | 5.68 | 5.78 | 5.87 | 5.94 | 5.99 |
| #54 | 133.56 | 133.77 | 133.98 | 134.13 | 134.40 | 134.61 | 134.82 | 135.03 | 135.24 | 135.45 | 135.65 | 135.87 |
| — | 6.03 | 6.05 | 6.05 | 6.04 | 6.01 | 5.96 | 5.90 | 5.82 | 5.73 | 5.63 | 5.52 | 5.40 |
| #55 | 136.08 | 136.29 | 136.50 | 136.71 | 136.92 | 137.13 | 137.34 | 137.55 | 137.76 | 137.97 | 138.18 | 138.39 |
| — | 5.27 | 5.13 | 4.99 | 4.85 | 4.70 | 4.55 | 4.40 | 4.25 | 4.11 | 3.96 | 3.82 | 3.68 |
| #56 | 138.60 | 138.81 | 139.02 | 139.23 | 139.44 | 139.65 | 139.86 | 140.07 | 140.28 | 140.49 | 140.70 | 140.91 |
| — | 3.54 | 3.41 | 3.28 | 3.16 | 3.04 | 2.93 | 2.82 | 2.72 | 2.63 | 2.54 | 2.45 | 2.38 |
| #57 | 141.12 | 141.33 | 141.54 | 141.75 | 141.96 | 142.17 | 142.38 | 142.59 | 142.80 | 143.01 | 143.22 | 143.43 |
| — | 2.30 | 2.24 | 2.18 | 2.12 | 2.07 | 2.02 | 1.98 | 1.94 | 1.91 | 1.88 | 1.86 | 1.83 |
| #58 | 143.64 | 143.65 | 144.05 | 144.27 | 144.48 | 144.69 | 144.90 | 145.11 | 145.32 | 145.53 | 145.74 | 145.95 |
| — | 1.82 | 1.80 | 1.79 | 1.79 | 1.78 | 1.78 | 1.78 | 1.78 | 1.79 | 1.80 | 1.80 | 1.81 |
| #59 | 146.16 | 146.37 | 146.58 | 146.79 | 147.00 | 147.21 | 147.42 | 147.63 | 147.84 | 148.05 | 148.25 | 148.47 |
| — | 1.83 | 1.84 | 1.85 | 1.86 | 1.88 | 1.89 | 1.90 | 1.92 | 1.93 | 1.94 | 1.95 | 1.96 |
| #60 | 146.68 | 148.89 | 149.10 | 149.31 | 149.52 | 149.73 | 149.94 | 150.15 | 150.36 | 150.57 | 150.78 | 150.99 |
| — | 1.97 | 1.98 | 1.98 | 1.98 | 1.98 | 1.98 | 1.98 | 1.98 | 1.97 | 1.97 | 1.96 | 1.95 |

TABLE 14

| Center conductor widths (3/3) | | | | | | | | | | | | |
|---|---|---|---|---|---|---|---|---|---|---|---|---|
| #61 | 151.20 | 151.41 | 151.62 | 151.83 | 152.04 | 152.25 | 152.46 | 152.67 | 152.88 | 153.09 | 153.30 | 153.51 |
| — | 1.94 | 1.92 | 1.91 | 1.89 | 1.87 | 1.86 | 1.84 | 1.82 | 1.80 | 1.78 | 1.76 | 1.74 |
| #62 | 153.72 | 153.93 | 154.14 | 154.35 | 154.56 | 154.77 | 154.98 | 155.19 | 155.40 | 155.61 | 155.82 | 156.03 |
| — | 1.72 | 1.71 | 1.69 | 1.67 | 1.66 | 1.65 | 1.63 | 1.62 | 1.61 | 1.61 | 1.60 | 1.60 |
| #63 | 156.24 | 156.45 | 156.66 | 156.87 | 157.08 | 157.29 | 157.50 | 157.71 | 157.92 | 158.13 | 158.34 | 158.55 |
| — | 1.60 | 1.60 | 1.60 | 1.61 | 1.62 | 1.63 | 1.64 | 1.66 | 1.68 | 1.70 | 1.73 | 1.75 |
| #64 | 158.76 | 158.97 | 159.18 | 159.39 | 159.60 | 159.81 | 160.02 | 160.23 | 160.44 | 160.65 | 160.85 | 161.07 |
| — | 1.78 | 1.81 | 1.85 | 1.89 | 1.93 | 1.97 | 2.01 | 2.06 | 2.11 | 2.16 | 2.21 | 2.27 |
| #65 | 161.28 | 161.49 | 161.70 | 161.91 | 162.12 | 162.33 | 162.54 | 162.75 | 162.96 | 163.17 | 163.38 | 163.59 |
| — | 2.32 | 2.38 | 2.44 | 2.50 | 2.56 | 2.62 | 2.68 | 2.74 | 2.80 | 2.85 | 2.91 | 2.97 |
| #66 | 163.80 | 164.01 | 164.22 | 164.43 | 164.64 | 164.85 | 165.06 | 165.27 | 165.48 | 165.69 | 165.90 | 166.11 |
| — | 3.02 | 3.07 | 3.12 | 3.17 | 3.21 | 3.25 | 3.29 | 3.33 | 3.36 | 3.38 | 3.40 | 3.42 |
| #67 | 166.32 | 166.53 | 166.74 | 166.95 | 167.16 | 167.37 | 167.58 | 167.79 | 168.00 | 168.21 | 168.42 | 168.63 |
| — | 3.44 | 3.45 | 3.45 | 3.45 | 3.45 | 3.44 | 3.43 | 3.42 | 3.40 | 3.38 | 3.36 | 3.34 |

TABLE 14-continued

| Center conductor widths (3/3) | | | | | | | | | | | | |
|---|---|---|---|---|---|---|---|---|---|---|---|---|
| #68 | 168.84 | 169.05 | 169.26 | 169.47 | 169.68 | 169.89 | 170.10 | 170.31 | 170.52 | 170.73 | 170.94 | 171.15 |
| — | 3.31 | 3.28 | 3.25 | 3.21 | 3.18 | 3.14 | 3.11 | 3.07 | 3.03 | 3.00 | 2.96 | 2.92 |
| #69 | 171.36 | 171.57 | 171.78 | 171.99 | 172.20 | 172.41 | 172.62 | 172.83 | 173.04 | 173.25 | 173.46 | 173.67 |
| — | 2.89 | 2.85 | 2.82 | 2.79 | 2.76 | 2.72 | 2.70 | 2.67 | 2.64 | 2.62 | 2.60 | 2.58 |
| #70 | 173.88 | 174.08 | 174.30 | 174.51 | 174.72 | 174.93 | 175.14 | 175.35 | 175.56 | 175.77 | 175.98 | 176.19 |
| — | 2.56 | 2.54 | 2.53 | 2.51 | 2.50 | 2.49 | 2.48 | 2.48 | 2.47 | 2.47 | 2.47 | 2.46 |
| #71 | 176.40 | 176.61 | 176.82 | 177.03 | 177.24 | 177.45 | 177.66 | 177.87 | 178.08 | 178.29 | 178.50 | 178.71 |
| — | 2.46 | 2.46 | 2.46 | 2.47 | 2.47 | 2.47 | 2.47 | 2.48 | 2.48 | 2.48 | 2.49 | 2.49 |
| #72 | 178.92 | 179.13 | 179.34 | 179.55 | 179.76 | 179.97 | 180.18 | 180.39 | 180.60 | 180.81 | 181.02 | 181.23 |
| — | 2.49 | 2.49 | 2.49 | 2.49 | 2.49 | 2.49 | 2.48 | 2.48 | 2.47 | 2.46 | 2.45 | 2.44 |
| #73 | 181.44 | 181.65 | 181.86 | 182.07 | 182.28 | 182.49 | 182.70 | 182.91 | 183.12 | 183.33 | 183.54 | 183.75 |
| — | 2.43 | 2.41 | 2.40 | 2.38 | 2.37 | 2.35 | 2.33 | 2.31 | 2.28 | 2.26 | 2.24 | 2.21 |
| #74 | 183.96 | 184.17 | 184.38 | 184.59 | 184.80 | 185.01 | 185.22 | 185.43 | 185.64 | 185.85 | 186.06 | 186.27 |
| — | 2.19 | 2.16 | 2.14 | 2.11 | 2.09 | 2.07 | 2.04 | 2.02 | 1.99 | 1.97 | 1.95 | 1.93 |
| #75 | 185.48 | 185.69 | 186.90 | 187.11 | 187.32 | 187.53 | 187.74 | 187.95 | 188.16 | 188.37 | 188.58 | 188.79 |
| — | 1.91 | 1.89 | 1.87 | 1.86 | 1.84 | 1.83 | 1.82 | 1.81 | 1.80 | 1.79 | 1.79 | 1.79 |
| #76 | 189.00 | 189.21 | 189.42 | 189.60 | 189.84 | 190.05 | 190.26 | 190.47 | 190.68 | 190.89 | 191.10 | 191.31 |
| — | 1.79 | 1.79 | 1.79 | 1.79 | 1.80 | 1.81 | 1.82 | 1.83 | 1.84 | 1.86 | 1.87 | 1.89 |
| #77 | 191.52 | 191.73 | 191.94 | 192.15 | 192.36 | 192.57 | 192.78 | 192.99 | 193.20 | 193.41 | 193.62 | 193.83 |
| — | 1.91 | 1.93 | 1.95 | 1.98 | 2.00 | 3.03 | 2.06 | 2.08 | 2.11 | 2.14 | 2.17 | 2.20 |
| #78 | 194.04 | 194.25 | 194.46 | 194.67 | 194.88 | 195.09 | 195.30 | 195.51 | 195.72 | 195.93 | 196.14 | 196.35 |
| — | 2.23 | 2.27 | 2.30 | 2.33 | 2.36 | 2.39 | 2.42 | 2.45 | 2.47 | 2.50 | 2.53 | 2.55 |
| #79 | 196.56 | 196.77 | 196.99 | 197.19 | 197.40 | 197.61 | 197.82 | 198.03 | 198.24 | 198.45 | 198.66 | 198.87 |
| — | 2.57 | 2.60 | 2.62 | 2.64 | 2.65 | 2.67 | 2.68 | 2.69 | 2.71 | 2.71 | 2.72 | 2.73 |
| #80 | 199.08 | 199.29 | 199.50 | 199.71 | 199.92 | 200.13 | 200.34 | 200.55 | 200.76 | 200.97 | 201.18 | 201.39 |
| — | 2.73 | 2.73 | 2.74 | 2.74 | 2.73 | 2.73 | 2.73 | 2.72 | 2.72 | 2.71 | 2.70 | 2.70 |
| #81 | 201.60 | 201.81 | 202.02 | 202.23 | 202.44 | 202.65 | 202.86 | 203.07 | 203.28 | 203.49 | 203.70 | 203.91 |
| — | 2.69 | 2.68 | 2.67 | 2.67 | 2.66 | 2.65 | 2.64 | 2.64 | 2.63 | 2.62 | 2.62 | 2.61 |
| #82 | 204.12 | 204.33 | 204.54 | 204.75 | 204.96 | 205.17 | 205.38 | 205.59 | 205.80 | 206.01 | 206.22 | 206.43 |
| — | 2.61 | 2.61 | 2.60 | 2.60 | 2.60 | 2.60 | 2.60 | 2.61 | 2.61 | 2.61 | 2.62 | 2.62 |
| #83 | 206.64 | 206.85 | 207.06 | 207.27 | 207.48 | 207.69 | 207.90 | 208.11 | 208.32 | 208.53 | 208.74 | 208.95 |
| — | 2.63 | 2.64 | 2.64 | 2.65 | 2.66 | 2.67 | 2.68 | 2.69 | 2.70 | 2.71 | 2.71 | 2.72 |
| #84 | 209.18 | 209.37 | 209.58 | 209.79 | 210.00 | | | | | | | |
| — | 2.73 | 2.74 | 2.75 | 2.75 | 2.76 | | | | | | | |

Figure 25:
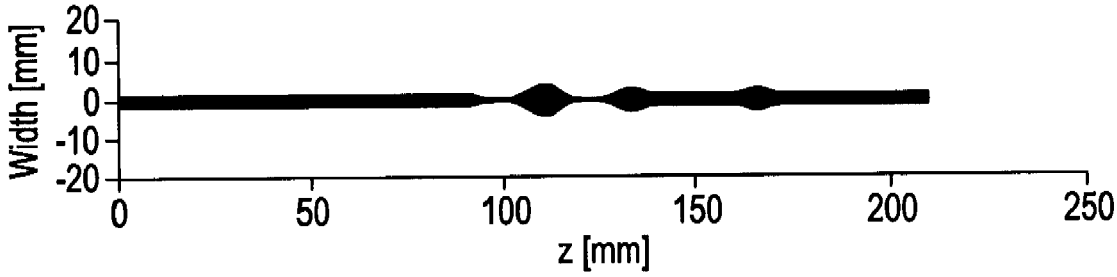
FIG. 25 is a graph showing the shape of the center conductor in the reflection-type bandpass filter manufactured in Embodiment 5.

FIG. 25 shows the shape of the center conductor 6 in the reflection-type bandpass filter 1 of Embodiment 5. In the figure, the dark portion represents the center conductor 6. A non-reflecting terminator, or an R=75Ω resistance, is provided on the terminating side (the face at z=210 mm) of this reflection-type bandpass filter 1. The thicknesses of the conducting layers 4, 5 and of the center conductor 6 may be thick compared with the skin depth at f=1 GHz. For example, when using copper, the thickness of the conducting layers 4, 5 and of the center conductor 6 may be 2.1 μm or greater. This bandpass filter is used in a system with a characteristic impedance of 75Ω.

Figure 26:
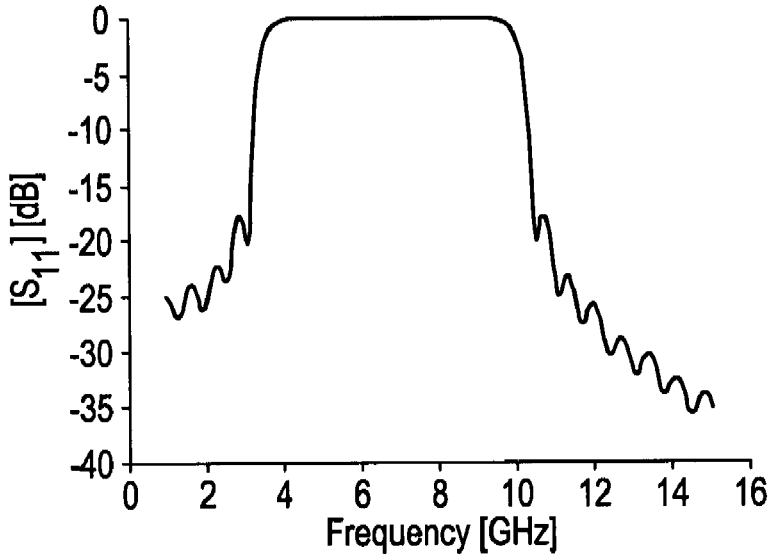
FIG. 26 is a graph showing the reflected-wave amplitude characteristic in the reflection-type bandpass filter manufactured in Embodiment 5.
Figure 27:
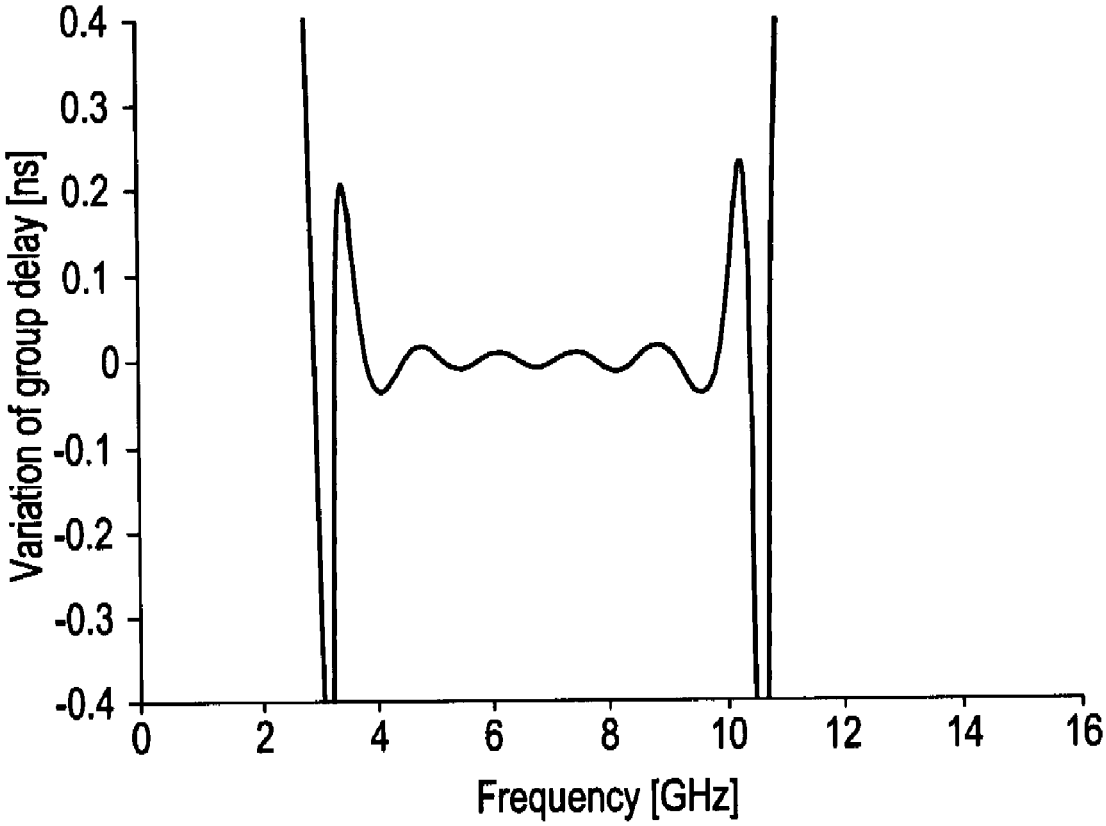
FIG. 27 is a graph showing the reflected-wave group delay characteristic in the reflection-type bandpass filter manufactured in Embodiment 5; and, FIG. 28 is an equivalent circuit of a non-uniform transmission line.

FIG. 26 and FIG. 27 show the amplitude characteristic and group delay characteristic respectively of reflected waves ($S_{11}$) in the bandpass filter of Embodiment 5. As shown in the figures, in the range of frequencies f for which 3.7 GHz≦f≦10.0 GHz, the reflectance is −2 dB or greater, and the group delay variation is within ±0.1 ns. In the region f<3.1 GHz or f>10.6 GHz, the reflectance is −15 dB or lower.

In the above, exemplary embodiments of the invention have been explained; but the invention is not limited to these embodiments. Various additions, omissions, substitutions, and other modifications to the configuration can be made, without deviating from the gist of the invention. The invention is not limited by the above explanation, but is limited only by the scope of the attached claims.

What is claimed is:

1. A reflection-type bandpass filter for ultra-wideband wireless data communication, the filter comprising:

a substrate comprising a dielectric layer and a conducting layer layered on top and bottom surfaces of the dielectric layer, and a center conductor disposed within said dielectric layer and serving as a strip line, wherein a distribution of a width of said center conductor is non-uniform in a length direction of the center conductor; and wherein a length-direction distribution of a width of the center conductor satisfies a design method based on an inverse problem of deriving a potential from spectral data in a Zakharov-Shabat equation.

2. The reflection-type bandpass filter according to claim 1, wherein a difference between a reflectance in a range of frequencies f for which f<3.1 GHz and f>10.6 GHz, and a reflectance in a range of frequencies for which 3.7 GHz≦f≦10.0 GHz, is 10 dB or greater, and wherein, in the range of frequencies for which 3.7 GHz≦f≦10.0 GHz, a group delay variation is within ±0.05 ns.

3. The reflection-type bandpass filter according to claim 1, wherein a difference between a reflectance in a range of frequencies f for which f<3.1 GHz and f>10.6 GHz, and a reflectance in a range of frequencies for which 3.9 GHz≦f≦9.8 GHz, is 10 dB or greater, and wherein, in the range of frequencies for which 3.9 GHz≦f≦9.8 GHz, a group delay variation is within ±0.07 ns.

4. The reflection-type bandpass filter according to claim 1, wherein a difference between a reflectance in a range of frequencies f for which f<3.1 GHz and f>10.6 GHz, and a reflectance in the range of frequencies for which 4.4 GHz≦f≦9.2 GHz, is 10 dB or greater, and wherein, in the range of frequencies for which 4.4 GHz≦f≦9.2 GHz, a group delay variation is within ±0.05 ns.

5. The reflection-type bandpass filter according to claim 1, wherein a difference between a reflectance in a range of frequencies f for which f<3.1 GHz and f>10.6 GHz, and a reflectance in a range of frequencies for which 3.8 GHz ≦f≦9.8 GHz, is 10 dB or greater, and wherein, in the range of frequencies for which 3.8 GHz≦f≦9.8 GHz, a group delay variation is within ±0.2 ns.

6. The reflection-type bandpass filter according to claim 1, wherein a difference between a reflectance in a range of frequencies f for which f<3.1 GHz and f>10.6 GHz, and a reflectance in a range of frequencies for which 3.7 GHz≦f≦10.0 GHz, is 10 dB or greater, and wherein, in the range of frequencies for which 3.7 GHz≦f≦10.0 GHz, a group delay variation is within ±0.1 ns.

7. The reflection-type bandpass filter according to claim 1, wherein a characteristic impedance Zc of an input terminal of the bandpass filter satisfies the inequality 10 Ω≦Zc≦300Ω.

8. The reflection-type bandpass filter according to claim 7, wherein one of a resistance having an impedance equal to the characteristic impedance Zc, and a non-reflecting terminator, is provided on a terminating side of the bandpass filter.

9. The reflection-type bandpass filter according to claim 1, wherein the center conductor and the conducting layers of the substrate comprise metal plates of thickness equal to or greater than a skin depth of the metal plates at a frequency f=1 GHz.

10. The reflection-type bandpass filter according to claim 1, wherein the dielectric layer has a thickness h in a range 0.1 mm≦h≦10 mm, a relative permittivity ∈r in a range 1∈r100, a width W in a range 2 mm≦W≦100 mm, and a length L in a range 2 mm≦L≦500 mm.

11. The reflection-type bandpass filter according to claim 1, wherein the length-direction distribution of the width of the center conductor width satisfies a window function method.

12. The reflection-type bandpass filter according to claim 1, wherein the length-direction distribution of the width of the center conductor satisfies a Kaiser window function method.

* * * * *